United States Patent [19]

Stubbs et al.

[11] Patent Number: 4,760,797

[45] Date of Patent: Aug. 2, 1988

[54] METHOD AND APPARATUS FOR AUTOMATED TIE DETECTION AND TAMPING

[75] Inventors: John L. Stubbs, Charlotte, N.C.; Wesley H. Patton, Atlanta; Jeffrey L. Thompson, Lawrenceville, both of Ga.

[73] Assignee: Southern Railway Company, Atlanta, Ga.

[21] Appl. No.: 703,567

[22] Filed: Feb. 20, 1985

[51] Int. Cl.[4] ..... E01B 27/16; B61L 3/22

[52] U.S. Cl. ..... 104/12; 180/168; 364/424; 246/187 B

[58] Field of Search ..... 104/12, 16, 17 R, 17.1; 180/168, 321; 364/424.1, 424, 478; 246/187 B, 122 R

[56] References Cited

U.S. PATENT DOCUMENTS

| | | | |
|---|---|---|---|
| 1,416,076 | 5/1922 | Simmon | 246/187 B |
| 3,210,539 | 10/1965 | Malaquin | 246/122 R X |
| 3,504,635 | 4/1970 | Stewart et al. | 104/12 |
| 3,738,443 | 6/1973 | Kubo | 180/168 |
| 3,762,333 | 10/1973 | Theurer et al. | 104/12 |
| 3,942,000 | 3/1976 | Dieringer | 104/17 R X |
| 4,015,680 | 4/1977 | Pircher et al. | 180/168 |
| 4,224,874 | 9/1980 | Theurer | 104/12 |
| 4,315,129 | 2/1982 | Wilkinson et al. | 104/16 X |
| 4,334,479 | 6/1982 | Theurer | 104/12 |
| 4,401,848 | 8/1983 | Tsunoda | 364/424 X |
| 4,430,945 | 2/1984 | Theurer | 104/7 R X |
| 4,449,459 | 5/1984 | Cicin-Sain | 104/12 |

FOREIGN PATENT DOCUMENTS

| | | | |
|---|---|---|---|
| 15101 | 2/1981 | Japan | 364/424 |
| 503974 | 3/1976 | U.S.S.R. | 104/12 |

*Primary Examiner*—Robert B. Reeves
*Assistant Examiner*—Scott H. Werny
*Attorney, Agent, or Firm*—Watson, Cole et al.

[57] ABSTRACT

Apparatus for detecting at least one metallic object in a series of metallic objects lying along a path in a repetitive pattern by a metallic detector mounted on a vehicle movable along the path with the movement of the vehicle controlled by the detector to position the vehicle over a detected metallic object and blocking detection of a previously detected object subsequent to the detection of the previously detected metallic object to prevent erroneous metallic object detections, and further controlled to initiate different travel modes of movement including a fast mode to move the vehicle in a forward direction along the path at an optimum speed and controlling deceleration of the vehicle for accurately positioning it at a detected one of the metallic objects. The apparatus has particular application to the tamping of crossties on railway tracks and includes programs for controlling the movement of the vehicle and the tamping operation.

49 Claims, 23 Drawing Sheets

2-46
2-55
2-18
2-47
2-56
2-19

TAMPER DRIVE UNIT
1-12
1-14
1-10
1-18
1-40
1-30
1-22
1-32
1-27
1-28
1-23
1-16
1-21
1-20
1-25
1-43
1-26
1-53
1-52
D
1-48
1-42
1-44
1-51
2
3

4-60
4-64
4-63
4-62
4-67
4-65
4-61

4-66
4-64
4-61
4-65

2-48
2-54
2-46
2-18
2-42
2-44
2-45
2-19
2-49
2-55
2-47

3-46
3-42
3-50
3-51
3-51'
3-47

5B-5
PEAK
5B-6
PEAK
Δ
5B-7
5B-4

5B-8
VALLEY
Δ
5B-1
5B-10
5B-2
CRIB
5B-3
TIE PLATE
TIE PLATE 5C-1
5C-2
RELATIVE PEAK DETECTOR SIGNAL TO ATFTA COMPUTER

FORWARD PERMISSIVE SIGNAL FROM ATFTA COMPUTER

DISTANCE ENCODER OUTPUT (FORWARD MOTION)

DISTANCE ENCODER OUTPUT (REVERSE MOTION)
PEAK
Δ

Δ
Δ
VALLEY
Δ
NO DETECTION
DUE TO FORP
FORP "OFF"

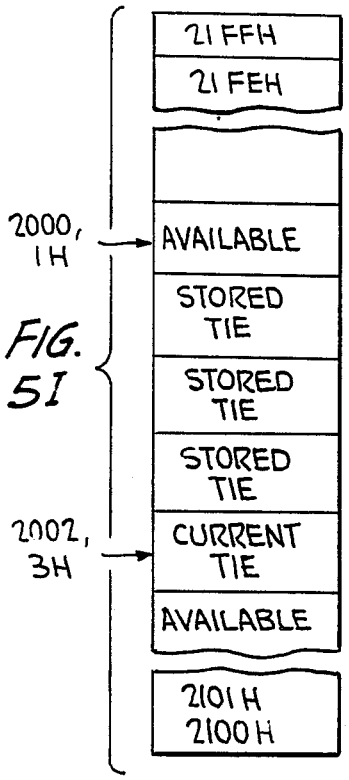
FIG. 5I
FIG. 5J
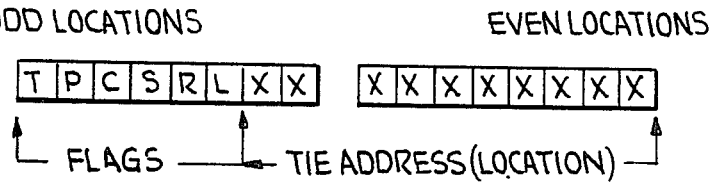
FIG. 5L
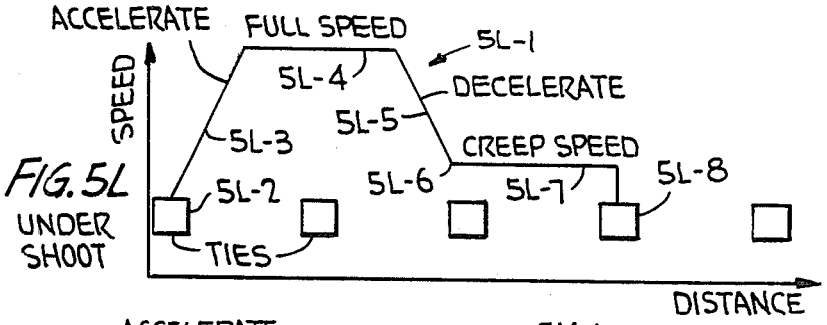
FIG. 5M
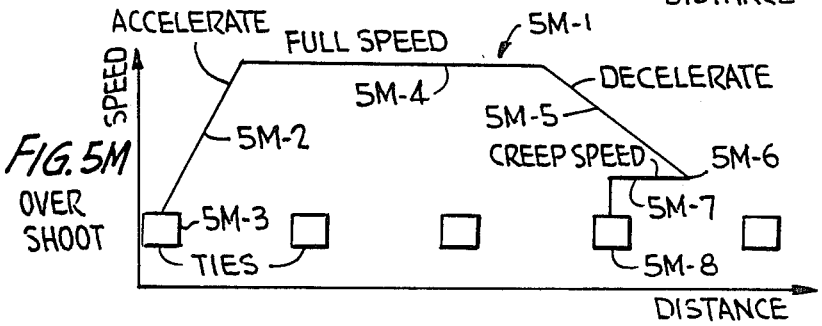
FIG. 5N
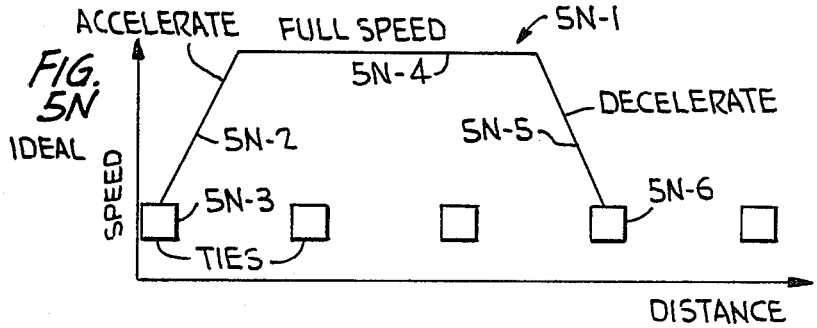
FIG. 5K
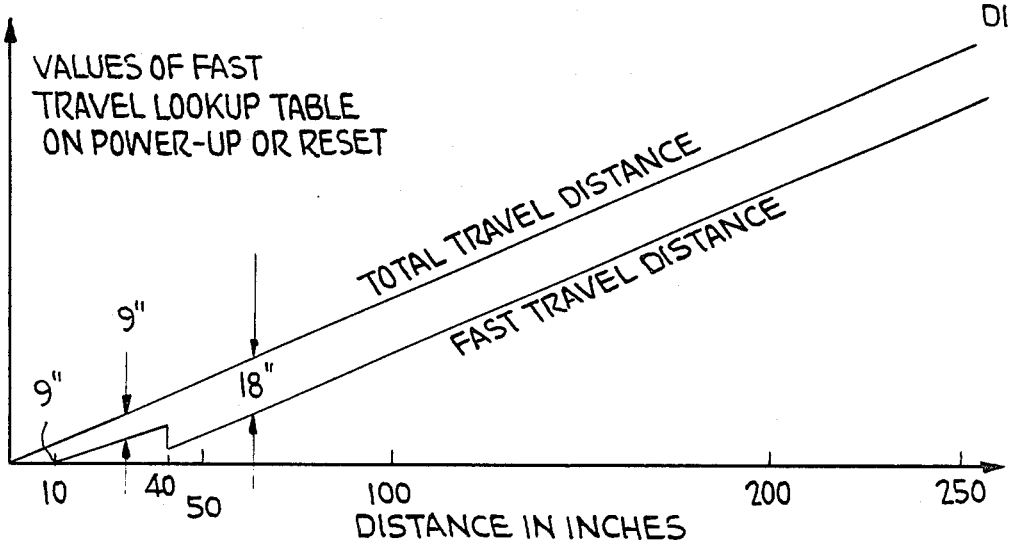

FIG. 6 TIE PLATE METAL DETECTOR
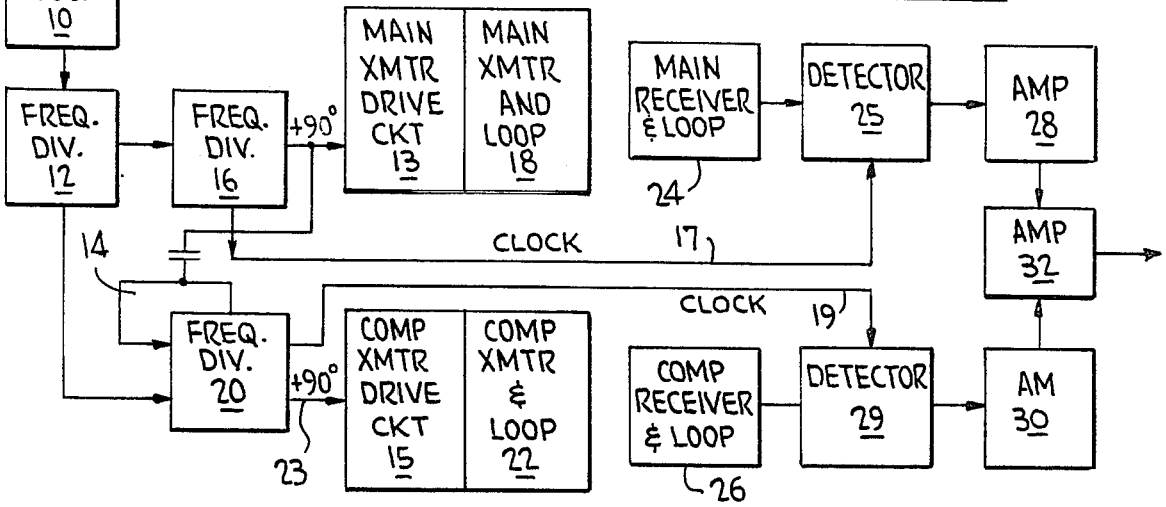
FIG. 7
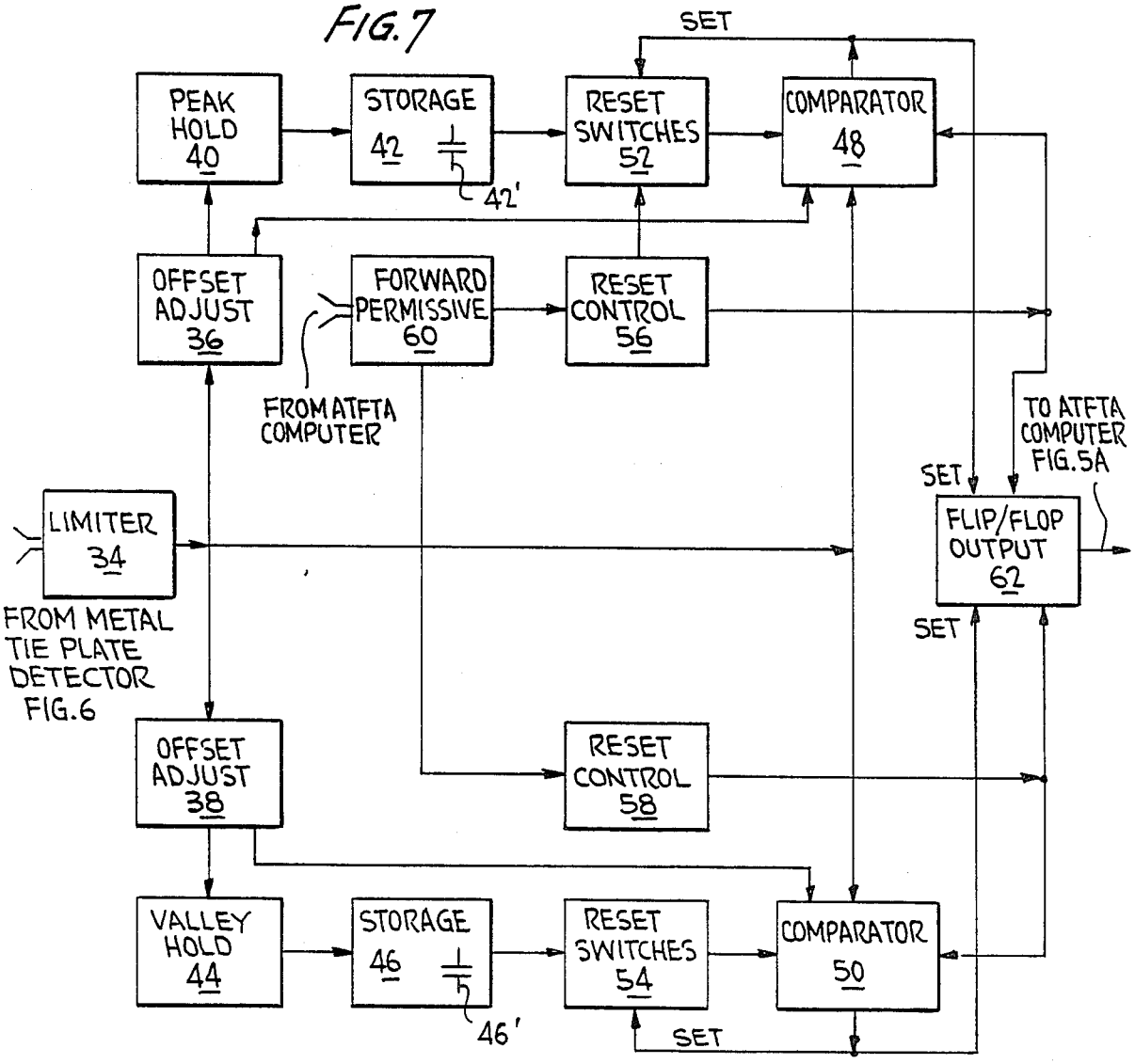

① DRIVE CKTS TO BE TUNED FOR ZERO PHASE SHIFT FROM RESPECTIVE PIN #1 OF 4013'S

② LOOPS TO BE RESONATED SO THAT TARGET SIGNAL @ $\phi$ DETECTORS IS IN PHASE WITH CLOCK DRIVE ③ LOOPS TO BE ADJUSTED FOR APPROXIMATE ZERO VOLTAGE @ FINAL OUTPUT WITH "COMP SET" TO CONCEAL JOINT PLATES

INITL-INITIALIZATION PROGRAM

ENTER-ENTER VARIABLES PROGRAM

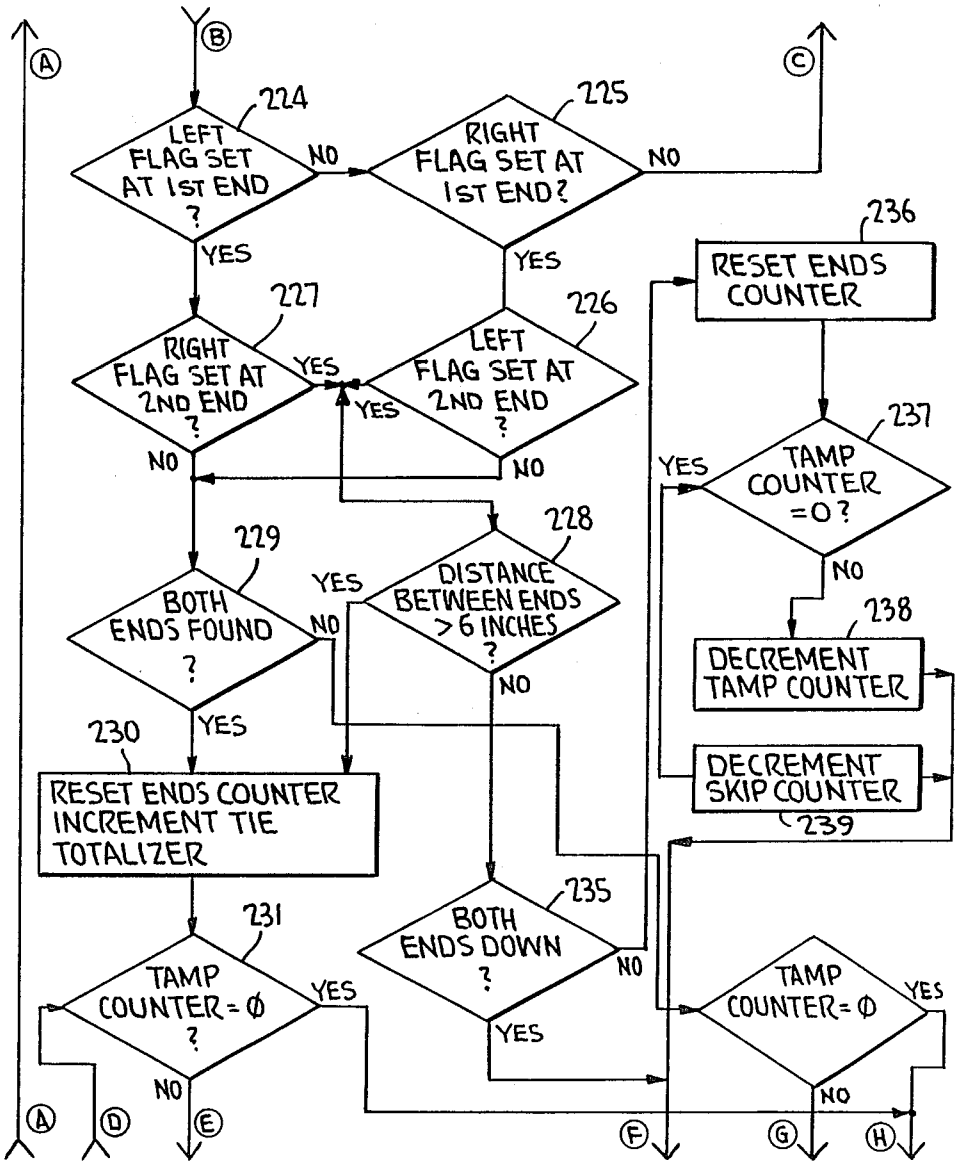
FIG. 12B
LEFT FLAG SET AT 1ST END ?
RIGHT FLAG SET AT 2ND END ?
BOTH ENDS FOUND ?
RESET ENDS COUNTER INCREMENT TIE TOTALIZER
TAMP COUNTER = Φ ?
RIGHT FLAG SET AT 1ST END ?
LEFT FLAG SET AT 2ND END ?
DISTANCE BETWEEN ENDS > 6 INCHES ?
BOTH ENDS DOWN ?
RESET ENDS COUNTER
TAMP COUNTER = 0 ?
DECREMENT TAMP COUNTER
DECREMENT SKIP COUNTER
TAMP COUNTER = Φ
YES
NO
224
225
226
227
228
229
230
231
235
236
237
238
239

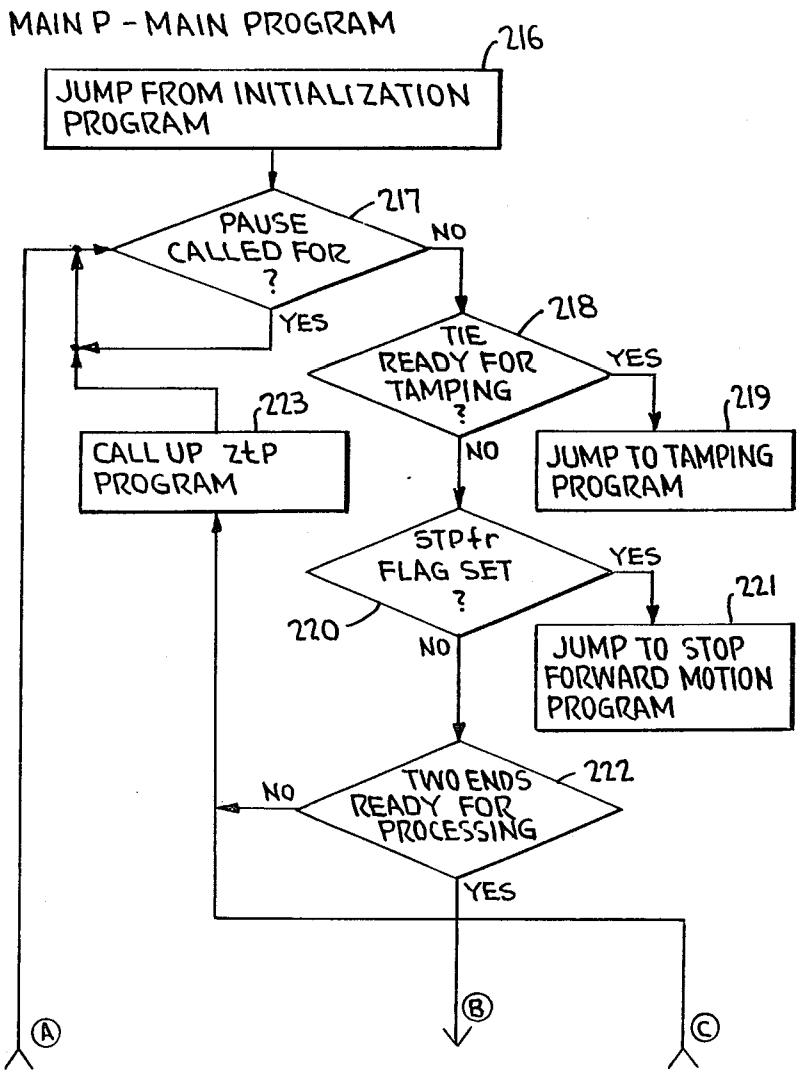
FIG. 12A
MAIN P - MAIN PROGRAM
JUMP FROM INITIALIZATION PROGRAM
PAUSE CALLED FOR ?
TIE READY FOR TAMPING ?
JUMP TO TAMPING PROGRAM
STPtr FLAG SET ?
JUMP TO STOP FORWARD MOTION PROGRAM
TWO ENDS READY FOR PROCESSING
CALL UP ZtP PROGRAM
YES
NO
216
217
218
219
220
221
222
223

START - START PROGRAM

CNTRL - CONTROL STATIONS PROGRAM

D STOP - ONE OF SEVERAL STOP PROGRAMS

D STOP - ONE OF SEVERAL STOP PROGRAMS

E STOP - ONE OF SEVERAL STOP PROGRAMS

TRAVL - FAST TRAVEL PROGRAM

FTOVR - FAST TRAVEL OVER

CREEP-CREEP DETECTOR

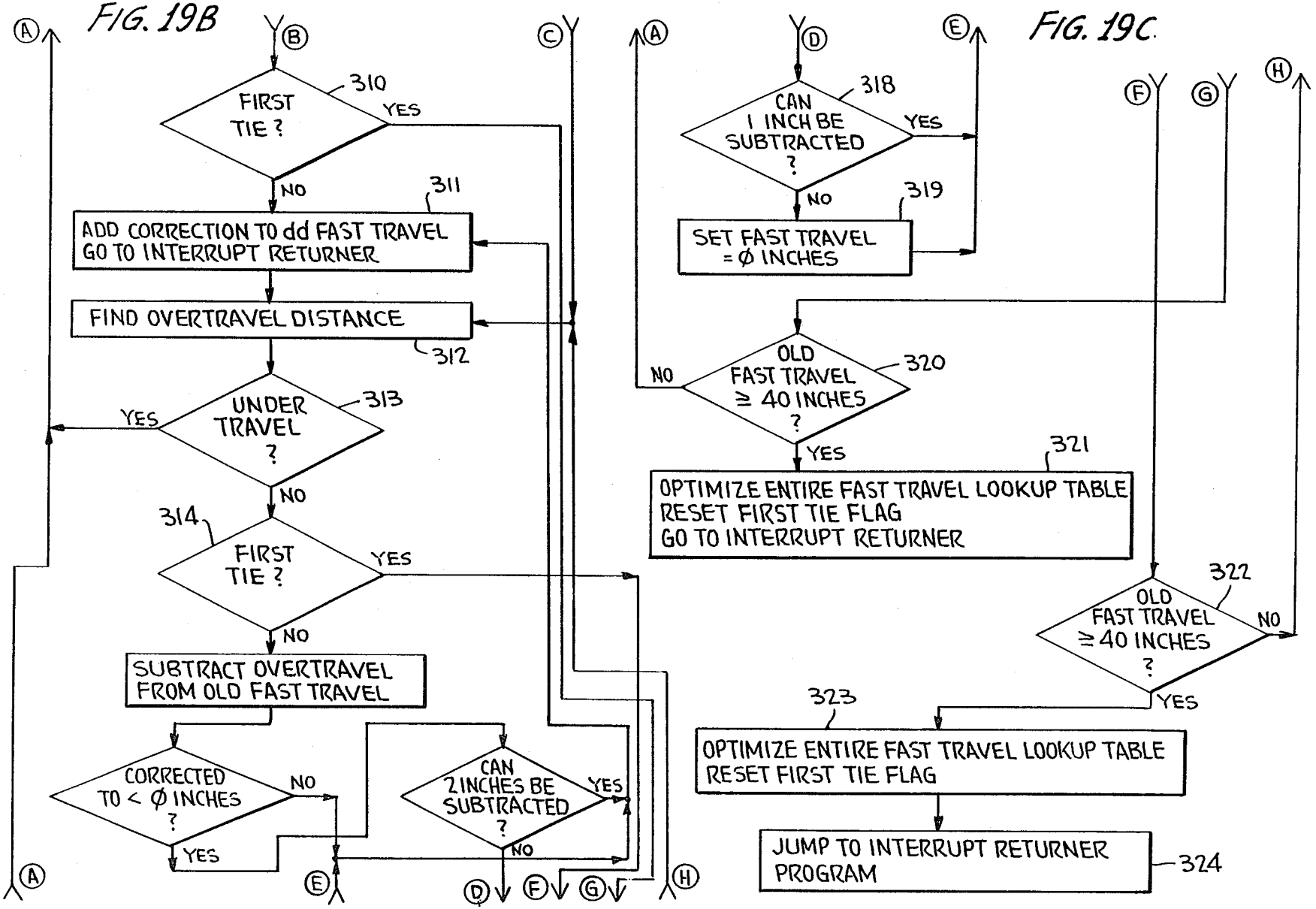
FIG. 19C
FIG. 19B
FIRST TIE ?
310
YES
NO
ADD CORRECTION TO dd FAST TRAVEL GO TO INTERRUPT RETURNER
311
FIND OVERTRAVEL DISTANCE
312
UNDER TRAVEL ?
313
YES
NO
FIRST TIE ?
314
YES
NO
SUBTRACT OVERTRAVEL FROM OLD FAST TRAVEL
CORRECTED TO < Ø INCHES ?
NO
YES
CAN 2 INCHES BE SUBTRACTED ?
YES
NO
CAN 1 INCH BE SUBTRACTED ?
318
YES
NO
SET FAST TRAVEL = Ø INCHES
319
OLD FAST TRAVEL ≥ 40 INCHES ?
320
YES
NO
OPTIMIZE ENTIRE FAST TRAVEL LOOKUP TABLE RESET FIRST TIE FLAG GO TO INTERRUPT RETURNER
321
OLD FAST TRAVEL ≥ 40 INCHES ?
322
NO
YES
OPTIMIZE ENTIRE FAST TRAVEL LOOKUP TABLE RESET FIRST TIE FLAG
323
JUMP TO INTERRUPT RETURNER PROGRAM
324
A
B
C
D
E
F
G
H

FRSTP - STOP FORWARD MOTION

STPFR - STOP FORWARD MOTION

STPRV - STOP REVERSE MOTION

TMPIT - TAMPING PROGRAM

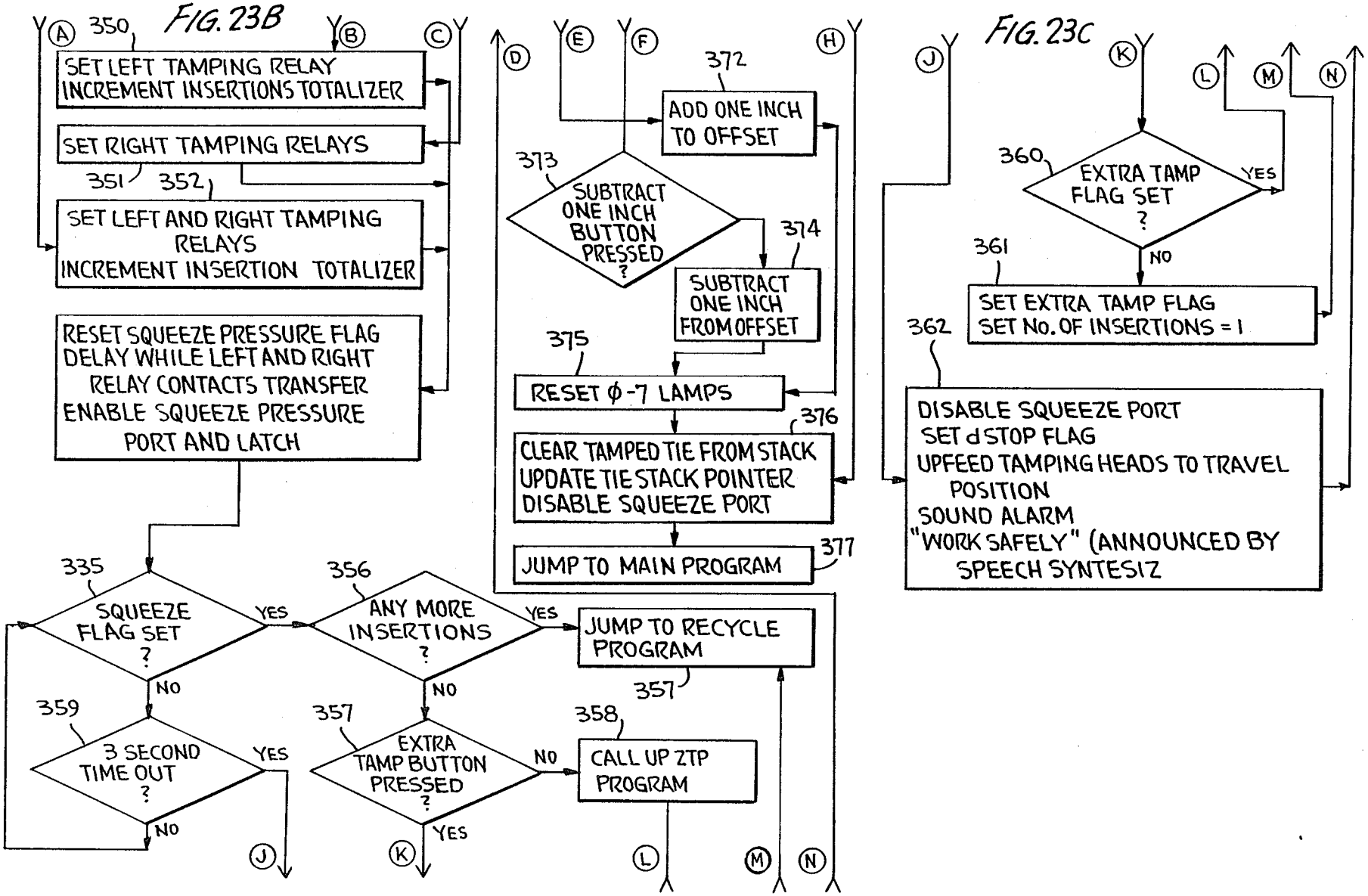
FIG. 23C
EXTRA TAMP FLAG SET ?
YES
NO
360
SET EXTRA TAMP FLAG
SET No. OF INSERTIONS = 1
361
DISABLE SQUEEZE PORT
SET dSTOP FLAG
UPFEED TAMPING HEADS TO TRAVEL POSITION
SOUND ALARM
"WORK SAFELY" (ANNOUNCED BY SPEECH SYNTESIZ
362
FIG. 23B
SET LEFT TAMPING RELAY
INCREMENT INSERTIONS TOTALIZER
350
SET RIGHT TAMPING RELAYS
351
SET LEFT AND RIGHT TAMPING RELAYS
INCREMENT INSERTION TOTALIZER
352
RESET SQUEEZE PRESSURE FLAG
DELAY WHILE LEFT AND RIGHT RELAY CONTACTS TRANSFER
ENABLE SQUEEZE PRESSURE PORT AND LATCH
SQUEEZE FLAG SET ?
335
3 SECOND TIME OUT ?
359
ANY MORE INSERTIONS ?
356
EXTRA TAMP BUTTON PRESSED ?
357
ADD ONE INCH TO OFFSET
372
SUBTRACT ONE INCH BUTTON PRESSED ?
373
SUBTRACT ONE INCH FROM OFFSET
374
RESET ϕ-7 LAMPS
375
CLEAR TAMPED TIE FROM STACK
UPDATE TIE STACK POINTER
DISABLE SQUEEZE PORT
376
JUMP TO MAIN PROGRAM
377
JUMP TO RECYCLE PROGRAM
357
CALL UP ZTP PROGRAM
358
A
B
C
D
E
F
H
J
K
L
M
N

CKEOS - RECYCLE PROGRAM

UPZTP - UPFEED TO TRAVEL POSITION

METHOD AND APPARATUS FOR AUTOMATED TIE DETECTION AND TAMPING

FIELD OF THE INVENTION

The invention relates to method and apparatus for repairing and maintaining railroad track, and in particular to such method and apparatus for automatically detecting tie plates and tamping crossties.

The repair and maintenance of railroad right of way has always been of prime consideration to ensure safe and reliable passage of passenger and freight trains, and especially over tracks that are subject to frequent and heavy freight traffic and loads. The costs of maintaining railroad track is also commensurate with such traffic as well as to the costs of labor, as such maintenance tends to be labor intensive.

In particular the tamping of crossties has always been of considerable importance in the maintenance of railroad track, and has involved commensurate time and effort in attempting to increase the productivity of maintenance operations as well as to enhance the tamping operations and associated functions therewith. To that end the aforementioned endeavors have contemplated the application of automation techniques, which have been only partially successful largely because of the failure to develop reliable and commercially feasible techniques for locating the crossties and then accurately positioning the tamping apparatus.

The ever decreasing costs as well as improvements in computer technology have given further impetus to the automation of tie detection and tamping operations to provide method and apparatus that is reliable and commercially feasible.

SUMMARY OF THE INVENTION

The automated tie finder and tamper apparatus (ATFTA) and method of the invention utilizes a microprocessor-based control system affording the capabilities of detecting, counting and tamping cross-ties in a variety of tamp and skip sequences, as well as enabling the selection of a number of tamping insertions per tie. The method and apparatus of the invention provide accurate and consistent compaction of the ballast, simple programming, both verbal and visual computer-to-operator interfacing, obstacle collision avoidance, and automatic operation without constant human intervention.

After the ATFTA has been driven to the work site, the typical START-UP procedure is as follows. With the engine throttle in the tamper drive vehicle locked in an outermost position, the tamper vibrator motors on each of a pair of tamping units mounted on the tamper drive vehicle, are separately started, with several seconds between starts to prevent an undue load on the motor alternator. After the tamper vibrators have come up to speed, the ATFTA computer is activated by the operator, which causes the RESET lamp in the operator cab of the motor drive vehicle to light, and the command "WORK SAFELY" is formulated by a speech synthesizer and annunciated from speakers, for example, one located in the operator cab and several external thereto. The speakers are located to afford sound in a region surrounding the ATFTA, and in particular to the front and rear thereof.

After a programmed delay of several seconds, the ATFTA computer annunciates the command "ENTER DISTANCE TO STOP". At this time, the ATFTA operator manually sets a DOWNCOUNTER in the computer to the total distance in feet that are desired for the ATFTA to operate before automatically stopping.

After another programmed delay of several seconds, for example, the ATFTA computer causes the command "ENTER INSERTIONS PER TIE", whereupon any number in a specified range, for example between zero and three, may be entered by the ATFTA operator on the instrument panel mounted within the operator cab, or at an outside remote control panel. The ATFTA computer is programmed to refuse entry of any other numbers, and if some other number is entered, it will not be accepted, and the aforesaid computer request will be repeated. The failure of the operator to enter a number will also cause the ATFTA conputer to repeat the annunciated request.

"ENTER TIE TO TAMP" is the next annunciated computer command and only the numbers in another specified range, for example between one to seven, will be accepted as valid inputs, which numbers represent the number of consecutive ties to be tamped before any ties are "skipped". The ATFTA computer then commands the ATFTA operator to "ENTER TIES TO SKIP", whereupon the operator may enter any number. Entering zero instructs the ATFTA computer not to "skip" any ties, i.e. tamp all ties.

The last computer command requiring operator action is "POSITION DETECTOR, THEN PRESS START". At this stage of the ATFTA program, the tamping heads are unlatched and positioned high enough to ensure clearing the rails. The operator may then dismount from the control cab on the tamper drive vehicle, and using a hand-held pendant station position a pair of metal tie detectors, suspended underneath a cart pushed by the tamper drive vehicle, over the middle of the crib before the first tie that is to be tamped.

The ATFTA operator may then depress a start button, and no further operator action is required until a tamping program change, for example, is required or desired. Upon depression of the START button on the control panel (either in the cab or in the remote control unit), the ATFTA computer commands the annunciation of "STAND CLEAR!", raises the tamping heads to the upper limit switches if necessary, and sounds the FORWARD TRAVEL alarm briefly before initiating travel of the ATFTA to the first tie, and beginning the metal tie detector and tamping operations.

The programming station within the ATFTA operator cab of the tamper drive vehicle (and also the remote operator control station) includes at least the following exemplary function switches and operating buttons. An ON/OFF switch supplies power to the ATFTA computer, which automatically resets upon the application of power. The RESET button is used whenever the ATFTA operator desires to immediately stop all computer functions, thereby returning to the beginning of the computer program. Upon depression of the RESET button, all data acquired by the computer is erased from the computer memory, including all parameters entered by the ATFTA operator, distance travel table optimization, and the tamping sequence position. The ATFTA computer operator errors may be corrected by depression of the RESET button to enable the insertion of program parameters from "scratch".

If the RESET lamp does not light after the ATFTA computer is turned on, the RESET button should be depressed.

DATA INSERT buttons one to seven, for example, light momentarily after they are depressed. The ATFTA computer is programmed not to accept certain numbers for certain parameters to impose limitations or logistical restrictions on the tie detecting and tamping operations. For example, seven insertions per tie, or the tamping of zero ties.

A DOWNCOUNTER may be loaded whenever the ATFTA computer in ON. The work distance is entered on a row of thumbwheel switches, and a RESET button on the front control panel in the operator cab (or on the remote operator control panel) is operated to load the DOWNCOUNTER. A DISPLAY continuously indicates the remaining number of feet and when "zero" is reached, the DOWNCOUNTER informs the computer to stop operation of the ATFTA.

TIE and INSERTION TOTALIZERS display the number of ties counted and the insertions made since they were last reset. A keyswitch marked TOTALIZERS RESET can be used to reset the TIE and INSERTION TOTALIZERS to "zero" whenever desired by the ATFTA operator. This feature facilitates the maintenance of records of the number of ties or insertions for each day, week, etc., or between tamping changes, for example.

The VOLUME controls adjusts the volume of the internal and external speakers for annunciation commands from the ATFTA computer.

The outside remote ATFTA operator control station includes at least the following function switches and control buttons. The START button starts or resumes automatic operation of the ATFTA. Prior to actuation of this START button, the aforementioned tamping parameters must have been entered. The command "STAND CLEAR!" is announced by the computer from the aforementioned speakers, whenever this START button is actuated. Also, the FORWARD TRAVEL ALARM is briefly actuated by the computer, and the tamping heads are upfed to their respective upper limit switches, if necessary.

The STOP button immediately halts travel of the motor drive and tamper vehicle and the tie detector cart of the ATFTA, causes the computer to upfeed the tamping heads to their respective upper limit switches, and causes the computer synthesizer to announce "PRESS RESET". After depression of the STOP button it is necessary to completely re-introduce the tamp operating parameters into the computer. The ATFTA computer does not maintain the tamping heads at their respective upper limit switches after activation of this STOP button.

The PAUSE button may be pressed a number of times to initiate different actions from the tie detector and tamping apparatus. The first actuation causes the computer to announce "WORK SAFELY" and then to await some other command or action at the end of the current or next tamping cycle. At that point in time, namely the current or next tamping cycle, the computer does not initiate travel of the tamper drive vehicle and tie detector cart to the next tie, but enters a WAITING mode. The ATFTA computer also does not maintain the tamping heads at their respective upper limit switches after actuation of this PAUSE button.

Once the tamper had entered the PAUSE mode at the end of a tamping cycle, the operator may exercise one or more of the following options. He may mount the machine and manually tamp the current tie or the previous tie. Automatic operation of the tie detector and tamping apparatus is resumed by depression of the START button. Alternatively, the operator may actuate the PAUSE button a second time.

After a few seconds, the computer will announce "ENTER INSERTIONS PER TIE". The operator may then enter new tamping parameters following each of the announced instructions commanded by the ATFTA computer as previously described. When the operator is finally informed to "POSITION DETECTOR, THEN PRESS START", the START button should only be depressed, leaving the motor drive tamper vehicle and tie detector cart of the ATFTA at its present position. Tamping action will commence with the SKIP portion on the new tamping interval.

When the computer has announced "ENTER INSERTIONS PER TIE" after the second activation of the PAUSE switch, the operator may then depress the PAUSE switch yet a third time. Now the computer will announce "POSITION DETECTOR, THEN DEPRESS START". This action is useful for maintaining the original tamping interval, while the tamper is moved through, for example, a switch crossing or other track component not to be tamped. To accomplish that, the operator simply mounts the tamper, latches the tamping heads in the travel position, moves the motor drive and tamper vehicle and tie detector cart through the crossing switch or other track component, unlatches the tamping heads, positions the metal tie detectors in the crib before the first tie to be tamped, and actuates the START button.

The EXTRA TAMP button may be used to provide one additional tamp insertion on any given tie. It is necessary to actuate the EXTRA TAMP button before the last squeeze of the tie that is to receive the extra tamp has occured. The EXTRA TAMP button may be depressed as early as after both tamping heads have reached their respective upper limit switches at the end of the tamping cycle of the tie immediately preceding the tie to be extra-tamped.

The ADD A TIE/SUBTRACT A TIE buttons are used to keep the motor drive and tamper vehicle and the tie detectors on the tie detector car operating on the proper tie or ties, thereby effectively correcting a sequence error which may originate from several sources. As the motor drive and tamper vehicle and tie detector cart of this invention usually follows a jack tamper, it is unavoidable that tamping sequence errors will occur. A sequence error is defined for the purposes of this description as that error which results in the tamping of a tie previously tamped by the jack tamper, and/or the failure to tamp the proper untamped tie while still maintaining the proper tamp-skip interval. Such errors can be caused by the incapability of the jack tamper to tamp a tie due to the presence of a joint plate or other anomaly, incorrect original positioning of the motor drive tamper vehicle and the tie detector cart, or simply a "missed" detection, more fully discussed hereinafter. In a normal sequence error, the tamping interval will be correct, but off by one tie. Such errors can readily be corrected without re-setting the computer by means of the ADD A TIE/SUBTRACT A TIE buttons. If it is noted that the tamping heads and the tie detectors of the motor drive tamper vehicle ahd the tie detector cart, respectively, are behind by one tie, the ADD A TIE button is depressed. Similarly, if it is noted that the aforementioned components are ahead by one tie, the SUBTRACT A TIE button is depressed. The time frame in which the ADD A TIE/SUBTRACT A TIE buttons are acutated, is the same as that for the EXTRA TAMP button.

The following is a summary of the tamping sequence. This mode of operation consists of positioning the tamping heads over the tie to be tamped, downfeeding the tamping heads to the bottom limit switches and squeezing-in the tamping heads, and then upfeeding the tamping heads to either the upper limit switch position and ending the TAMPING cycle, or upfeeding the tamping heads to the middle limit switch position and starting another insertion operation. Under the control of the ATFTA computer, up to three insertions may be specified, and an extra tamp operation can be requested by the operator above the number for any tie.

After the motor drive vehicle and the tie detector detectors on the tie detector cart have been positioned over a tie to be tamped, the tamping cycle proceeds as follows. Based on information from the tie detector, the ATFTA computer decides whether to tamp both ends of the tie or just one end of that tie. If the number of insertions selected is "zero", no tamping head insertion is made. The tamper merely stops momentarily over that tie before proceeding to the next tie. This operation is included as a trouble-shooting aid.

Subsequent to positioning the tamping heads over a tie, determining what end or ends of the tie to tamp, and recalling from memory the number of insertions per tie, the ATFTA computer then starts the downfeed of the tamping heads, and increments the INSERTIONS TOTALIZER. Simultaneously therewith, a DOWNFEED TIMER is started, allowing approximately five seconds from the start of downfeed to receipt of the squeeze pressure signal indicating that the proper squeeze pressure has been applied to the tamping heads in the tamping cycle.

If the time in the DOWNFEED TIMER elapses before the squeeze pressure is attained, the computer stops the tamping cycle, upfeeds the tamping heads to their respective upper limit switches, causes the FORWARD TRAVEL ALARM to be annunciated briefly, and then announces "WORK SAFELY." The operator then may manually tamp or tie or press the START button to continue automatic operation of the tie detector and tamper. However, if the DOWNFEED TIMER does not "time out" before the correct squeeze pressure is reached, the DOWNFEED operation will have been changed to SQUEEZE IN by the bottom limit switch or switches, and sufficient pressure will have been built up to actuate the squeeze pressure limit switch or switches, which then causes the computer to upfeed the tamping heads.

If this is not the last tamping head insertion to be made, the tamping heads come up only to the middle limit switch positions, and the cycle is then repeated. However, if this is the last insertion to be made, several switch positions are checked by the computer to see if they have been pressed, prior to proceeding with the automatic operation of the apparatus. If the EXTRA TAMP button has been depressed, the tamping heads will upfeed only to the middle limit switch position or positions, then the tamping cycle will be repeated. Only one extra tamp per tie is allowed by the computer in the embodiment of the invention described herein, but the TAMPING cycle program can be modified to include several extra tampings per tie.

After examination of the status of the EXTRA TAMP switch and taking any necessary action, the computer then upfeeds the tamping heads, whereupon the status of the PAUSE switch is checked. This switch is parallelly connected with the output of the DISTANCE-TO-STOP DOWNCOUNTER, such that the following cooperation applies also to that component. If the PAUSE button has been actuated, the tamping heads will continue to upfeed to the upper limit switch position, but no TRAVEL of the motor drive tamper vehicle and the tie detector cart will be initiated. If the PAUSE button has not been depressed, FORWARD TRAVEL will be initiated, prior to which the tamping heads will have been upfed to their respective upper limit switch position.

The computer then checks the status of the ADD A TIE/SUBTRACT A TIE switches. If ADD A TIE has been actuated, one tie is added to the number of ties to be tamped. This is a "one time" addition involving only the current tamping interval. If, for example, a tamping interval of TAMP 2 AND SKIP 4 has been chosen, and the ADD A TIE button has been actuated after tamping the first tie in the interval, the remaining ties to be tamped would be "1", to which the computer would add "1", thereby making two ties to be tamped. This then totals three consecutive ties to be tamped, and effects only the tamping interval in which the ADD A TIE button was actuted. The next tamping interval, and all subsequent intervals, revert to TAMP 2 AND SKIP 4, unless, either the ADD A TIE or SUBTRACT A TIE button is depressed.

If the computer determines that the SUBTRACT A TIE button has been actuated, there must be one or more ties remaining to be tamped, and one tie is subtracted from that number. As in the case of adding a tie, only the present tamping interval is affected. If, however, there is not even one tie remaining to be tamped, then one tie is subtracted from the number of ties to be skipped, again only effecting that particular tamping interval.

Once the ADD/SUBTRACT A TIE buttons have been serviced by the ATFTA computer, the tamping sequence ends by returning to the main part of the computer program.

In the TRAVEL mode of operation the metal tie plates, the required amounts of FAST and CREEP FORWARD TRAVEL distances are optimized, and the pair of tamping heads are maintained at their respective upper limit switches during the TRAVEL mode of operation of the motor drive tamper vehicle and tie detector cart.

In the TRAVEL mode of operation, the motor drive tamper vehicle and the tie detector cart start forward in FAST TRAVEL wherein, for only the first tie, that TRAVEL mode continues until two opposite ends of the crosstie are detected. For subsequent travel the detection of the respective crosstie ends has already effectively been made, and the ATFTA computer then calculates the distance from the current position of the tamping heads to the tie to be tamped. A lookup table shows the amount of FAST TRAVEL distance to be used for each total TRAVEL distance. In accordance with a preferred embodiment of the invention, the FAST TRAVEL distance is set to one-fourth the total TRAVEL distance when the ATFTA computer is reset with power on, and the TRAVEL distance is loaded into an internal DOWNCOUNTER.

During the TRAVEL portion of the program, the upper tamping head position limit switches are checked, and the tamping heads are maintained at that position by upfeeding the tamping heads if necessary.

The motor drive tamper vehicle and tie detector cart are slowed to CREEP speed when the aforementioned computer DOWNCOUNTER reaches zero. Preferably the change in speed is not attempted to be instantaneously carried out, but is of sufficient duration so that the drive wheels of the motor drive tamper vehicle will not skid on the rails. The amount of time required to decelerate to the CREEP speed is a function of the original vehicle speed and track conditions, including the grade and the coefficient of friction of the rail. When the motor drive tamper vehicle actually reaches the CREEP speed the ATFTA computer calculates the remaining distance to the tie. If that distance is still in the forward direction, then one-hand of that distance is added to the value shown in the FAST TRAVEL lookup table for the total travel distance involved. However, if the amount of distance left to the tie is in the reverse direction, then all of that distance is subtracted from the value shown in the travel distance table. In this way, the amount of CREEP speed involved in each TRAVEL situation is kept to a minimum, thereby optimizing the TRAVEL sequence for maximum FAST TRAVEL speed.

The ATFTA includes obstacle detection devices, and if at any time during the TRAVEL DISTANCE program, an obstacle is detected, no correction is made to the FAST TRAVEL look-up table for the travel distance involved, because a complete stop of the motor drive tamper vehicle and tie detector cart occurs under such instances to provide a measure of safety.

When the motor drive tamper vehicle and tie detector cart again return to CREEP speed after the obstacle has been removed, or determined to be of no significance, the ATFTA computer then positions the tamping heads over the tie to be tamped, and the TAMPING program is initiated.

There are many occasions when it is desired to temporarily stop the motor drive tamper vehicle because of such reasons as (1) the motor drive tamper vehicle and tie detector cart have caught up with the jack tamper, (2) waiting for the jack tamper to plot a curve, (3) waiting for the track in front of the motor drive tamper vehicle to be repaired, (4) waiting for a ballast regulator or tie plate broom to clear the track, etc. During such relatively short waiting periods, it is preferred that the push-pull STOP button, either in the operator cab or at the external station, be activated to temporarily halt the motor drive tamper vehicle and the tie detector cart. The only effect of such operation is to inhibit the FORWARD TRAVEL and cause the tamping heads to be upfed to the upper limit switch position. For longer waiting periods, the ATFTA computer can be turned OFF.

The operator should observe the operation of the ATFTA to ensure that any sequence errors be corrected as soon as possible. If the operator has any doubt as to the action to be taken, it is preferred that the PAUSE button be actuated, thereby providing an interval for the operator to consider the appropriate action to be taken. If, for example, the ATFTA is ahead by one tie, then the SUBTRACT A TIE button should be actuated, and if the ATFTA is behind by one tie, then the ADD A TIE button should be actuated. However, if the ATFTA is off by more than one tie, then the ATFTA computer should preferably be restarted in accordance with the following sequence to preserve the TRAVEL table optimization. The operator depresses the PAUSE button again and waits for the computer to initiate annunciation of "ENTER INSERTION PER TIE", then the operator depresses the PAUSE button yet a third time. The ATFTA computer will respond shortly with "POSITION DETECTOR, THEN PRESS START". The operator then re-positions the tie detectors on the tie detector cart over the middle of the crib in front of the first tie to be tamped with the hand-held pendant positioning station, and depresses the START button.

The apparatus of the present invention also enables the tamping intervals to be changed without resetting the ATFTA computer. The tamping interval, defined as the number of ties to be tamped and the number of ties to be skipped, can be changed without resetting the computer in the following manner. Preferably the original positioning of the motor drive tamper vehicle and the tie detector cart are selected such that the last tie tamped by the tamping heads before skipping a tie is the same as the last tie skipped by the jack tamper before tamping any ties.

However, if it is desired to change the tamping sequence, the operator depresses the PAUSE button when the last tie in the tamping part of the interval is tamped. The PAUSE button is then depressed a second time at the end of the TAMPING cycle. When the ATFTA computer initiates annunciation of "ENTER INSERTION PER TIE", etc., the new tamping sequence information should be entered when requested by the computer. When the START button is depressed, the tamping part of the tamping sequence begins with the skip part of the new tamping interval.

One of the significant advantages of the present invention is that the ATFTA enables the operator to perform other functions than that of operating the equipment. For example, the operator can perform other duties such as clearing ballast from between the rail and the tie plate on downed ties, nipping-down ties up to the rail, watching for missing tie plates, dressing signal wires to lie against the tie, and observing the tamping interval being utilized by the jack tamper. It is very important that ballast be removed from between the rail and plate, and that ties be nipped-up against the rail before the ATFTA detects such ties. The reason for the above is two-fold, namely, first and foremost is the fact that space between the rail and tie allows ballast to fill in when that tie or an adjacent tie is tamped. Secondly, no detection of downed ties can be guaranteed. The operation of the ATFTA will be significantly enhanced if the operator coordinates the action of the jack tamper with that of the ATFTA of the present invention, such that missing tie plates are observed, and corrections are made for any sequence errors.

Most missed tie plate detections are attributable to poor track conditions, missing or mis-oriented tie plates, non-metallic tie plates, downed ties, canted ties, closely spaced ties, metallic debris in the crib, improperly dressed signal wires, signal starters, and personnel walking by wearing steel-toes shoes or carrying metal implements.

BRIEF DESCRIPTION OF THE FIGURES

The above objects, features and advantages of the invention are more readily apparent from a consideration of the following description of a preferred embodiment of the best mode of carrying out the invention when taken in conjunction with the following drawings, wherein:

FIGS. 5B and 5C illustrate the principle of generating digital signals from the detection of the tie plates by the metal tie plate detectors for the electronic tie detector circuitry shown in FIGS. 6, 8A and 8B;

FIGS. 5D–5H illustrate the general principle of operation of the forward permissive signal (FIG. 5D) in preventing the digital tie detector signal to the computer (FIG. 5H), and wherein FIGS. 5E and 5F show the pulse outputs from the distance encoder for forward and reverse motion, respectively of the motor drive tamper vehicle and the tie detector cart. FIG. 5G shows the analog detection signal internal to the metal tie detector circuitry of FIGS. 6, 8A and 8B;

FIGS. 5I and 5J respectively show a memory stack for storing information of the detected ties and the manner of addressing the tie stack information within the tie stack;

FIG. 5K illustrates typical values of the FAST TRAVEL lookup table vs. the distance to a tie;

FIGS. 5L–5M represent respective speed curves for undershoot, overshoot and ideal travel conditions of the motor drive tamper vehicle and tie detector cart;

FIG. 6 is a block diagram of the tie plate metal detector circuitry used in the ATFTA;

FIG. 7 is a block diagram representation of the relative peak detector circuitry used in conjunction with the tie plate metal detector circuitry of FIG. 6 of the automatic tie finder system;

FIGS. 10 to 26 are exemplary flow diagrams showing the various steps in the operation of the ATFTA, wherein:

FIG. 10 shows an exemplary INITIALIZATION program;

FIGS. 12A–12C show an exemplary MAIN program;

FIG. 13 shows an exemplary CONTROL STATIONS program;

FIG. 14 shows an exemplary START program;

FIG. 17 shows an exemplary FAST TRAVEL program;

FIG. 18 shows an exemplary FAST TRAVEL OVER progam;

FIGS. 19A–19C show an exemplary CREEP DETECTOR program;

FIG. 20 shows an exemplary STOP FORWARD MOTION program;

FIG. 21 shows another exemplary STOP FORWARD MOTION program;

FIG. 22 shows an exemplary STOP REVERSE MOTION program;

FIGS. 23A–23C show an exemplary TAMPING program;

FIG. 24 shows an exemplary SQUEEZE PRESSURE program;

FIG. 25 shows an exemplary RECYCLE program; and

DETAILED DESCRIPTION

Figures 1, 2A, 2B, 3, 4A, 4B:
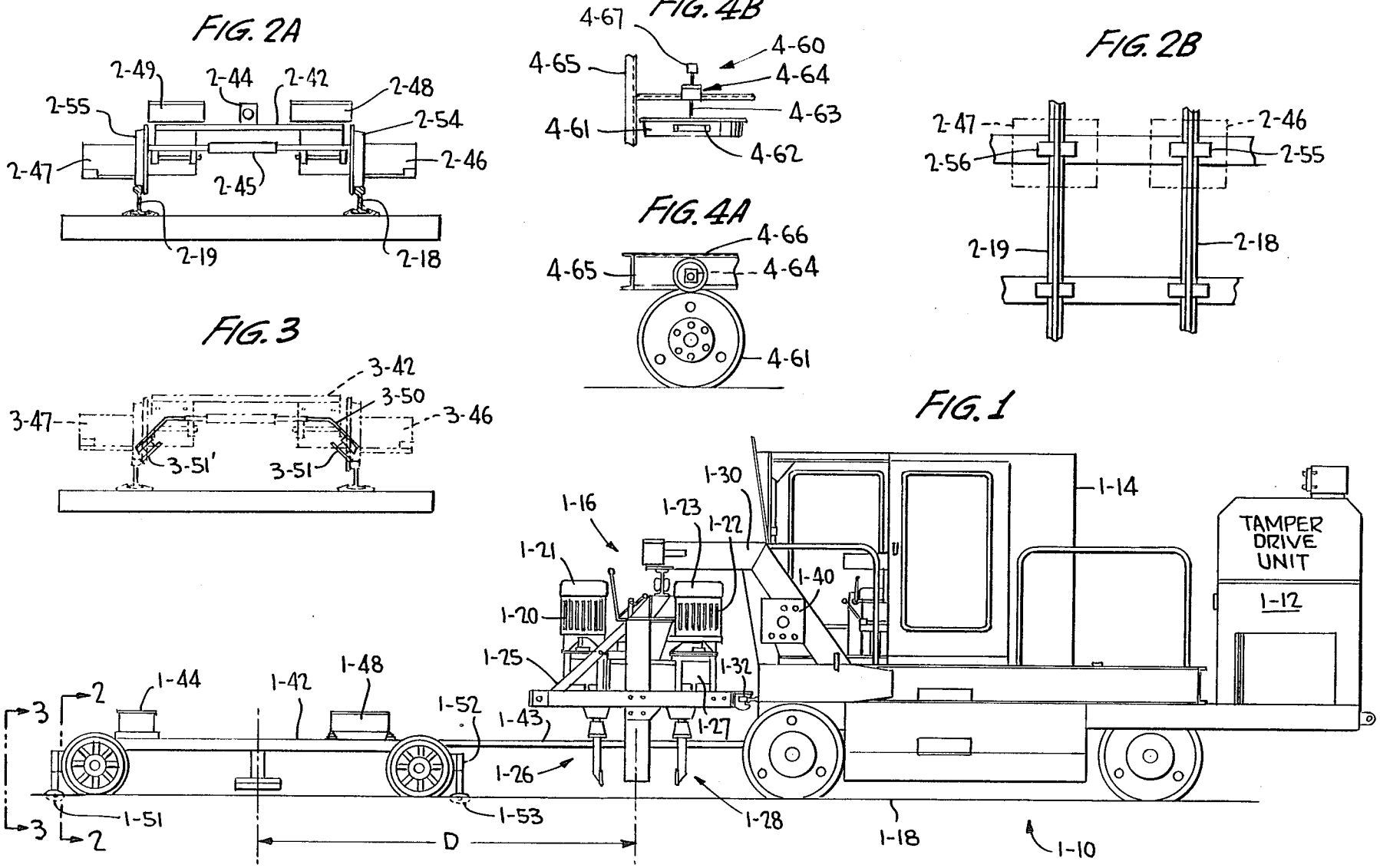
FIG. 1 is a side view of the motor drive tamper vehicle and tie detector cart of the ATFTA showing the general configuration and relationship between the tie detectors and the tamper unit including the tamping heads.
FIG. 2A is a section taken along the direction of lines 2—2 in FIG. 1 of the tie detector cart, and illustrates a general exemplary arrangement of the left and right tie detectors, the housings for the associated tie detector electronics and the ultrasonics detector for personnel and objects of a general nature.
FIG. 2B is a schematical plan view of the left and right tie detectors showing the relationship of the tie detectors and the tie plates on a railroad tie for an ideal tie detection situation.
FIG. 3 is a section taken along the direction of lines 3—3 in FIG. 1 and shows the guide wheel arrangement for maintaining the metal tie detectors in a substantially constant, unchanging lateral position and to prevent the tie detector cart from climbing the rails.
FIG. 4A is a side view of a preferred mounting arrangement of the travel distance encoder and an associated wheel of the railway tamper.
FIG. 4B is a top view of FIG. 4A.

FIG. 1 shows the general relationship and configuration between the metal plate tie detectors and the tamping unit, including the dual pair of oppositely disposed tamping heads. Motor drive tamper vehicle 1-10 is a four-wheeled, self-powered vehicle with tamper drive unit 1-12, cab 1-14 and tamper unit 1-16 mounted thereon as illustrated in FIG. 1. Tamper drive unit 1-12 includes the motor and other components associated therewith for movement of motor drive tamper vehicle 1-10 in a forward and reverse direction on rails 1-18 under control of operator-actuated control switches, buttons, foot switches, etc., in cab 1-14 in a manner generally known to those skilled in the railway art. Cab 1-14 contains the tamping, squeeze and throttle limit switches, foot switches and components of the main computer (not shown) that form the main operator station for the ATFTA. The configuration of the aforementioned components of the main operator station is only of significance to the present invention in that such control components should be mounted to be convenient to the operator in a manner consistent with generally accepted railroad guidelines and regulations to ensure safe and reliable operation of the ATFTA. However, the functions of the tamping, squeeze and throttle limit switches, foot switches and the main computer are of significance and will be described more fully hereinafter.

Also, a special type deceleration control valve is used to control the forward and reverse movement of the motor drive tamper vehicle 1-10 as is described more fully hereinafter. However, such a deceleration control valve is, in and of itself, known to those skilled in the railway art.

Tamper unit 1-16 is a standard unit known to those skilled in the railway art and comprises a pair of dual tampers 1-20, 1-22 (only one pair of the dual pair being shown in FIG. 1) hingedly mounted to vertical guide member 1-26 forming part of tamper frame 1-24 such that dual tampers 1-20 and 1-22 can be raised to an upper position for travel of the ATFTA (as shown in FIG. 1), a lower position for tamping of ties, and an intermediate position for successive tie insertion and tamping operations as described more fully hereinafter. Each of tampers 1-20 and 1-22 includes a motor drive unit 1-21 and 1-23, a vibrator 1-25 and 1-27 for causing oscillation of the respective tamper heads 1-26 and 1-28, and contemporaneous squeezing action thereof in a manner that is known to those skilled in the railway art. However, the functions of the squeezing action, the pressure applied and the sequence of the application of the squeezing action of the tie tamping operation are of significance and will be more fully described hereinafter. The dual pair of tampers enable the simultaneous tamping on both sides of a tie and at both ends thereof.

Tamper 1-16 further includes horizontally extending support member 1-30 for vertically supporting tamper guide member 1-26 and tamper frame 1-24 such that the dual tampers 1-20 and 1-22 can be lowered and raised vertically as previously described. In that connection, tamper platform 1-24 includes brace 1-32 for preventing horizontal movement of the tamper platform along the direction of travel of tamper 1-10. Tamper frame 1-24 and tampers 1-20, 1-22 can be moved laterally in a manner known to those skilled in the railway art to tamp ties at switch intersections and frogs, for example.

Tampers 1-10 further includes remote operator station 1-40 which may include a pendant positioning station (not shown) connected via an extendable cable from the remote operator station to provide the operator of the ATFTA with mobility, thereby enabling the operator to supervise and/or better observe the operation of the ATFTA. The conservation of labor in reducing the number of workers required in the tamping crew as compared with known tamping apparatus and techniques is one of the primary objects and features of the invention.

Tie detector cart 1-42 is attached in front of tamper 1-10 by a coupling member 1-43 which is itself attached to tamper 1-10 by a ball joint (not shown). Tie detector cart 1-42 illustratively includes an ultrasonic detector 1-44 for detecting personnel or objects. The mounting and configuration of ultrasonic detector 1-44 is shown in FIG. 1 in an exemplary manner, as it can comprise several units mounted in different locations on the tie detector cart 1-42 (and at the rear of motor drive tamper vehicle 1-10) to optimize its detecting capabilities. The electronics for the metal tie detectors (only one tie detector 1-46 of two tie detectors being illustrated in FIG. 1) are packaged in respective housings 1-48 (only one housing 1-48 of two housing being shown in FIG. 1). The ultrasonic detector 1-44 and the electronics for the metal tie detectors located on tie detector cart 1-42 are connected via cable (not shown) to the control components located in cab 1-14, which cable passes through the interior of hollow coupling member 1-43, for example.

The tie detectors are mounted on the tie detector cart 1-42 such that the distance between the center of the tie detector and the centerline between the tamping heads 1-26 and 1-28 is a calibrated distance. In FIG. 1 distance D is shown between the centerline of one tie detector 1-46 and the centerline between tamping heads 1-26 and 1-28. This calibrated distance is utilized by the ATFTA computer to precisely and automatically position the dual pair of tamping heads 1-26 and 1-28 (along with the associated other pair of tamping heads not shown in FIG. 1) over a tie for the simultaneous tamping on both tie ends and on both sides of the tie. Such a tamping operation will be more apparent from the following description. The motor drive tamper vehicle 1-10 and the tie detector cart 1-42 can also be positioned by manual control.

Frame support members 1-50 and 1-52 are mounted to tie detector cart 1-42 (see FIG. 3), respectively at the front and rear of the tie detector cart. A pair of guide wheels 1-51, 1-51' (FIG. 3) are mounted to frame 1-50 to prevent the tie detector cart 1-42 from riding over the balls of the rails and serve to maintain the tie detector cart laterally positioned on the tracks.

This is necessary such that the main and compensating loops in each housing 1-46 and 1-47 of each of the tie detectors are optimally positioned over a pair of tie plates 1-55 and 1-56 as illustrated in FIG. 2B. The tie detectors are capable of simultaneously detecting a pair of tie plates that are skewed and not in the "ideal" aligned relationship as illustrated in FIG. 2B. In the description that follows, the tie detectors are identified as RIGHT and LEFT TIE DETECTORS.

Only one pair of guide wheels is illustrated in FIG. 3, but the rear of tie detector cart 1-42 also includes a frame 1-52 similar to frame 1-50, and includes a pair of guide wheels (only guide wheel 1-53 being shown in FIG. 1).

FIG. 2A shows tie detector cart 2-42 mounted to axle 2-45 (one of two frames) with wheels 2-54, 2-55 mounted at opposite ends thereof to ride on rails 2-18, 2-19, respectively. Metal tie plate detectors 2-46 and 2-47 are each suspended below tie detector cart 2-42 to respectively span tie plates 2-55 and 2-56 as illustrated in FIG. 2B. Each metal tie plate detector 2-46 and 2-47 includes a main and compensating loop. The main and compensating loops of each tie plate detector 2-46, 2-47 are suspended in approximately the middle of tie detector cart 2-42 to avoid as much as possible interference with the metal wheels thereof. Additionally, tie detector cart 2-42 is made of a pultruted fiberglass material that is both non-magnetic and not an electrical conductor. Metal tie plate detectors 2-46 and 2-47 are suspended so that the compensating and main frequency loops are approximately 3 to 6 inches above the top part of the respective tracks 2-18 and 2-19. Additionally, the main and compensating loops within metal tie plate detectors 2-46 and 2-47 extend on each side of rails 2-18 and 2-19 to enable detection of skewed or otherwise abnormally positioned tie plates.

FIG. 3 essentially illustrates the manner in which frame 3-50 and the pair of guide wheels 3-51 and 3-51' maintain the lateral stability of the tie detector cart 3-42 by their respective engagement with the inner portion of the ball of tracks 3-18 and 3-19, respectively. The paired guide wheels (one at the front and one at the rear) of the tie detector cart 3-42 are necessary because of the light weight of the tie detector cart and the fact that it is being pushed rather than pulled by the motor drive tamper vehicle 1-10.

FIG. 4A is a side view of a distance encoder 4-60 which is preferably mounted to the right rear wheel of the motor drive tamper vehicle 1-10 behind the operator cab 1-14. Rubber distance detector wheel 4-62 rides on the surface of steel rail wheel 4-61. Rotable shaft 4-63 of distance encoder 4-60 is mounted through bearing 4-64 which is attached to frame member 4-65 of the tie plate detector cart 1-42 by suspension rod 4-66. The distance encoder unit 4-67 generates a pulse train output signal representative of the distance that motor drive tamper vehicle 1-10 and tie plate detector cart 1-42 have moved in either a forward or backward direction. Distance encoder 4-60 is known to the art, and the relationship of the pulse output to the distance traveled is discussed more fully hereinafter.

Figure 5A:
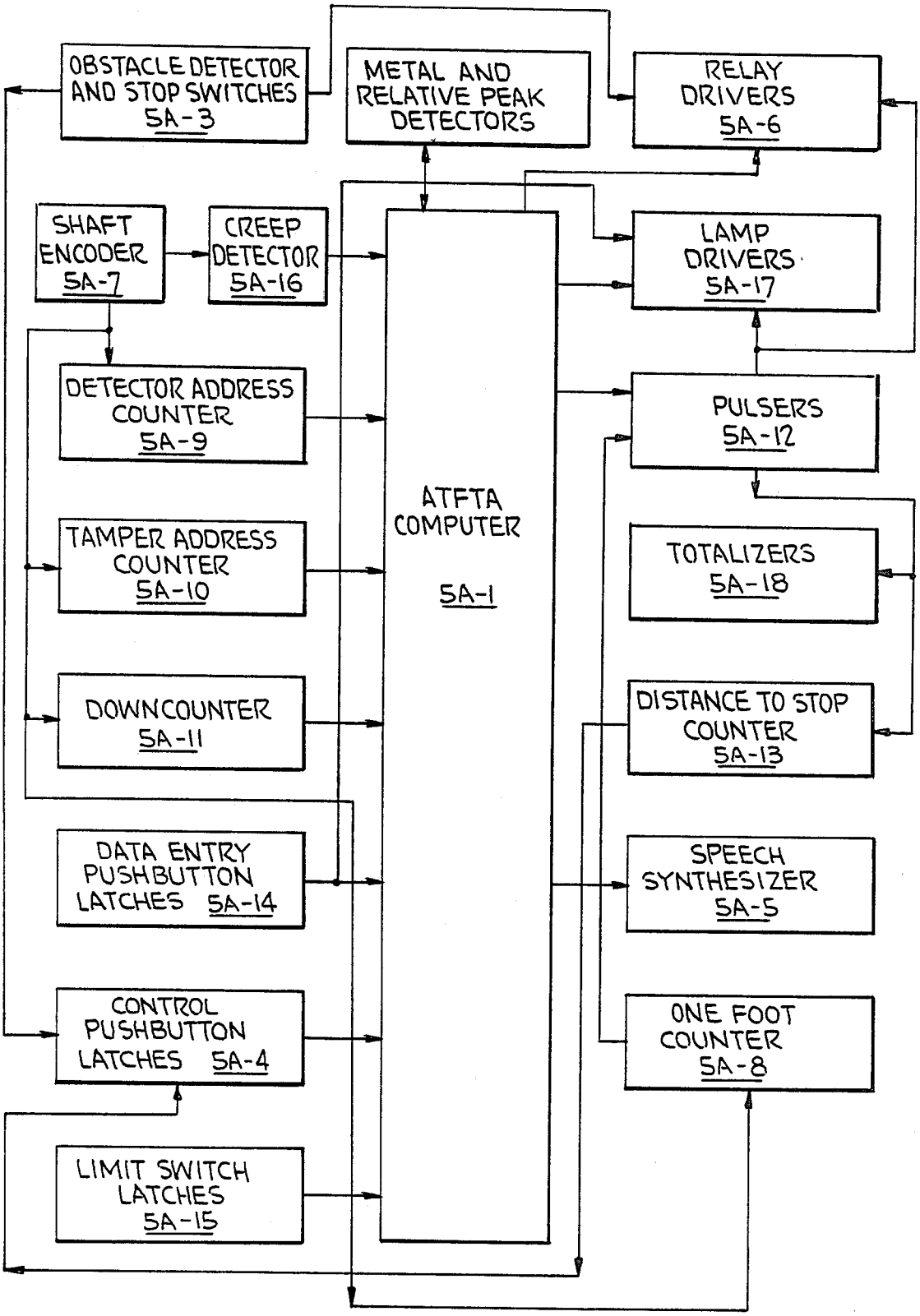
FIG. 5A is a block diagram illustrating the peripheral devices associated with the computer of the ATFTA.

The following is a description of the peripheral components of the ATFTA which operate in conjunction with the ATFTA computer as shown in block diagram form in FIG. 5A. The input data for the ATFTA computer is obtained from the following components. The input from the pair of metal detectors and the associated relative peak detectors consists of two digital inputs which are active upon detection of a pair of tie plates. The ATFTA computer 5A-1 operates upon the edge of the digital input signals from the pair of metal and relative peak detectors 5A-2. ATFTA computer 5A-1 responds to that digital input by checking for false detection by means of a software anti-aliasing filter known to the computer art. The ATFTA computer 5A-1 then stores valid metal and relative peak detector signal inputs in a tie plate stack (more fully described hereinafter).

The ATFTA computer 5A-1 provides a FORWARD PERMISSIVE output signal to the relative peak detectors within the metal and relative peak detectors 5A-2 which enables the metal detectors only when they are at their most forward track location, i.e., the detection of previously (since ATFTA "turn-on") unexplored track territory. Such a technique for controlling the metal and relative peak detectors 5A-2 helps prevent multiple detections of the same tie during tamping operations of the ATFTA.

Figures 5B, 5C, 5D, 5E, 5F, 5G, 5H:
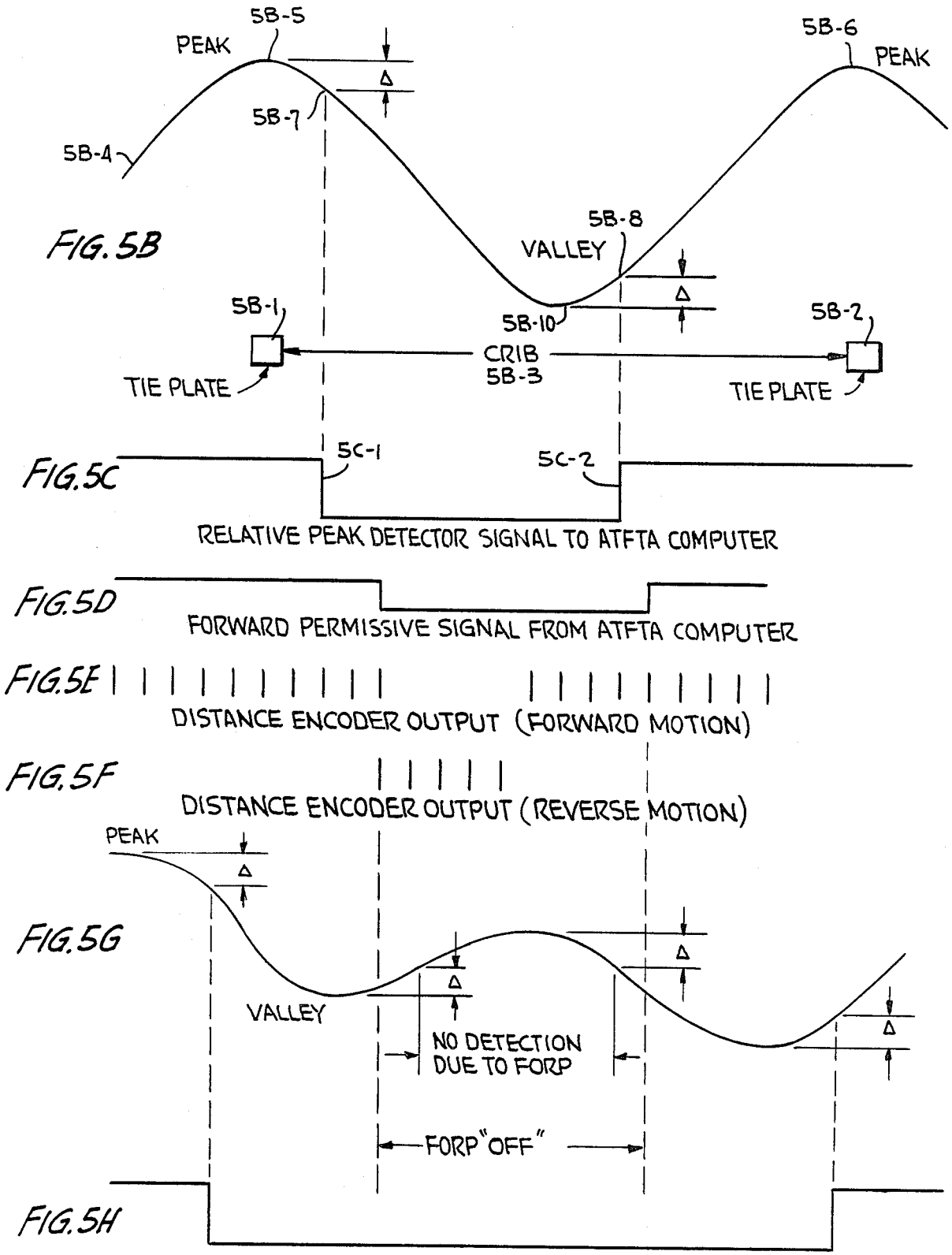

The operation of the metal and relative peak detectors 5A-2 and their associated circuitry is described more fully hereinafter with respect to the circuitry illustrated in FIGS. 6–9. However, the basic principle of their operation is shown in FIG. 5B illustrating the relationship of the anolog signal within a tie plate detector relative to tie plates 5B-1 and 5B-2 which are separated by crib 5B-3. The sinusoidal analog metal tie plate detection signal 5B-4 has a peak at point 5B-5 over a tie plate, for example tie plate 5B-1, and a corresponding peak value at point 5B-6 over tie plate 5B-2. Relative peak detector circuitry (illustrated in FIGS. 7 and 9) produces a digital signal shown in FIG. 5C having negative edges 5C-1 and 5C-2 at respective points 5B-7 and 5B-8, each corresponding to a value "delta" less than the respective peak values 5B-5 and 5B-6 as illustrated in FIGS. 5B and 5C. The positive edge 5C-3 of the digital signal illustrated in FIG. 5C is produced at point 5B-9 on analog signal 5B-5, which point is at a value less than that at valley 5B-10 by an amount'-'delta". Point 5B-10 corresponds to the middle of crib 5B-3 between the tie plates 5B-1 and 5B-2.

The FORWARD PERMISSIVE signal is generated by the ATFTA computer 5A-1 and is illustrated in FIG. 5D relative to the respective pulse outputs of the distance encoder 4-60 (FIG. 4) as shown in FIGS. 5E and 5F for forward and reverse travel, respectively, of the motor driven tamper vehicle 1-10 and tie detector cart 1-42 (FIG. 1). A representative output from a metal detector is illustrated in FIG. 5G with the corresponding digital signal to the ATFTA computer 5A-1 shown in FIG. 5H. Upon reversal of the motor drive tamper vehicle 1-10 and tie detector cart 1-42, the FORWARD PERMISSIVE signal shown in FIG. 5D switches from a high level to a low level. The negative edge 5H-1 of the digital signal shown in FIG. 5H is produced at the point 5G-1, which is an amount "delta" less than the value of the analog detection signal 5G-2 at the peak 5G-3 thereof. However, because the FORWARD PERMISSIVE signal is "low", no digital signal is produced at the subsequent "delta" points 5G-4 and 5G-5, which respectively follow a valley and a peak of analog detection signal 5G-2. When the FORWARD PERMISSIVE signal is again "high", after the motor tamper vehicle 1-10 and tie detector cart 1-42 have resumed forward motion, the digital detection signal shown in FIG. 5H produces a negative-going edge 5H-2 at, for example, the "delta" point 5G-6 shown in FIG. 5G.

Continuation with the peripheral components shown in FIG. 5A, the obstacle detector and stop switches 5A-3 are connected in parallel to allow interruption of only the travel cycle of the motor drive tamper vehicle 1-10 and tie detector cart 1-42. The output from obstacle detectors and stop switch 5A-3 to the control pushbutton latches 5A-4 causes the ATFTA computer 5A-1 to instruct the speech synthesizer 5A-5 to annunciate "STAND CLEAR!" Also, the ATFTA computer 5A-1 will not attempt to optimize the travel cycles of the motor drive tamper vehicle 1-10 and tie detector cart 1-42 that have been interrupted by this input. The speech synthesizer 5A-5 also formulates and annunciates other announcements upon command of the ATFTA computer 5A-1 as described herein. The other output of the obstacle detector and stop switch 5A-3 to relay drivers 5A-6 disengages all travel functions, independent of what the ATFTA computer 5A-1 is doing.

Shaft encoder 5A-7 is bidirectional unit having pulsed outputs on separate lines for forward and reverse motion of the motor drive tamper vehicle 1-10 and tie detector cart 1-42. The incremental distance between pulses is defined by the following equation:

$$\frac{12'' \text{ diameter} \times \pi}{600 \text{ pulses/revolution}} = 0.062832''/\text{pulse, or } 1/16''/\text{pulse}$$

For all purposes other than the one foot counter 5A-8 and the FORWARD PERMISSIVE signals, the incremental distance is divided by four to equal approximately $\frac{1}{4}''$/pulse.

The detector address counter 5A-9 accepts the bidirectional output of the shaft encoder 5A-7, and counts up/down (forward/reverse) with a ten-bit output to provide an indication of where the metal detectors in metal and relative peak detectors circuit 5A-2 are relative to a given tie. During "power-up" or manual reset, the detector address counter 5A-9 is loaded (preset) with a number corresponding to the incremental distance D from the tamping heads 1-26 and 1-28 (FIG. 1) to the metal detector heads (metal detector 1-46 shown in FIG. 1. Such loading of the detector address counter 5A-9 is a calibration that is performed when tie detector cart 1-42 is assembled to the motor drive tamper vehicle 1-10 (FIG. 1), and may be performed using a 10-position DIP switch.

The tamper address counter 5A-10 is essentially the same as the detector address counter 5A-9, except that it is reset to zero on "power-up" or manual reset.

Downcounter 5A-11 is a ten-bit counter and is loaded by the ATFTA computer 5A-1 with the desired number of incremental pulses to be decremented for a given operation of the ATFTA computer 5A-1, which operations are more fully described hereinafter with respect to the program flow diagrams illustrated in FIGS.

10-26. Downcounter 5A-11 is connected to operate the opposite of the other counters in the ATFTA, i.e., forward/reverse is down/up rather than up/down. An underflow condition (borrow) or overflow (carry) of downcounter 5A-11 generates interrupt signals to the ATFTA computer 5A-1 to indicate the end of a count. The underflow condition is the normal condition and is used to indicate the end of FAST TRAVEL and end of [FORWARD] TRAVEL. The overflow condition of downcounter 5A-11 is the end of [REVERSE] TRAVEL in the case that the motor driven tamper vehicle 1-10 and tie detector cart 1-42, and in particular the tamping heads 1-26 and 1-28, overshoot a tie.

The detector address counter 5A-9, the tamper address counter 5A-10 and the downcounter 5A-11 each store ten bits of data, or a distance of approximately 21 feet. While that is a relatively short distance, it is satisfactory as only six to seven ties (about ten feet) lie between the metal detectors (1-46 in FIG. 1) and the tamping heads 1-26 and 1-28, which corresponds to the distance D shown in FIG. 1. Of course this means that the aforementioned counters will "roll over" or overflow every 21 feet or so. The ATFTA computer 5A-1 is programmed to take such counter "roll over" operation into account.

One foot counter 5A-8 is calibrated by setting a DIP switch at installation of the ATFTA to count incremental pulses from the shaft encoder 5-A7 amounting to a distance of one foot (approximately 191 pulses, accurate to within + or −1/16" variance of the distance encoder wheel 4-62 (FIG. 4A) from a 12" diameter). When the last pulse of the shaft encoder 5A-7 is counted, an output to one of the pulsers 5A-12 causes the distance-to-stop counter 5A-13 to decrement. The one foot counter 5A-8 also resets at that time and starts counting again. The one foot counter 5A-8 is reset to zero at "power-up".

Data entry pushbutton latches 5A-14 latch on closure of their respective pushbutton switches, and unlatch on command from the ATFTA computer 5-A1. Additionally, data entry pushbutton latches 5A-14 cause the proper lamp driver in lamp drivers 5A-17 to light appropriate indicator lamps (self-contained in the switch). The pushbuttons involved are #0, #1, #2, #3, #4, #5, #6 and #7.

The limit switch latches 5A-15 are essentially the same as the data entry pushbutton latches 5A-14, except that no output to the lamp drivers 5A-17 is provided. The limit switch latches 5A-15 latch on closure of the associated pushbutton switches LEOS, REOS, LTP and RTP (left/right recycle position and left/right travel position, respectively), and SP (squeeze pressure). Also, the squeeze pressure limit switch generates an interrupt to the ATFTA computer 5A-1.

The control pushbutton latches 5A-4 are essentially the same as the limit switch latches 5A-15, with the additional function that any closure generates an interrupt to the ATFTA computer 5A-1. The associated control pushbuttons operate, for example, START, EMERGENCY STOP, PEOPLE (OBSTACLE) DETECTOR STOP and DISTANCE STOP (distance to stop the downcounter 5A-11).

The creep detector 5A-16 senses the return to creep speed of the motor drive tamper vehicle 1-10 and the tie detector cart 1-42 (FIG. 1). An input from the shaft encoder 5A-7 is integrated to provide a dc voltage level proportional to speed. An input from the ATFTA computer 5A-1 strobes the creep speed detector 5A-16. If the motor drive tamper vehicle 1-10 and tie detector cart 1-42 are at/below creep speed, the creep speed detector 5A-16 responds with a detector signal. Otherwise, the creep speed detector 5A-16 is armed, and the detector signal occurs on return to creep speed (from some faster speed).

The outputs from the peripheral computer components shown in FIG. 5A are as follows. The relay drivers 5A-6 latch and buffer the ATFTA computer 5A-1 signals to turn "on/off" the appropriate relays: CREEP FORWARD, FAST TRAVEL, CREEP REVERSE, DOWN and IN/OVER AND UP, PAINT POT and PEOPLE DETECTOR.

The lamp drivers 5A-17 are of the same structure as the relay drivers 5A-6.

Pulsers 5A-12 stretch the ATFTA computer 5A-1 signals, increment/decrement totalizers 5A-18 (tie and insertions) and the distance-to-stop counter 5A-13. Also, the pulsers 5A-12 provide an output to a relay driver in the relay drivers circuitry 5A-6 for a operation of the paint pot for marking ties as desired by the ATFTA operator.

The speech synthesizer 5A-5 latches/decodes the ATFTA computer 5A-1 signals to drive a known speech synthesizer unit. One of eight phrases is chosen and annunciated on command form the ATFTA computer 5A-1.

Throughout this description, components such as power supplies are not shown or described as their structure and operation are well known to those skilled in the art to which the invention pertains.

A pendant station (not shown) may be provided in parallel with a foot switch in the control cab 1-14 (FIG. 1) to position the motor drive tamper vehicle and tie detector cart. The pendant station is strictly an ancillary function, but is necessary for initial "spotting" (positioning) of the motor drive tamper vehicle 1-10 and the tie detector cart 1-42. Preferably two speed controls in each of two directions (forward and reverse) are provided.

Additionally, the amplifiers and speakers necessary for the operation of the speech synthesizer 5A-5 are not illustrated or described. Furthermore, the operating switches, lamps, etc., are not shown or described as their structure and function are so well known to those skilled in the art to which the invention pertains.

The following is a description of the tie stack management of the ATFTA taken in conjunction with the tie stack shown in FIG. 5I and the counterpart address arrangement shown in FIG. 5J. As ties are detected, their corresponding addresses are stored in a section of memory called a stack. In the ATFTA there are two pointers to a stack, one of which points to the next available storage location, and the other one of which points to the detection currently being processed. The stack is 256 memory locations long, and can store 128 detections, However, in actual use, only ten to sixteen locations are occupied at any one time, as only five to eight ties need to be stored (the number of ties from the tie detectors (1-42) to the tamping heads 1-26 and 1-28 (FIG. 1).

The stack exits from 2100H to 21FFH as illustrated in FIG. 5I. The pointers sre incremented only in the lower eight bits, so that 21FFH rolls over to 2100H, and the pointers are in effect recirculated through the stack.

Two contiguous addresses in the stack define a tie location as follows. The even addresses hold the lower eight bits of the location. The odd addresses hold the upper two bits of the location and six status flags as illustrated in FIG. 5J and as shown by the following:

| BIT | FLAG |
|---|---|
| 7 | Tie ready to be tamped |
| 6 | Tie ready for processing |
| 5 | Creep speed detected |
| 4 | Tie reached |
| 3 | Right end of a tie |
| 2 | Left end of a tie |

During INITIALIZATION of the ATFTA computer 5A-1 (FIG. 5A), the pointers (2000,1H and 2002,3H) are both set to 2100H. As the tie plates are detected, they are stored in the location pointed to by stack pointer 2000,1H. This stack pointer is then incremented (only the lower eight bits are effected). Along with the tie's address, two flags are set, namely either left or right end of tie, and the process flag.

Whenever two tie detections occur, the MAIN program loop (described hereinafter with respect to FIGS. 12A–12C) decides whether the tie ends (1) are close enough to allow splitting the difference in location and tamping both simultaneously (this is the normal case), (2) are "skewed" and therefore must be tamped separately, or (3) have a plate missing (in this case only the detected tie end is tamped, but the lack of a tie plate detection affects other operations, specifically the tie totalizer and the ends counter). If the two tie ends are consolidated into one operation, tamping both at once, then a new location is figured at a point halfway between the detections, the old detections are erased, and the new location is stored with both left and right flags set. In any case, once the above determinations are made, the process flag is reset.

When the motor drive tamper vehicle 1-10 and tie detector cart 1-42 are properly positioned over the tamping location (and specifically the tamping heads 1-26 and 1-28), the tamping flag is set, causing the ATFTA computer program to branch to the TAMPING program described more fully hereinafter with respect to the program flow shown in FIGS. 23A–23C. In that program the left and right flags are tested, and either left, right, or both tie ends are tamped. After tamping, the detection is erased, and the stack pointer is updated.

The two remaining flags are set and tested by the CREEP DETECTOR and STOP FORWARD MOTION programs described more fully hereinafter with respect to FIGS. 19A–19C, 20 and 21.

Upon the occurrence of "power-up" reset or any manual reset, the FAST TRAVEL lookup table is generated by the INITIALIZATION table as follows. For total travel distances from 0 to 9 inches, the amount of FAST TRAVEL is 0 inches. For total travel distances from 9 to 40 inches, the amount of FAST TRAVEL is=(total travel)−(18 inches) as is apparent from an examination of FIG. 5K. This establishes a starting point from which adjustments to the amount of fast travel can be made in order to compensate for varying (1) grade, (2) coefficient of friction of the rail, (3) weather, (4) tamp/skip sequence, and (5) tamper operating characteristics not related to the above.

The motor drive tamper vehicle 1-10 (FIG. 1) was originally equipped with a simple ON/OFF valve for controlling travel. The use of such a valve resulted in the wheels of the motor drive tamper vehicle 1-10 spinning on the track when travel was initiated, and skiding when travel ended. To accomplish precise positioning of the tamper heads 1-26 and 1-28 on the motor drive tamper vehicle 1-10, the simple ON/OFF valve was changed to one having smooth acceleration/deceleration curves as described more fully hereinafter.

It has been determined that only during creep speed can the motor drive tamper vehicle 1-10 and the tie detector cart 1-42 simultaneously stop travel and start tamping, while maintaining efficient and safe operation. Therefore, it was necessary to detect the return (from fast travel) to creep speed, and adjust the amount of fast travel such that as little creep speed as is practical is used. The fast ravel lookup table and the creep detector 5A-16 accomplish the aforementioned operation.

The basic algorithm used in adjusting the fast travel lookup table (special cases may be used for first adjustment, obstacle detection, over adjustment and errors) is to add one-half of the creep speed distance to the fast travel lookup table in the event of an undershoot, and to subtract the whole creep speed distance from the fast travel lookup table in the event of an overshoot.

The above described use of the basic algorithm in adjusting the fast travel lookup table is readily apparent from a consideration of the "speed" curves illustrated in FIGS. 5L, 5M and 5N. In the undershoot condition shown in FIG. 5L, the "speed" curve 5L-1 accelerates from tie 5L-2 during portion 5L-3, then full speed is attained during portion 5L-4, and deceleration occurs during portion 5L-5, whereupon detection of a preselected distance at point 5L-6 the creep speed mode of operation is entered until the tamping heads 1-26 and 1-28 (FIG. 1) are positioned directly over a tie 5L-8 to be tamped.

In the overshoot condition shown in FIG. 5M, the "speed" curve 5M-1 accelerates during portion 5M-2 from a given tie 5M-3, includes a full speed portion 5M-4, enters a deceleration portion 5M-5, and upon detection of a distance exceeding a predetermined distance at point 5M-6 a reverse creep speed mode of operation is entered during portion 5M-7 until the proper distance to the tie 5M-8 (the tie to be tamped) is attained, whereupon the motor drive tamper vehicle 1-10 and tie detector cart 1-42 are stopped with tamping heads 1-26 and 1-28 positioned directly over tie 5M-8.

The "ideal speed" curve is illustrated in FIG. 5L. The speed curve 5N-1 includes an acceleration portion 5N-2 from a starting tie 5L-3, a full speed portion 5N-4, and a deceleration portion 5N-5 until the proper distance to the desired tie 5N6 (the tie to be tamped) is reached.

The result ("ideal speed" curve) shown in FIG. 5N is an approximation of the ideal travel situation, i.e., one having no over/undershoot, and therefore no creep speed. Such an "ideal speed" curve is the most efficient travel mode of operation possible for the motor drive tamper vehicle 1-10 and tie detector cart 1-42.

The control valve used in controlling the speed of the motor drive tamper vehicle 1-10 is of the type described in U.S. Pat. No. 3,213,886, the description thereof being incorporated herein by reference. Such a control valve is a 4-way, 5-position directional valve, pilot-operated and solenoid controlled. It can be adjusted to control every phase of load movement such as starting, accelerating, full speed, decelerating, stopping and return.

The following is a brief description of the operation of the aforementioned valve mechanism. The control valve utilizes five basic main spool positions: (1) OFF-spring centered, (2) CREEP SPEED-spool partially displaced to the right or left, (4 and 5) FULL SPEED-spool fully displaced fully to the left or right. All positions of the spool are independently adjustable. At each end of the main spool there are single-acting control cyclinders. Adjustable stops limit movement of the cyclinder pistons to establish travel of the main spool. A double-solenoid directional pilot valve controls the direction the main spool shifts. When one of the two solenoids is energized, the main spool shifts until the control cylinder piston stops it at CREEP SPEED position. CREEP SPEED is adjustable from 0 to 10 gpm. To accelerate from CREEP SPEED to FULL SPEED, a single solenoid control valve is energized. Fluid in the two control cylinders (which were at system pressure) is vented to tank. The main spool, still energized hydraulically by the directional pilot valve, drives the control piston out until it meets a speed stop. An adjustable orifice controls the rate at which the main spool shifts from CREEP SPEED to FULL SPEED (acceleration); and another adjustable orifice controls the rate at which the main spool shifts from full speed back to creep speed. Both orifices are infinitely adjustable from 70 milliseconds to one minute, or more. The maximum spool displacement is also adjustable to 80 gpm.

In the operation of the motor drive tamper vehicle, the aforementioned control valve controls a hydraulic cylinder, or motor. An initial electrical signal to the control valve starts the motor drive tamper vehicle 1-10 in a forward direction at a preset CREEP SPEED. A second electrical signal accelerates the load smoothly up to full speed. When the second electrical signal is dropped out the motor driven tamper vehicle 1-10 decelerates smoothly back to CREEP SPEED. Dropping out the first electrical signal brings the motor drive tamper vehicle to a stop.

The reverse rates of movement of the motor drive tamper vehicle are independently adjustable using the type of control valve described in the aforementioned U.S. patent.

MDTV 1-10 is driven by a standard diesel engine used for railway locomotion, which utilizes a constant feed supply of fuel to the diesel motor. The diesel motor is throttled to control its output power by draining various amounts of fuel into a drain tank in accordance with the desired power output and speed desired. The aforementioned control valve spools are connected to throttle the diesel engine of the MDTV in accordance with the control valve spool displacement in a manner known to those skilled in the railway art. However, the use of the aforementioned type of control valve to throttle a railroad diesel engine is considered novel and non-obvious in the context of the present invention.

GENERAL DESCRIPTION OF THE AUTOMATIC TIE FINDER ELECTRONIC CIRCUITRY

The tie detection electronic system comprises two basic components, namely, the tie plate metal detector circuitry and the relative peak detector circuitry. The aforementioned two basic components respectively detect the metallic contents of a tie plate, and distinguish between a tie plate and a crib. The tie plate metal detector circuitry generates and senses an electromagnetic field having a frequency chosen to emphasize the electrical conductivity characteristics of the tie plate. The amount of returned electromagnetic energy defines the amount of surface area as seen from a position directly over the tie plate. Because joint plates and portions of the rail also are present in the same "detection window", compensation is provided to account for the presence of such ancillary undesired components to prevent them from being detected as tie plates. As the detector circuitry approaches a tie plate, the output of the tie plate metal detector increases to a maximum when the receiver of the detector is directly centered over the tie plate. As the detector moves away from the tie plate and approaches a crib, the output of the plate metal detector decreases to a minimum when the detector is directly centered over the crib.

DETAILED DESCRIPTION OF THE AUTOMATIC TIE FINDER ELECTRONIC CIRCUITRY

The basic components of the tie plate metal detector circuitry are illustrated in FIG. 6. Two tie plate metal detectors are used within each ATFTA and are designated as a "righthand" and a "lefthand" unit respectively. The circuitry illustrated in FIG. 6 represents only one of such units which is sufficient for the purpose of describing the structure and operation of the tie plate metal detector circuitry. The tie plate metal circuits are identical with the exception that different operating frequencies are used in the "lefthand" and "righthand" units to avoid interference between the two units. Thus, for example, oscillator 10 of a lefthand tie plate metal detector unit utilizes a quartz crystal having a frequency of 2.6584 MHz, whereas a quartz crystal with a frequency of 2.6550 MHz is used for a righthand tie plate metal detector unit.

The output of oscillator 10 is divided by frequency dividers 16 and 20 to provide respective main and compensating clock frequencies 17, 19. Phase shifter feedback loop 14 ensures that the main and compensating frequencies are in quadrature to avoid any "cross-talk" between the main frequency and compensating frequency transmitters. Phase shifter feedback loop 14 simply resets the output of frequency divider 20 to reset compensating transmitter drive circuitry 15 to provide a 90 degree phase shift between the main and compensating transmitter frequencies.

The main frequency transmitter drive circuit 13, main transmitter and loop circuit 18, and compensating frequency transmitter drive circuit 22 are identical with each other except for tuning components. Frequency divider 16 divides the main clock frequency output of frequency divider 12 by four to provide an 83.075 KHz transmitter clock frequency output for excitation of main frequency transmitter drive circuit 13, comprising a PNP drive transistor and associated tuning components to power main frequency transmitter and loop circuit 18.

Similarly, the compensating frequency clock output of frequency divider 12 is input to frequency divider circuit 20 and is divided by four, thereby to provide a 166.15 KHz output signal that excites compensating frequency transmitter drive circuit 15. Drive circuit 15 includes a PNP drive transistor and associated tuning components to power compensating frequency transmitter and loop circuit 22.

Frequency divider circuits 16 and 20 respectively provide appropriately timed clock signals 17, 19 for use by the respective phase detectors 25, 29 in the main and compensating frequency receivers.

The main and compensating frequency receiver and loop systems are identical except for the respective tuning components of main frequency receiver and loop circuit 24 and compensating frequency receiver and loop circuit 26, which each utilize a respective phase detector 25, 29 operating as an analog switch. Main frequency receiver and loop circuit 26 are respectively gated by a clock signal from each of the respective main and compensating frequency transmitters as described above. The timing of the respective clock signals is such that the output of compensating frequency phase detector 29 in the compensating frequency receiver and loop circuit 26 is of opposite polarity from that of the output of the main frequency phase detector 25 in the main frequency receiver and loop circuit 24. Each of the respective outputs of the main frequency receiver and loop circuit 24 and the compensating frequency receiver and loop circuit 26 are input to a respective amplifier 28 and 30, the respective outputs of which are then algebraically added by an operational summing amplifier 32, the output of which is input to the relative peak detector circuit illustrated in FIG. 7. Each of amplifiers 28 and 30 has an approximate voltage gain of 4.3 and summing amplifier 32 provides a certain amount of integration and has an overall voltage gain of unity.

The output of the relative peak detector circuit (illustrated in FIG. 7) is processed to discriminate tie plates from cribs, and is correlated with data from a computer system (to be described hereinafter), such that the output of the tie plate metal detector circuit is accepted only once upon the first detection of a tie plate. The presence of a tie plate is determined when the output from the tie plate metal detector has decreased by an adjustable offset amount from the relative maximum which occurs when the tie plate metal detector is centered over a tie plate. Similarly, the presence of a crib is determined when the output from the tie plate metal detector has increased by an adjustable offset amount from the relative minimum that occurs when the tie plate metal detector centers over a crib. Although such determinations are necessarily made ex-post-facto, each such determination can be made within an absolute distance from the actual tie plate and crib that is constantly repeatable. Therefore, the actual location of a tie plate can be accurately inferred from such determination.

In the following description, the maximum output, which occurs with the main and compensating frequency loop circuits 24 and 26 over the tie plate, is referrred to as a peak signal, and the minimum output, which occurs with the aforementioned main and compensating frequency loop circuits over a crib, is referred to as a valley signal.

Because the absolute value of the peak signals and valley signals is not repeatable from tie plate to tie plate, and because the valley signals may on occasion achieve a higher absolute value than some peak signals, and since the peak signals may on occasion achieve a lower absolute value than some valley signals, the peak signals and valley signals are determined relative to one another rather than relative to some arbitrary absolute value.

The relative peak detector circuit is illustrated in block diagrammatic form in FIG. 7. The output from the tie plate metal detector circuit of FIG. 6 is input to a limiter circuit 34, the output of which is provided to respective offset adjust circuits 36, 38. The circuitry in the peak signal output channel and the valley signal output channel of the relative peak detector circuit are identical, and these channels respectively determine peak and valley signal outputs of the tie plate metal detector.

The limited output from limiter circuit 34 is offset from the positive supply voltage (ground) and is variably adjustable in accordance with the desired amount of offset signal necessary to establish either a peak or valley signal. A peak detector circuit is formed by peak hold circuit 40 and storage circuit 42. In a like manner, a valley detector circuit is formed by valley hold circuit 44 and storage circuit 46. Peak hold circuit 40 includes an operational amplifier and a switching diode having an output integrated by storage circuit 42, as the signal output from the tie plate metal detector rises. The peak hold signal is stored by storage circuit 42 when the voltage from the tie plate metal detector falls due to the rectifying action of the aforementioned switching diode, which will be more clearly explained with respect to the detailed circuitry illustrated in FIGS. 9A and 9B. Valley hold circuit 44 also includes an operational amplifier and a switching diode, the output of which is integrated by storage circuit 46 as the voltage from the tie plate metal detector falls. This valley hold signal is stored by storage circuit 46 when the signal output from the tie plate metal detector rises, because of the rectifying action of the diode within valley hold circuit 44. Each of the signals stored by storage circuits 42 and 46 may be buffered by additional operational amplifiers before being input to comparators 48, 50, respectively through respective reset switches 52 and 54. Reset switches 52 and 54, along with their respective reset control logic circuits 56 and 58, are identical with the exception of signal polarity. Reset switches 52 and 54 are analog switches which reset the storage circuits 42 and 46.

In a preferred embodiment of the invention, storage circuits 42 and 46 can each consist of a capacitor 42', 46' such that the capacitor of storage circuit 42 charges as the voltage output from amplifier 32 of the tie plate metal detector rises; and the peak hold signal is stored by the capacitor when the tie plate metal detector output falls due to the rectifying action of the aforementioned switching diode. The capacitor forming storage circuit 46 in the valley signal channel integrates the output of valley hold circuit 44 and is discharged as the signal output from the tie plate metal detector falls. The reset switches 52 and 54 then function to shunt capacitors 42' and 46' as controlled by reset control 56 and 58, respectively.

The reset or shunt function of reset switches 52 and 54 also is performed whenever either of the following occurs:

1. The comparators 48 and 50, respectively, signal a reset of storage circuits 42 and 46, in which case the reset action lasts only until the respective stored signal is decreased below (or increased above) that of the signal from respective offset circuits 36 and 38; or 2. The forward permissive signal from forward permissive circuit 60, which is output from the computer (to be described more fully hereinafter), becomes inactive, in which case the rest of each of the peak and valley channels lasts for as long as the inactivity of the forward permissive signal.

The peak comparator circuit 48 and the valley comparator circuit 50 are identical except for polarity. Comparator 48 receives an input from the buffered peak hold storage circuit 46. Comparator 48 also receives an input from offset adjust circuit 36 and comparator 50 receives an input from offset adjust circuit 38. With respect to comparator 48, when the offset signal input falls below the peak hold storage signal input, the output of comparator 48 changes state to require a reset of the peak hold storage circuit 42 and also indicating a fall of the amount of offset signal. Such action also toggles the set input of the output flip/flop circuit 62.

With respect to comparator 50, when the offset signal input rises above the valley hold signal stored in storage circuit 46, the output of comparator 50 changes state, requiring a reset of hold storage circuit 46 and indicating a rise in the amount of offset, which action also toggles the set input output flip/flop circuit 62. The output of flip/flop circuit 62 is provided as an input to the computer for purposes which will be more fully described hereinafter.

Figure 8A:
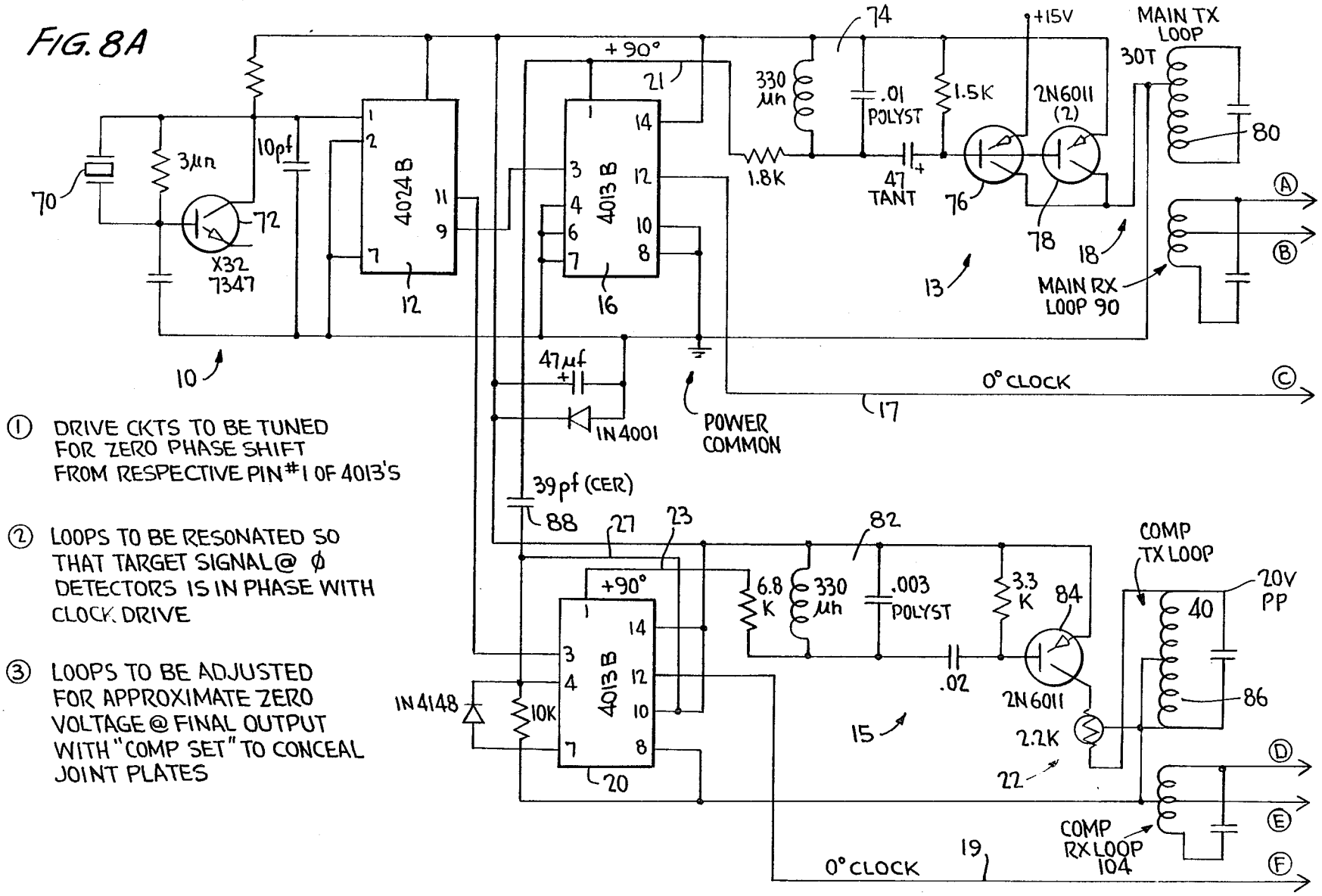
FIGS. 8A and 8B show an exemplary embodiment of an electrical schematic of the tie plate detector circuit illustrated in block diagram form in FIG. 6.
Figure 8B:
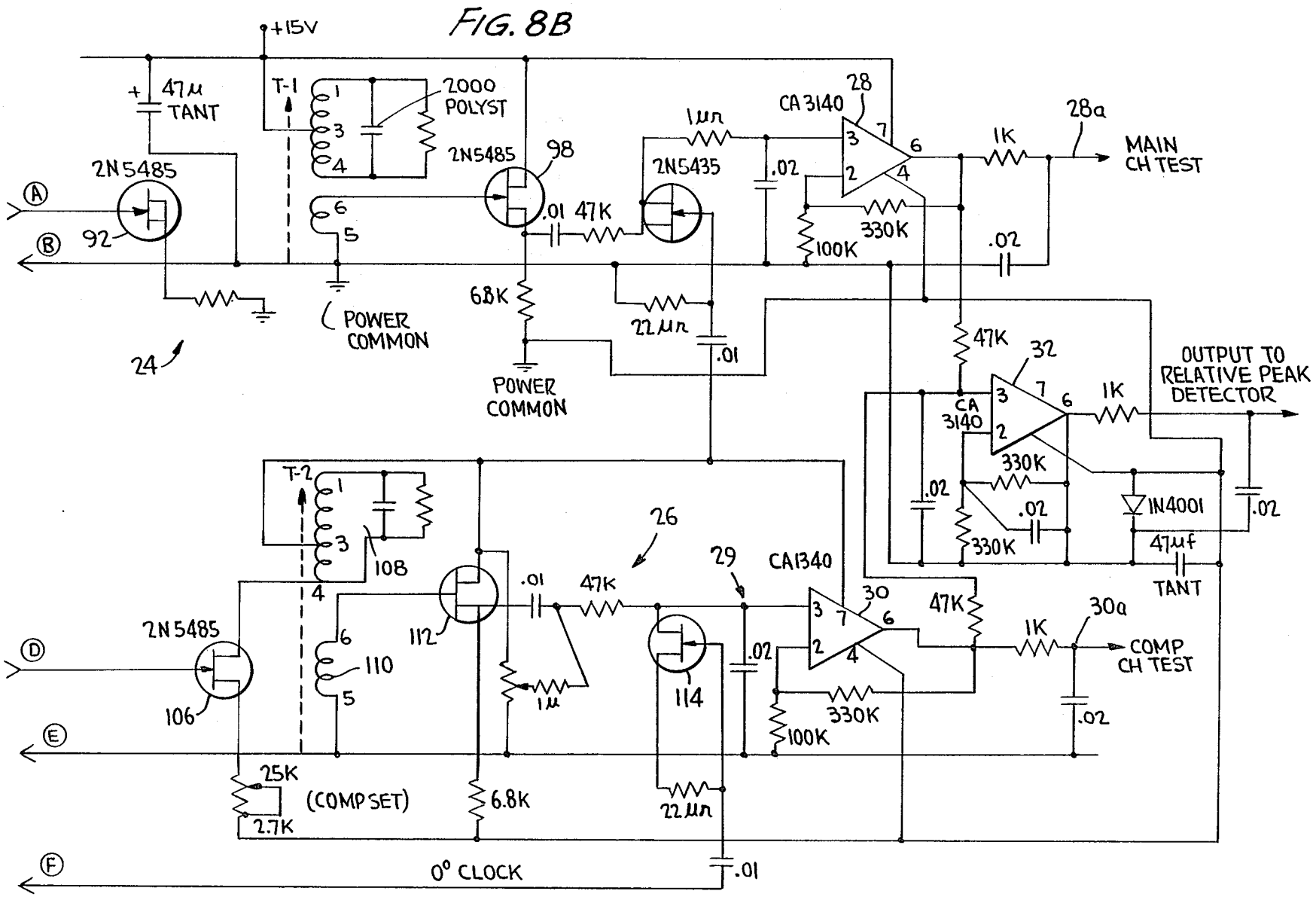

FIGS. 8A and 8B illustrate a detailed schematic of the metal tie detector circuitry which represents a preferred embodiment of the circuitry illustrated in block diagram format in FIG. 6. Quartz oscillator 10 includes NPN transistor 72 with quartz crystal 70 connected in parallel across the collector-base circuit thereof. The emitter of transistor 72 is connected to the common power ground. The output of oscillator circuit 10 is taken from the collector of transistor 72 and input to frequency divider 12 with a respective output thereof being input into each of frequency dividers 16 and 20. Frequency divider 12 may consist of a complementary metal oxide semiconductor (CMOS) seven stage, binary ripple counter, which is appropriately tapped to provide the main clock output 17 (frequency 2.6584 MHz) and compensating clock output 19 (frequency 2.6550 MHz), from flip/flop divider circuits 16 and 20, respectively. Flip/flop divider circuit 16 provides an excitation output 21 of 83.075 KHz to main transmitter drive circuit 13; and flip/flop frequency divider circuit 20 provides an excitation output to compensating transmitter drive circuit 15 at a frequency of 166.150 KHz. The output 21 of frequency drive circuit 13 includes a tuned section 74 and PNP driver transistors 76 and 78, which are coaxially coupled to a tap on transmitter coil 80.

The output 23 of frequency divider 20 is input to a transistor-compensated, transmitter drive circuit 22 which includes tuned section 82 and PNP driver transistor 84, the collector of which is coaxially coupled to the compensating transmitter loop coil 86. The compensating transmitter driver is reset by a feedback from an output 27 of frequency divider 20 to the input thereof such that the compensating transmitter section 15 is reset to provide a 90 degree phase shift between the main and compensating frequency transmitters. The feedback of frequency output 27 to the input of frequency divider 20 forms reset circuit 14, which is capacitively coupled to the input of main transmitter drive circuit by capacitor 88 as shown in FIGS. 6 and 7.

The output of main receiving loop 90 is input to FET 92 which drives tuned interstage transformer circuit 94 (83.075 KHz); and the secondary coil 96 of interstage transformer circuit 94 controls FET 98, which is connected as a source follower to buffer the interstage transformer output to phase detector circuit 25. Phase detector circuit 25 includes FET 102, the input of which is controlled by a zero clock output 17 from frequency divider 16. The output of FET 102 is input to CMOS amplifier 28, the output of which is input to CMOS summing amplifier 32. CMOS amplifier 28 has a voltage gain of aproximately 9.3 and the gain of CMOS summing amplifier 32 is set to unity by integration feedback network 33.

In the compensating frequency receiver loop 26 the output of tuned receiver coil 104 is input to FET 106, the output of which drives tuned interstage transformer circuit 108 (166.150 KHz) with the secondary coil 110 thereof controlling buffer FET 112 which is connected as a source-follower. Phase detector 29 uses FET 114 which is driven by a zero clock output 19 from frequency divider circuit 20. The output of FET 114 is input to CMOS amplifier 30 (also having a voltage gain of 4.3), the output of which is coupled to the same input of CMOS summing amplifier 32 as the output of CMOS amplifier 28, such that the respective CMOS amplifier outputs are summed. The output of summing amplifier 32 is then input to limiter 34 of the relative peak detector illustrated in FIG. 7.

Figure 9A:
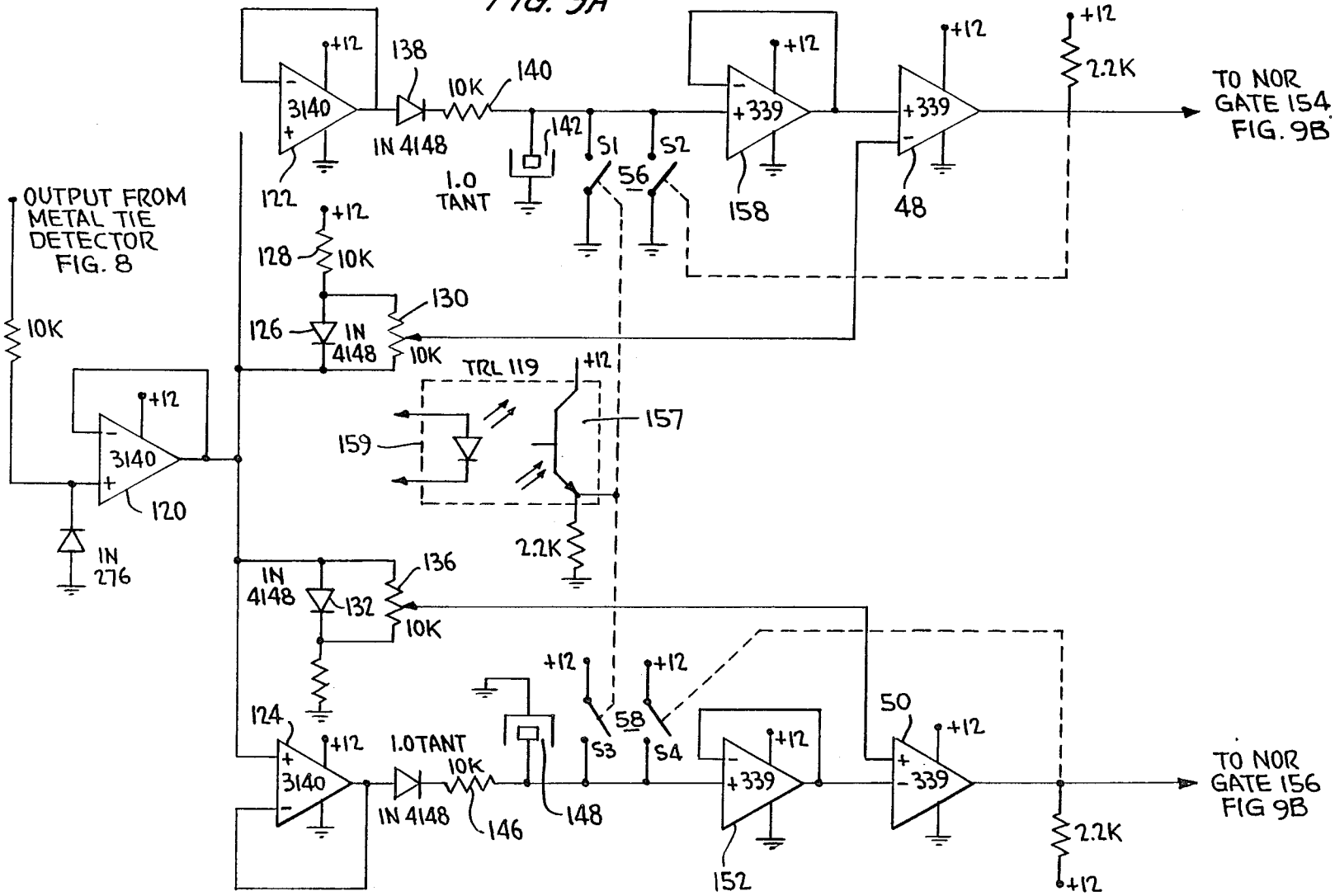
FIGS. 9A and 9B illustrate an exemplary embodiment of an electrical schematic of the relative peak detector circuitry illustrated in FIG. 7.
Figure 9B:
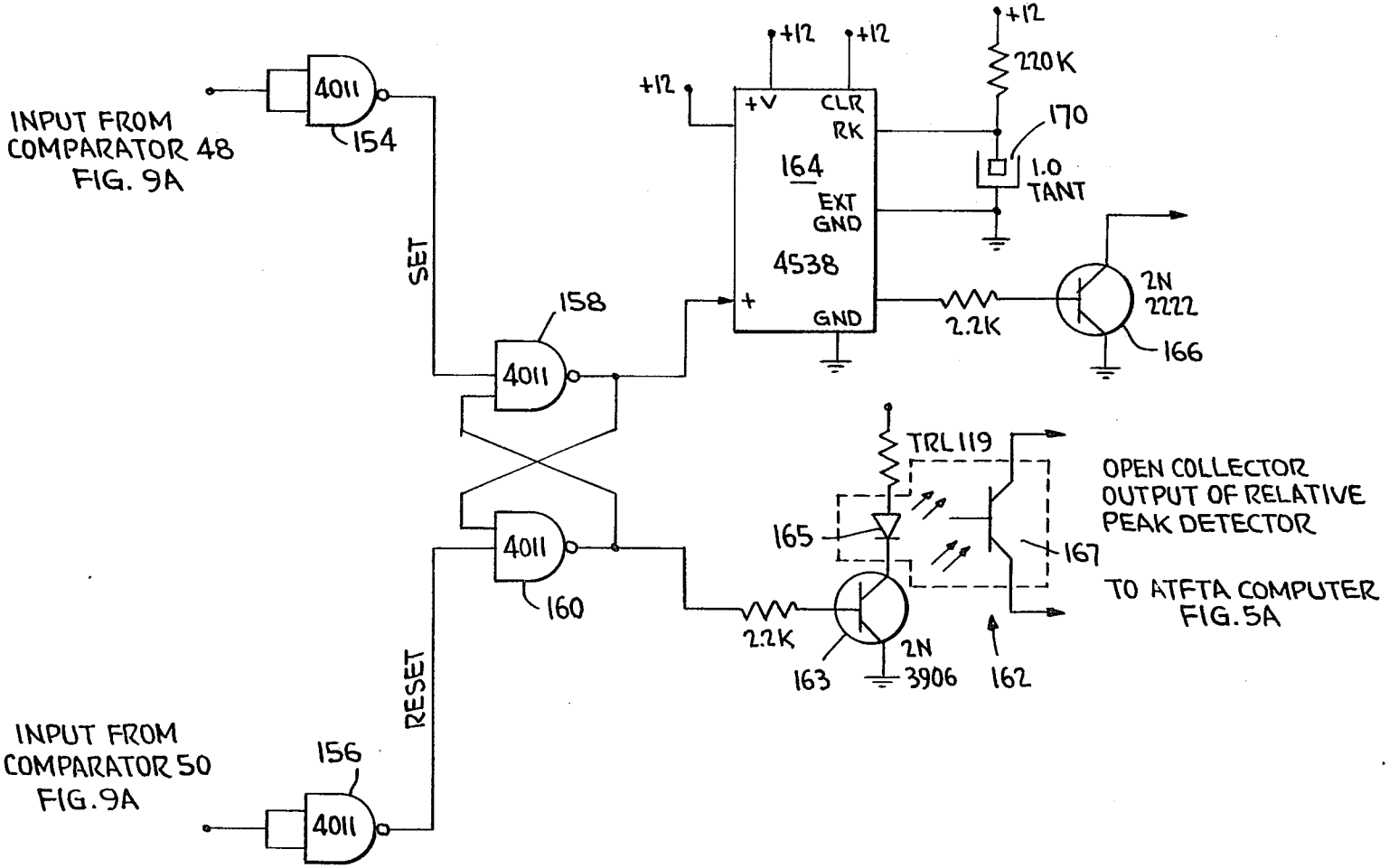

The detailed electric schematic of a preferred embodiment of the relative peak detector circuitry is illustrated in FIGS. 9A and 9B. The output from the tie plate detector circuitry is input to the relative peak detector circuit through limiting amplifier 120. The output of limiting amplifier 120 is respectively input to CMOS operational amplifiers 122 and 124 forming the input to respective peak and valley channels. The output of limiting amplifier 120 is offset in each of the peak and valley channels by respective offset circuits each consisting of a diode connected in parallel with a potentiometer such that the amount of offset can be adjusted to correspond to the voltage desired to establish a respective peak and valley indication.

In the peak channel, diode 126 is connected to the positive voltage supply through resistor 128 and potentiometer 130 is connected across diode 126. The output from potentiometer 130 is connected to the negative input of comparator 48. An identical offset circuit is provided in the valley channel by diode 132, which is connected to ground through resistor 134 with potentiometer 136 connected in parallel across diode 132. The output from potentiometer 136 is connected to the positive input of comparator 50.

The peak and valley channels and the circuits therein are identical. In addition to CMOS operational amplifier 122, the peak detector includes switching diode 138, interconnected between the output of operational amplifier 122 and low leakage tantalum capacitor 142 through resistor 140. Similarly, in the valley channel, the output of operational amplifier 124 drives diode 144 which is connected through resistor 146 to low leakage tantalum capacitor 148. Capacitor 142 is charged as the voltage input from the tie plate metal detector circuit rises. Conversely, in the valley detection circuit, capacitor 148 discharges as the voltage from the tie plate metal detector falls. The peak valley voltage is stored in capacitor 142 when the voltage from the tie plate metal detector falls due to the rectifying action of diode 138. Similarly, the valley voltage is held by capacitor 148 when the voltage from the tie plate metal detector rises due to the rectifying action of diode 144.

The voltage stored in capacitor 142 in the peak detector channel is buffered by amplifier 150 and then input to the positive input of comparator 48. The other input of comparator 48 receives the voltage at the output of potentiometer 130 in the offset circuit of the peak detector channel. Similarly, the output stored by capacitor 148 is buffered by amplifier 152 and input to the negative terminal of comparator 50. The positive input of comparator 50 is connected to the output of potentiometer 136 in the offset circuit for the valley detector channel. The respective settings of potentiometers 130 and 136 establish the specified offset signal mentioned above, which defines the threshold voltage for the operation of the peak and valley detector channels.

In the normal operation of the relative peak detector circuit, the offset signals for the peak and valley detector channels are equal. The outputs of comparators 48 and 50 are inverted by inverters 154 and 156 respectively, which inverters each consist of a NAND gate with common inputs.

In the peak detector channel, when the offset voltage from potentiometer 130 falls below the peak voltage stored by capacitor 142, the output of comparator 48 changes state, in effect calling for a reset of peak storage capacitor 142, and indicating a fall of the desired amount of offset voltage. This action also toggles the set input of output flip/flop circuit 156.

Similarly, when the offset voltage input from potentiometer 136 in the valley detector channel rises above the valley voltage stored in capacitor 148, the output of comparator 50 changes state, which requires reset of the valley storage capacitor 148, and indicates a rise of the desired amount of offset voltage. Such action also toggles the reset input of output flip/flop 156.

Reset switches S1, S2 in the peak detector channel, and reset switches S3 and S4 in the valley detector channel, are CMOS analog switches which set the respective voltages of capacitors 142 and 148 to ground potential by closure of the respective switches whenever either of the following actions occurs:

1. The output of either comparator 48 or 50 changes state to cause a reset of either storage capacitor 142 or 148 through the closing of switch S2 or switch S4. In this instance the reset action lasts only for the period that storage capacitor 142 or 148 is respectively below or above that of the respective peak or valley offset voltage.

2. With a command signal from the computer, the forward permissive signal becomes inactive, in which case the reset lasts for as long as the computer control signal is inactive.

Forward permissive signal 60 is illustrated as an input to the base of NPN transistor 157, which then causes the closing of both reset switches S1, S3, respectively, in the peak detector channel and the valley detector channel.

As was previously discussed, the forward permissive signal from the computer is generated external to the tie detection circuit. Its purpose is to inhibit the tie detector system during the operation of the tamper device when any motion in the reverse direction of travel occurs. Such motion could be caused by, for example, command of the computer system to back up the tamper apparatus to position it over a tie, the action of the tamper when tamping a tie, action by the operator of the tie detector system, gravitational action of the tamper when it is stopped on a grade, or any such other cause resulting in a reverse direction of travel. The most forward point of travel of the tamper during automatic operation can be referred to as the "line of scrimmage". Should the tamper retreat behind the "line of scrimmage" for any reason whatsoever, multiple detections of a tie would be possible. Therefore, to prevent such an occurrence, the computer system generates the forward permissive signal and makes it available to the tie detector system. The forward permissive signal is therefore in the inactive state if, and only if, the tamper is at or beyond the "line of scrimmage". The input is through an opto-isolator 159 for simplicity of the interface connection and for immunity to random noise sources.

Output flip/flop 156 is composed of a pair of CMOS NAND gates 158, 160 connected in the well-known set/reset flip/flop arrangement. The output of peak comparator 48 sets flip/flop 156 and the output of valley comparator 50 resets flip/flop 156. Once set, flip/flop 156 remains set until reset and vice-versa. One output of flip/flop 156 energizes an optical transmission circuit 162 for transmitting the information to the computer for processing. Optical transmission circuit 162 may consist of a light emitting transitor 163 or diode 165 (illustrated in FIG. 9B), the output of which is input to a fiber optic conductor (not shown) which transmits the optical signal to the computer interface where it is reconverted into an electrical signal by a light responsive transistor 167. The use of such an opto-isolator circuit provides a simple interface with the computer and affords immunity to random noise sources.

Output flip/flop 156 also drives monostable multivibrator 164, the output of which causes transistor 166 to energize a pilot lamp for approximately one-half second, thereby providing a visual indication of the basic operation of the tie detector circuitry. The one-half second time constant is established by resistor 168 and tantalum capacitor 170. The pilot lamp provides some indication that the tie detector system is powered and at least detecting something, and does not provide any indication that the system is operating at peak efficiency or accuracy, or that it is providing the proper interface with the computer. However, failure of the pilot lamp to light as the tie detector encounters ties indicates to the operator of the automatic tie finder system that something is wrong with the operation of the tie detector system itself.

DESCRIPTION OF THE COMPUTER PROGRAM FLOW

Figure 10:
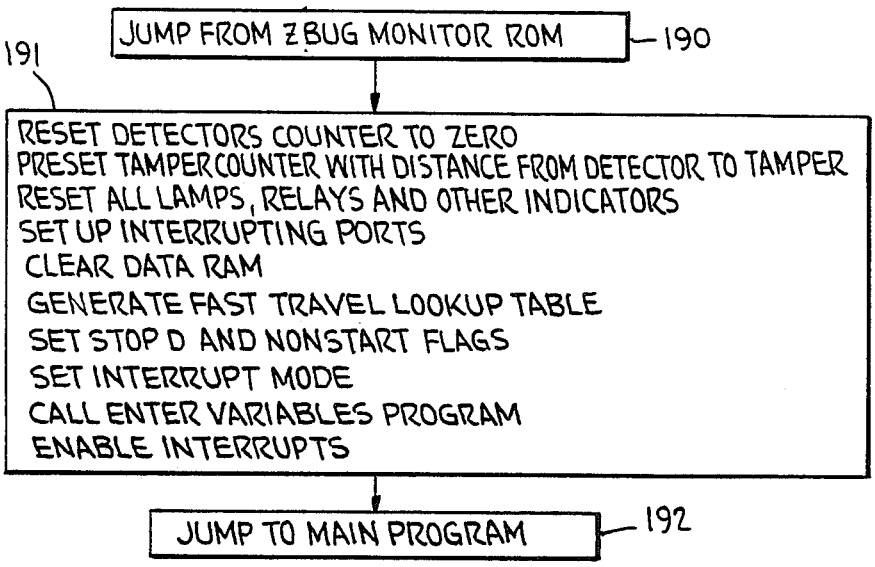

FIG. 10 illustrates an exemplary initialization program for the automatic tie finder and tamper apparatus (ATFTA) of the invention. The program JUMPS from ZBUG monitor ROM in step No. 190 to a series of initialization steps in step No. 191 comprising:

(1) Reset detectors counter to zero;
(2) Preset tamper counter with distance from detector to tamper;
(3) Reset all lamps, relays and other indicators;
(4) Set up interrupting ports;
(5) Clear data RAM;
(6) Generate fast travel lookup table;
(7) Set STOPD and NONSTART flags;
(8) Set interrupt mode;
(9) Call ENTER VARIABLES program; and
(10) Enable interrupts.

The initialization program then JUMPS in step No. 192 to the main program illustrated in FIG. 12.

Figure 11A:
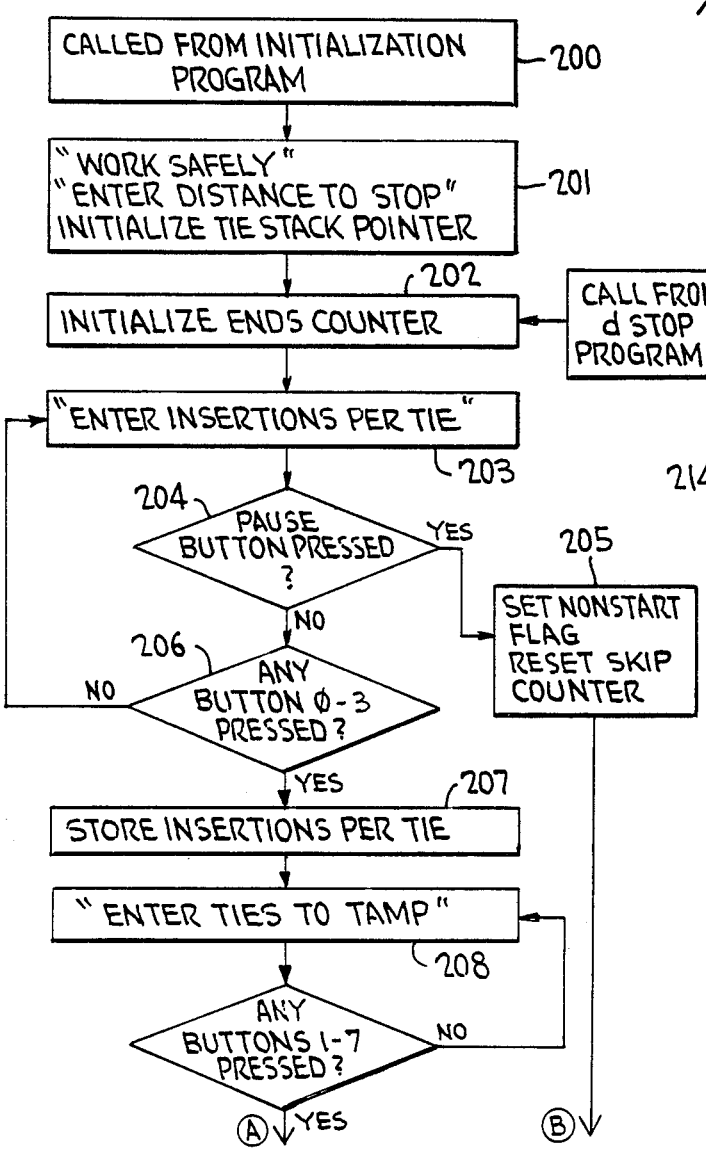
FIGS. 11A and 11B show an exemplary ENTER VARIABLES program.
Figure 11B:
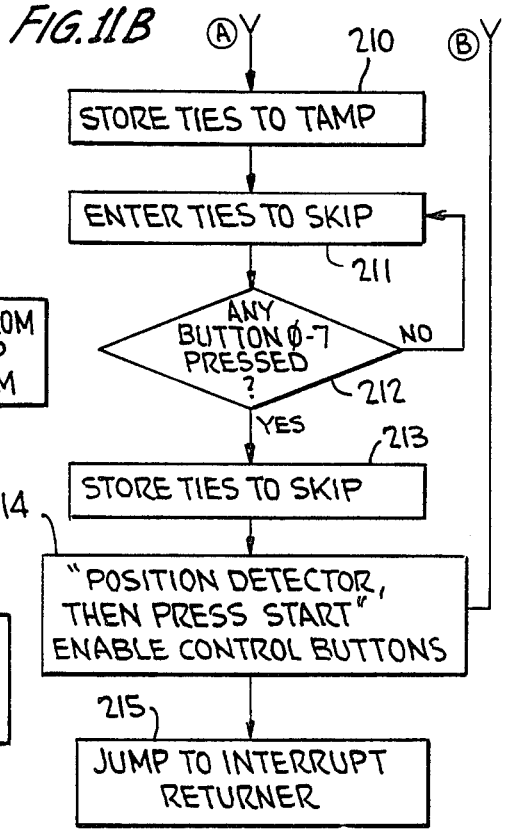

An exemplary embodiment of an ENTER VARIABLES PROGRAM is illustrated in FIGS. 11A and 11B. In step No. 200 the ENTER VARIABLES PROGRAM is called from the INITIALIZATION program described with respect to the program flow of FIG. 10. The "WORK SAFELY" and "ENTER DISTANCE TO STOP" are synthesized and annunciated, and the TIE STACK POINTER is INITIALIZED, in step No. 201. In step No. 202 the ENDS COUNTER is INITIALIZED in response to a CALL from the DSTOP program to be described more fully hereinafter. In step No. 203 the operator is required to "ENTER INSERTION PER TIE", whereupon the program flows to step No. 204 where the computer checks to determine if the PAUSE button is depressed. If that determination is affirmative, the program flows to step No. 205 to SET NONSTART FLAG and RESET the SKIP COUNTER. The program flow then SKIPS to step No. 214 in FIG. 11B. However, if the determination in step No. 204 was negative, the computer checks whether any "ENTER INSERTIONS PER TIE" operator data insert buttons 0 to 3 are pressed in step No. 206. If that check is negative, the program flow returns to step No. 203, where the computer causes the annunciation of "ENTER INSERTIONS PER TIE". If in step No. 206 any of the "ENTER INSERTIONS PER TIE" operator data insert buttons 0 to 3 are determined to have been depressed, the program flow proceeds to step No. 207 to store INSERTIONS PER TIE, and then the computer causes the annunciation of "ENTER TIES TO TAMP" in step No. 208. A determination is then made as to the actuation of any of "ENTER TIES TO TAMP" operator data insert buttons 1–7 in step No. 209, and if negative the program flow returns to step No. 208 for a repeat of the annunciation "ENTER TIES TO TAMP". If any of the "ENTER TIES TO TAMP" operator data insert buttons 1–7 has been depressed the program flow proceeds to steps Nos. 210 and 211 (shown in FIG. 11B) where TIES TO TAMP is stored and then the data "ENTER TIES TO SKIP" is entered into the system by the ATFTA operator. A determination is then made as to the actuation of any of the ENTER TIES TO SKIP operator data insert buttons 0–7 in step No. 212. A negative determination resulting in the program flow returning to step No. 211 for a repeat of the annunciation "ENTER TIES TO SKIP". If any of the ENTER TIES TO SKIP operator data insert buttons 0–7 have been depresed, then the program flow proceeds to step No. 213 where "TIES TO SKIP" is stored, and the ATFTA computer synthesizes the annunciation "POSITION DETECTOR, THEN PRESS START" and the ATFTA control buttons are ENABLED in step No. 214. The program flow then JUMPS to the INTERRUPT RETURNER program as illustrated in FIG. 28 and described hereinafter.

Figure 12C:
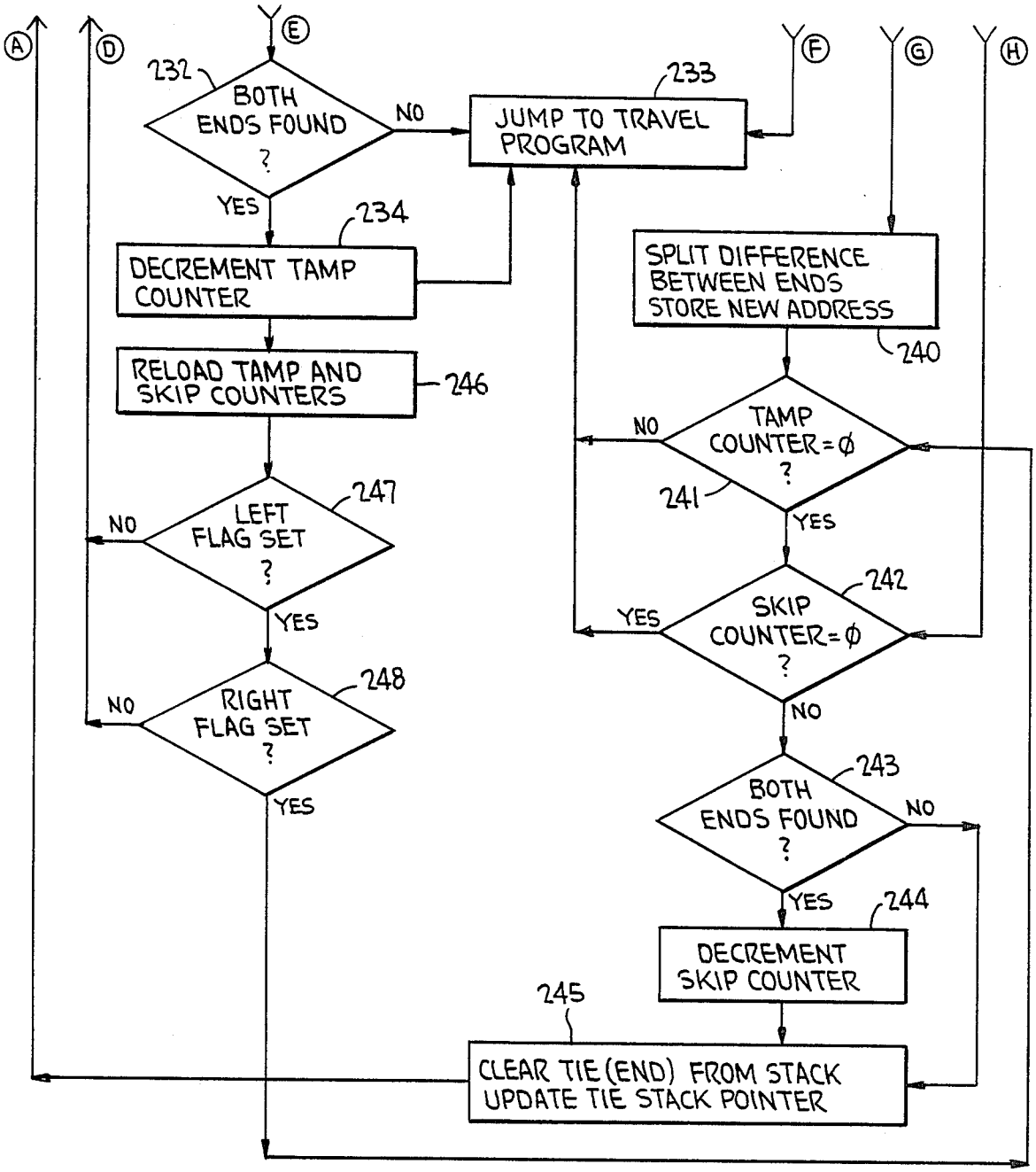

The main program for the ATFTA is shown in FIGS. 12A, 12B and 12C, and is entered from the INITIALIZATION program previously described with respect to FIG. 10. A check is first made as to whether a PAUSE has been called for by depression of the PAUSE button by the operator. If the determination is affirmative, then the program flow delays at step No. 217. If no PAUSE has been called for, the program flow proceeds to determine if TIE READY FOR TAMPING in step No. 218, and if positive the program JUMPS in step No. 219 to the TAMPING program described hereinafter with respect to the program shown in FIGS. 24A–24C. If the determination in step No. 218 was negative (tie not ready for tamping), the STPFR (STOP FORWARD) flag is checked, and if it is set the program JUMPS from step No. 220 to the FORWARD MOTION PROGRAM at step No. 221, which program is described hereinafter with respect to the program flow shown in FIG. 22. If the STPFR flag has not been set, the program proceeds from step No. 220 to determine if two ends of a tie are ready for processing in step No. 222. If the two ends of a tie are not ready for tamping, the program flow proceeds to call up the 2tp program in step No. 223, and then flows to step No. 217 to check for a PAUSE. A positive determination in step No. 222 that the two ends of a tie are ready for processing causes the program to proceed to a determination of whether the left flag is set at the first tie end in step No. 224 in FIG. 12B.

A negative determination results in the program flowing to determine if the right flag is set at the first tie end in step No. 225. A negative determination in step No. 225 causes the program to return to step No. 223, and a positive determination results in program flow to step No. 226 and a determination whether the left flag is set at the second tie end. In step No. 224, if the left flag was determined to be set at the first tie end, the program then flows to step No. 227 to determine whether the right flag is set at the second tie end. With an indication that both the right and left flags have been set at the first tie end, the program proceeds to step No. 228 where a determination is made as to whether the skew distance between the tie ends is six inches if both the right and left flags have been set at the second tie end in step Nos. 227 and 226, respectively. If step nos. 226 and 227 indicate that both the right and left flags are not set at the second tie end, then the program proceeds to determine if both tie ends have been found in step No. 229. If both tie ends are determined to have been found, the program then proceeds to step No. 230 where the ENDS COUNTER is RESET and the TIE TOTALIZER is incremented. If the skewed distance between the tie ends was greater than six inches as determined in step No. 228, then the program also flows to step No. 230. Subsequent to step No. 230, the program flows to determine if the TAMP COUNTER is equal to zero in step No. 231. If the determination is negative, then the program flows to step No. 232 (shown in FIG. 12C) to determine if both ends of the tie have been found. If that determination is negative, then the program JUMPS in step No. 233 to the TRAVEL PROGRAM as illustrated in FIG. 18, and to be more fully described hereinafter.

Figure 18:
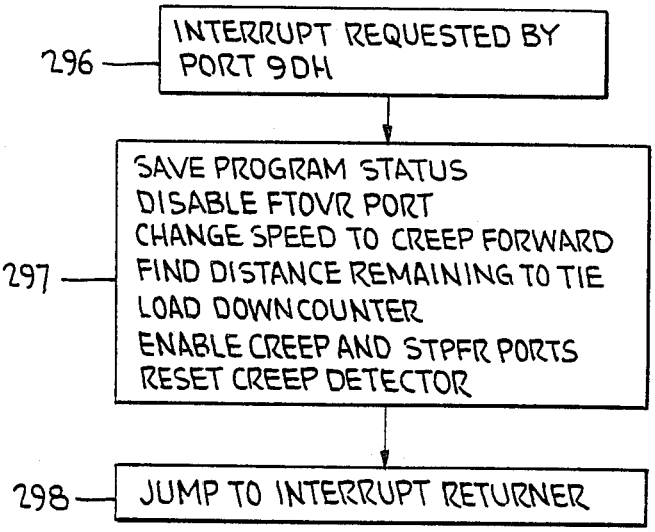

Continuing with the description of the program flow of the main program of the ATFTA as shown in FIG. 12C, with an affirmative determination of whether both ends of a tie have been found in step No. 232, the program proceeds to DECREMENT the TAMP counter in step No. 234, and then JUMPS to the TRAVEL program shown in FIG. 18.

The TRAVEL program is also entered in step No. 233 from a determination that the TAMP counter is not zero in step No. **229*a* from a prior determination that both tie ends have not been found in step No. 229 (FIG. 12B**).

Upon a positive determination that both tie ends have not been found in step No. 235 (FIG. 12B), the program flows to RESET the ENDS COUNTER in step No. 236, whereupon the program then proceeds to determine if the TAMP counter is equal to zero. A negative finding in step No. 237 causes the program to DECREMENT the TAMP counter in step No. 238, whereupon the program SKIPS to step No. 240 where the difference in distance between the tie ends is split and the new address of the tie ends is stored. A determination that the TAMP counter is equal to zero in step No. 237 then causes the program to flow directly to step No. 239 to DECREMENT the SKIP counter. Subsequent to the decrementing of the SKIP counter, the program flows to step No. 240 where the computer splits the difference between the distance between the tie ends and STORES this information in a new address. The program then proceeds to step No. 241 where the TAMP counter is INTERROGATED to see if its contents are zero. A negative finding in step No. 241 then causes the program to JUMP to the TRAVEL program as indicated by step No. 233. A positive result that the contents of the TAMP counter are not zero results in the INTERROGATION of the contents of the SKIP counter in step No. 242. A negative determination causes the program to flow to step No. 243 for a DETERMINATION of whether both ends of the tie have been found, with a positive result advancing the program to step No. 244 where the SKIP counter is DECREMENTED in step No. 244. If both ends of the tie have not been found in step NO. 243, the program SKIPS to step No. 245 where the computer CLEARS the tie end from a STACK (storage) and UPDATES the TIE STACK POINTER. Returning to step No. 242, a positive finding that the SKIP counter is equal to zero causes the program to JUMP to the TRAVEL program in step NO. 233.

Subsequent to step No. 245, the program returns to step No. 217 for a determination of whether a PAUSE has been requested, whereupon the program flow proceeds as previously described.

Continuing with the program flow shown in FIG. 12C, in step No. 246 the program accommodates the RELOADING of the TAMP and SKIP counters from which the program flows to determine if the LEFT FLAG has been set in step No. 247. A positive determination then causes the program to flow to step No. 248 where a determination is made whether the RIGHT FLAG has been set. A positive result then leads to a return to step No. 241 for INTERROGATION of the TAMP counter contents. A negative result from either of steps No. 247 or 248 causes the program to return to step No. 231 to INTERROGATE if the contents of the TAMP COUNTER are zero.

The above completes the main program for the tamping operation of the ATFTA.

Figure 13:
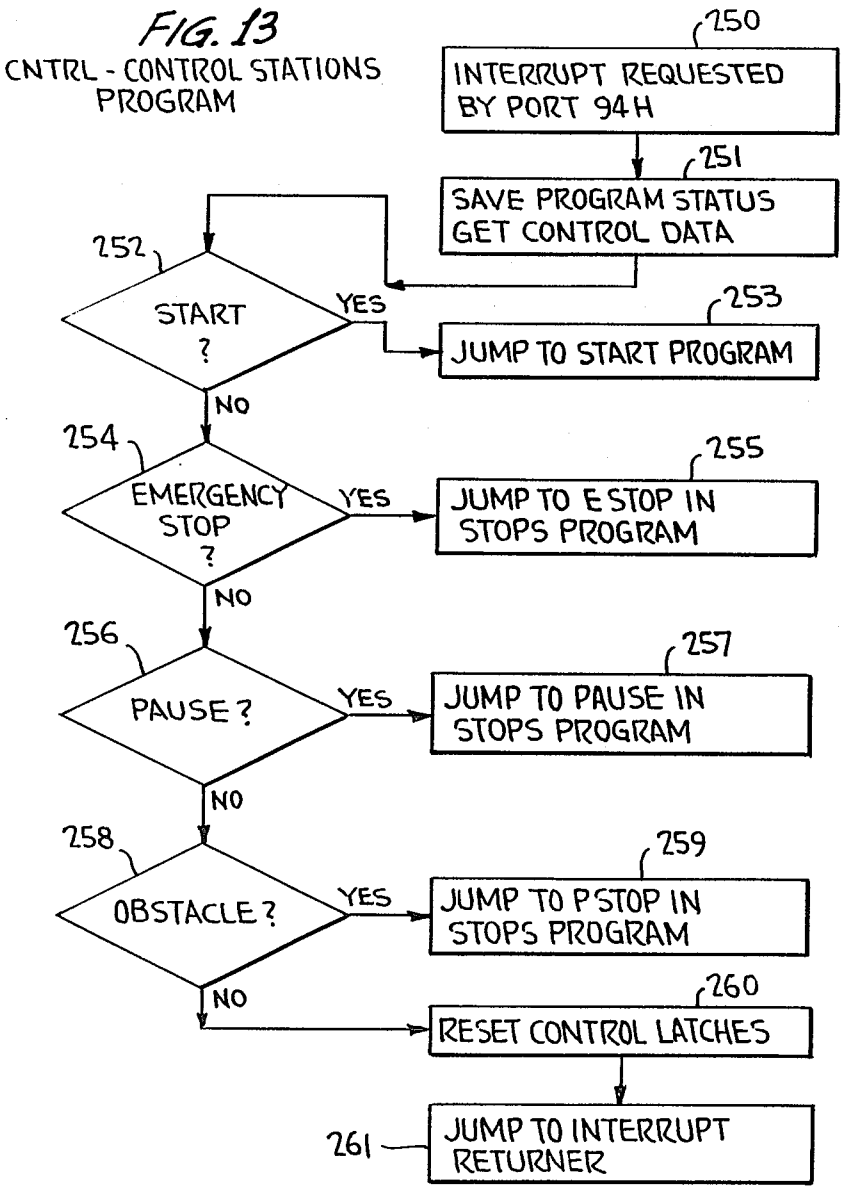

The CONTROL STATIONS program flow is illustrated in FIG. 13. This program is entered by an INTERRUPT REQUEST from a designated computer port as indicated in step No. 250, whereupon the program flows to step No. 251 to SAVE PROGRAM STATUS and obtain the CONTROL DATA. The program then determines if the START button has been actuated in step No. 252 such that the program JUMPS to the START program (to be described hereinafter with respect to FIG. 14) in step No. 253. With the START button not depressed, the program flows to step No. 254 to determine if an EMERGENCY STOP situation exists, with a positive finding causing the program to JUMP to ESTOP in the STOPS program (to be described hereinafter with respect to FIG. 15) in step No. 255. With no EMERGENCY stop condition present, the program flows to determine if there is a PAUSE condition in step No. 256. With a PAUSE indicated, the program JUMPS to PAUSE in the STOPS program as indicated by step No. 257. A no PAUSE condition resulting from step No. 256 causes the program to flow to step No. 258 to determine if there is an OBSTACLE present, with a positive finding causing the program to JUMP to PSTOP in the STOPS program as indicated in step No. 259. With no obstacle present the program proceeds to step No. 260 to RESET the CONTROL LATCHES, whereupon the program JUMPS to the INTERRUPT RETURNER program described hereinafter with respect to FIG. 28.

Figure 14:
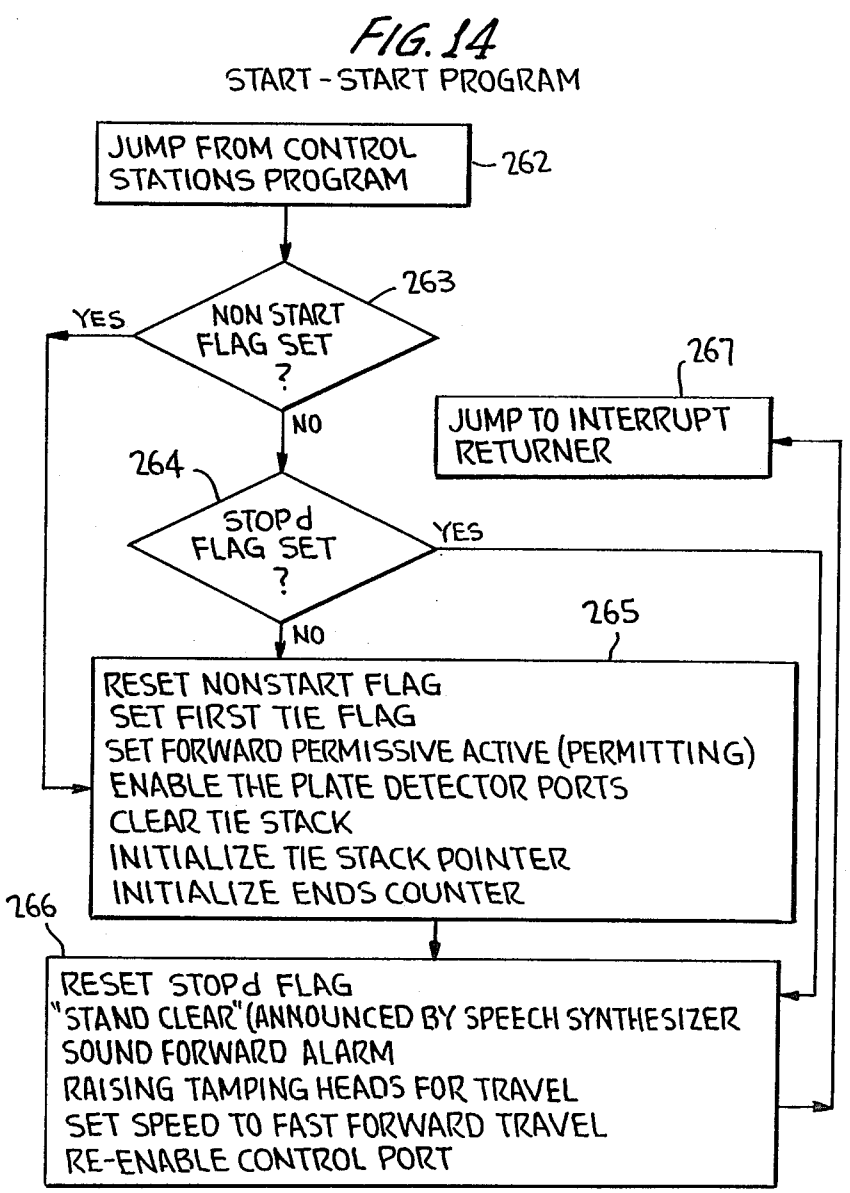

The START program is illustrated in FIG. 14 and is entered in step No. 262 from a JUMP from the CONTROL STATIONS program described above with respect to FIG. 13. In step No. 263 the status of NONSTART FLAGS SET is determined in a nonstart condition of the ATFTA, with a positive finding causing the program to SKIP to step No. 265. A negative result from step No. 263 causes the program to CHECK the STOPD FLAGS SET status in step No. 264. A positive finding causes the program to SKIP to step No. 266.

A negative result from step No. 264 or a positive result from step No. 263 causes the program to proceed to step No. 265 wherein the following steps are performed:

(1) RESET NONSTART FLAG;
(2) Set FIRST TIE FLAG;
(3) SET FORWARD PERMISSIVE to a permissive active status;
(4) ENABLE TIE UPDATE detector ports;
(5) CLEAR TIE STACK;
(6) INITIALIZE TIE STACK POINTER:
(7) INTIALIZE ENDS COUNTER.

Step No. 266 is entered from step No. 265, or from a determination that the STOPD FLAG is set in step No. 264 and the following action is undertaken:

(1) RESET STOPD FLAG;
(2) The speech synthesizer formulates the annunciated command "STAND CLEAR!";
(3) the FORWARD ALARM is sounded;
(4) The tamping heads are raised for TRAVEL of the motor drive tamper vehicle and the tie detector cart as described herein;
(5) SET speed of the motor drive tamper vehicle and the tie detector cart to FAST FORWARD TRAVEL; and
(6) RE-ENABLE the ATFTA control port.

Subsequent to step No. 266 the program JUMPS to the INTERRUPT RETURNER program as indicated by step No. 267.

Figure 15A:
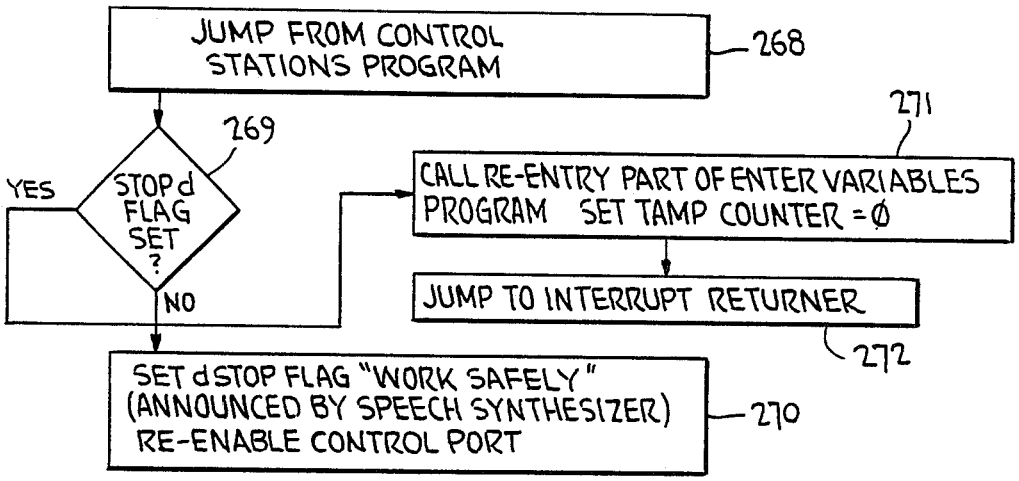
FIGS. 15A–15C show exemplary STOP programs.

One of several representative STOP programs is shown in FIG. 15A, wherein the DSTOP (DISTANCE STOP) program is entered from a JUMP from the CONTROL STATIONS program as indicated by step No. 268. The DSTOP program proceeds to determine if the STOPD FLAG (STOP DISTANCE) is set in step No. 269. A positive determination causes the program to SKIP to step No. 271 and a negative determination causes the program to proceed to step No. 270 wherein the following steps are performed:

(1) SET DSTOP FLAG;
(2) The "WORK SAFELY" announcement is prepared by the speech synthesizer and annunciated;
(3) the control port is RE-ENABLED.

Upon completion of step No. 270, the program SKIPS to step No. 272 where the DSTOP program JUMPS to the INTERRUPT RETURNER program. In step No. 271, which is entered from a positive finding in step No. 269 of the STPD FLAG SET condition, the program CALLS the re-entry part of the ENTER VARIABLES program described above and indicated in FIG. 11A, and the TAMP COUNTER is SET to zero, whereupon the DSTOP program JUMPS to the INTERRUPT RETURNER program to be described hereinafter.

Figure 15B:
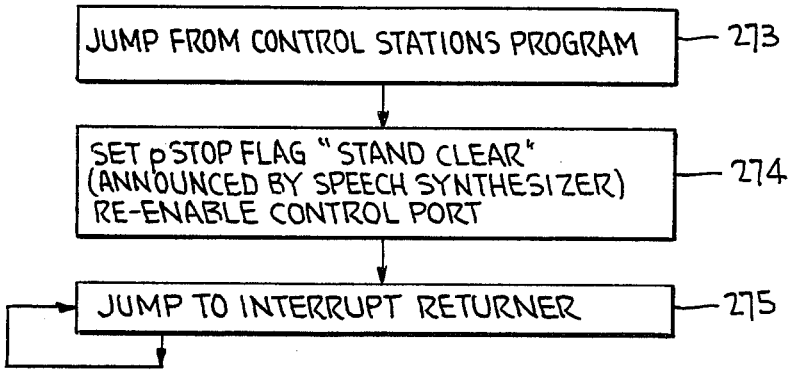

Th PSTOP program is described with respect to the program flow illustrated in FIG. 15B. The PSTOP program is entered from a JUMP in step No. 273 from the CONTROL STATIONS program described above with respect to FIG. 13. The program step No. 274 performs the following:

(1) SET PSTOP FLAG;

(2) The "STAND CLEAR" annunciation is prepared by the speech synthesizer and annunciated by command of the ATFTA computer; and (3) the contol port is RE-ENABLED.

The PSTOP program then JUMPS in step No. 275 to the INTERRUPT RETURNER program as described hereinafter.

Figure 15C:
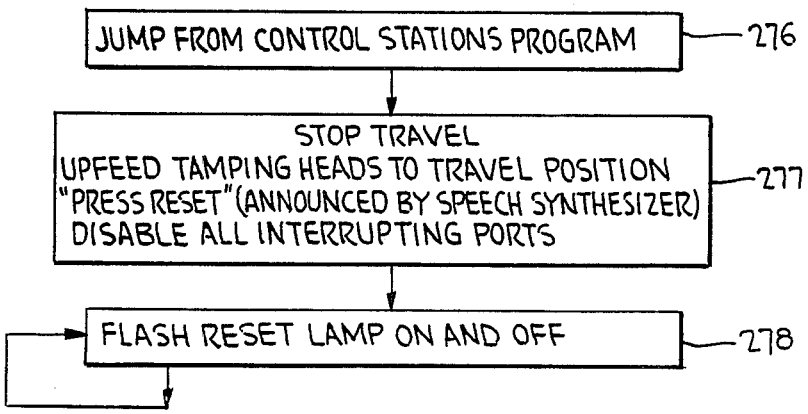

FIG. 15C shows the steps in the ESTOP (EMERGENCY STOP) program which is entered from a JUMP from the CONTROL STATIONS program (described above with respect to FIG. 13) as is indicated by step No. 276. The first ESTOP program step No. 277 performs the following functions:

(1) STOP TRAVEL of the motor drive tamper vehicle and the tie detector cart;

(2) UPFEED tamping heads to the travel position;

(3) The speech synthesizer prepares the "PRESS START" command which is annunciated; and (4) DISABLE all interrupt ports.

The ESTOP program then proceeds to step No. 278 where the reset lamp is FLASHED ON and OFF.

Figure 16A:
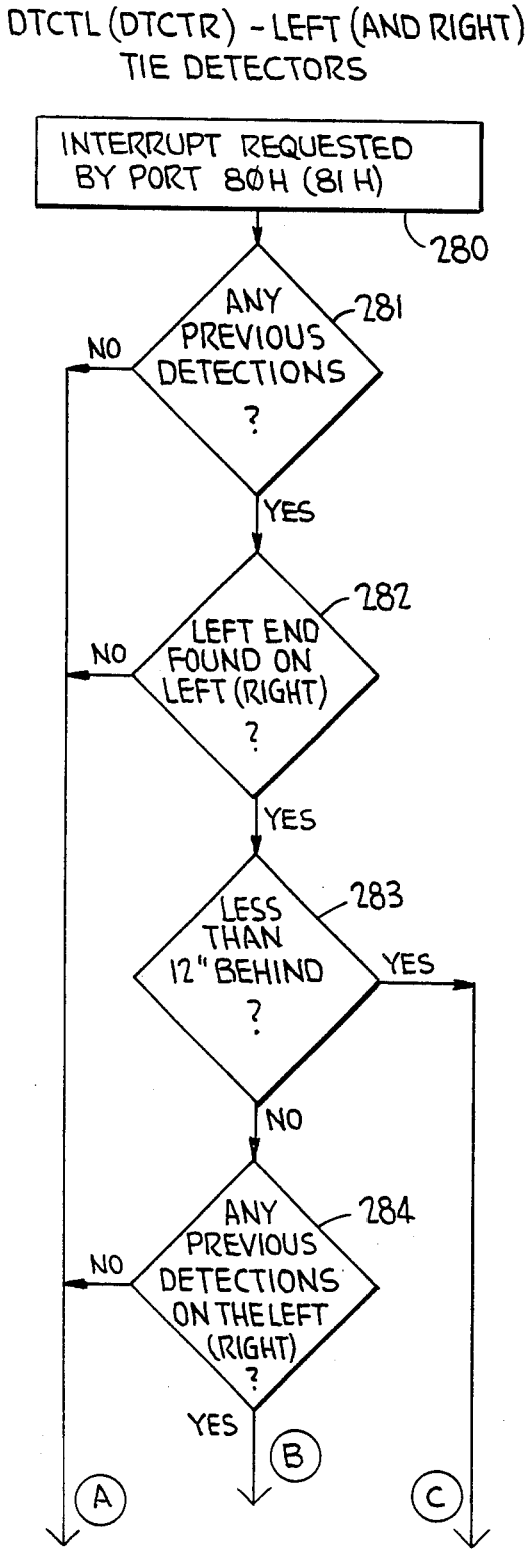
FIGS. 16A and 16B show an exemplary LEFT and RIGHT DETECTOR program.
Figure 16B:
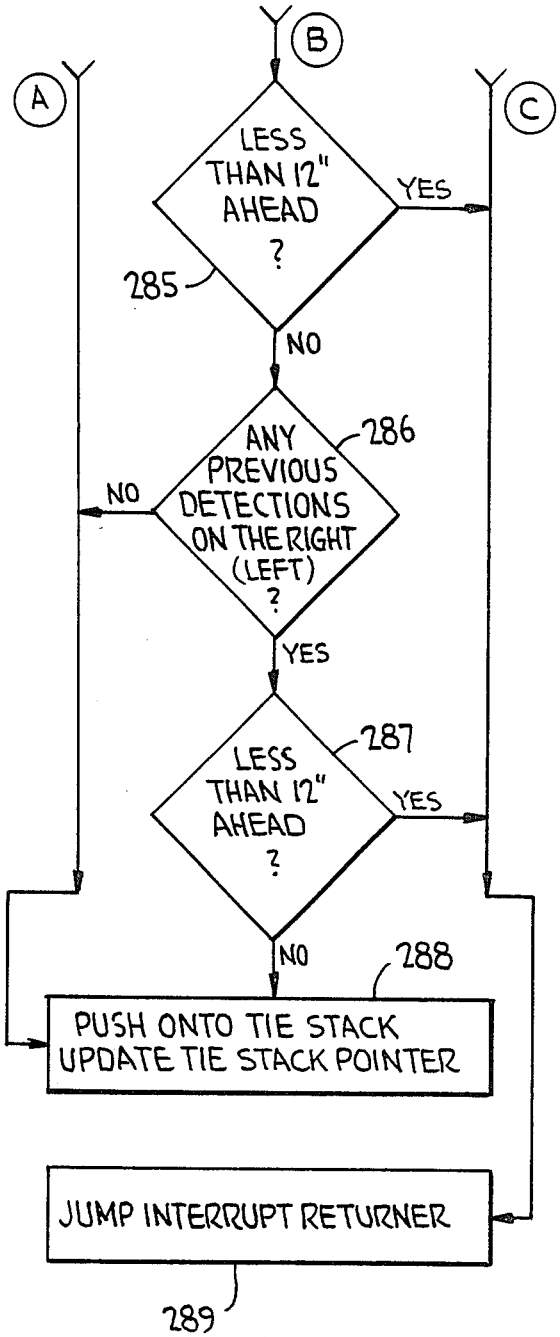

The program flow for the LEFT and RIGHT tie detectors is the same and therefore only the program for the LEFT tie detector is described herein with respect to FIGS. 16A and 16B. The difference for the right tie detector being indicated by parentheses as shown in FIG. 16B. The LEFT (RIGHT) TIE DETECTOR program is ENTERED by a request from a command from the computer through a designated port for that purpose as indicated by step No. 280 and the program flow then proceeds to DETERMINE if there are any previous tie detections in step No. 281, with a negative result causing the program to SKIP to step No. 288. A positive determination causes the program to flow to step No. 282 to DETERMINE if the left end of a tie has been FOUND by the left (right) tie detector, with a negative result causing the program to SKIP to step No. 288. A positive finding then causes the program to flow to step No. 283 to DETERMINE if the distance of the left (right) detector is less than twelve inches behind the detected tie. A positive result causes the program to SKIP to step No. 289 where the program JUMPS to the INTERRUPT RETURNER program to be described hereinafter. A negative determination in step No. 283 causes the program to flow to step No. 284 for a DETERMINATION of whether there have been any previous determinations by the left (right) tie detector, with a negative result causing the program to flow to step No. 288, and a positive result causing the program to flow to step No. 285 as shown in FIG. 16B. In step No. 285 the program DETERMINES if the left (right) tie detector is less than twelve inches behind the detected tie with a positive result causing the program to SKIP to step No. 289 for a JUMP to the INTERRUPT RETURNER program. A negative finding in step No. 285 causes the program to flow to step No. 286 wherein a DETERMINATION is made whether there are any previous detections of the right (left) detector, with a negative result causing the program to SKIP to step No. 288, and a positive finding causing the program to proceed to step No. 287. In step No. 287 a DETERMINATION is made as to whether the left (right) tie detector is less than twelve inches ahead of the tie with a positive finding causing the program to flow to step No. 289 and a JUMP to the INTERRUPT RETURNER program. A negative finding in step No. 287 causes the program to flow to step No. 288 wherein the findings from any one of steps No. 281, 282, 284 and 286 are STORED in the tie stack and the TIE STACK POINTER is UPDATED. Subsequent to step No. 288 the program proceeds to step No. 289 for a JUMP to the INTERRUPT RETURNER program described hereinafter.

Figure 17:
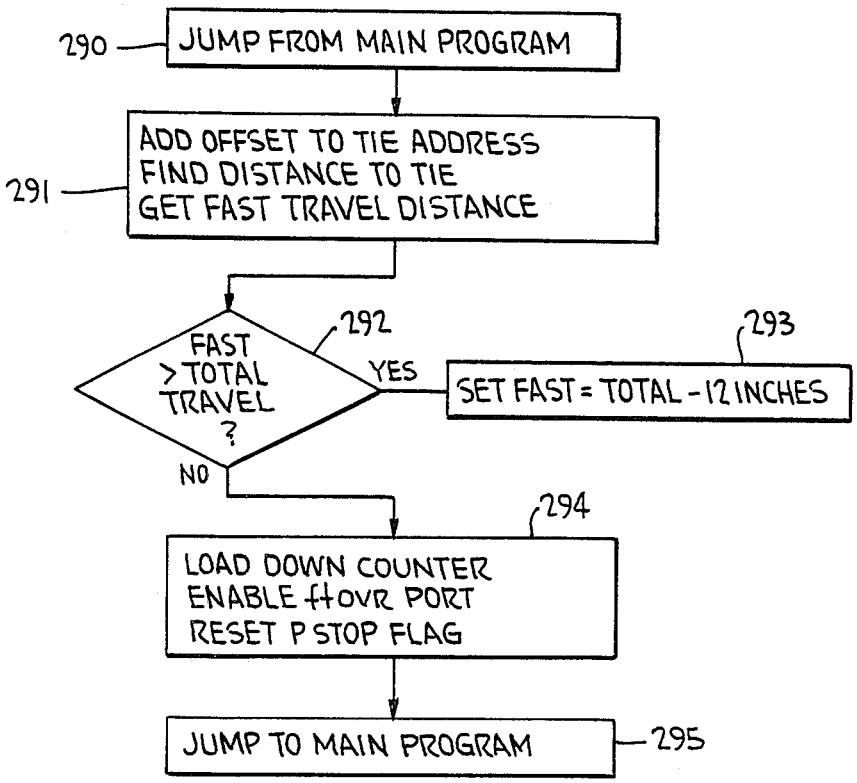

FIG. 17 illustrates the FAST TRAVEL program which is entered in step No. 290 by a JUMP from the MAIN program described above with respect to FIGS. 12A-12C. The FAST TRAVEL program then flows to step No. 291 where the following functions are carried out:

(1) ADD offset to tie address;

(2) FIND distance to tie; and (3) GET FAST TRAVEL distance.

The program then proceeds to step No. 292 where the DETERMINATION "is FAST TRAVEL greater than total TRAVEL?" is made. A positive result causes the program to flow to step No. 293 where SET FAST-=total Travel−twelve inches is CALCULATED and then the program proceeds to step No. 294.

If the determination in step No. 292 is negative, then the program flows to step No. 294 where the following functions are performed:

(1) LOAD DOWNCOUNTER:

(2) ENABLE FTOVR (FAST TRAVEL OVER) port; and (3) RESET PSTOP FLAG.

The FAST TRAVEL program then JUMPS to the MAIN program as described above with respect to FIGS. 12A-12C.

FIG. 18 illustrates the FAST TRAVEL OVER program which is entered by a computer request (interrupt) in step No. 296. The program flow then proceeds to step No. 297 where the following operations are carried out:

(1) SAVE program status;

(2) Disable FAST TRAVEL Over port;

(3) Change speed to CREEP FORWARD;

(4) FIND distance remaining to tie;

(5) LOAD DOWNCOUNTER;

(6) ENABLE CREEP and STPFD (STOP FOWARD SPEED) ports;

(7) RESET CREEP DETECTOR.

The program then JUMPS to the INTERRUPT RETURNER program as indicated in step No. 298.

Figure 19A:
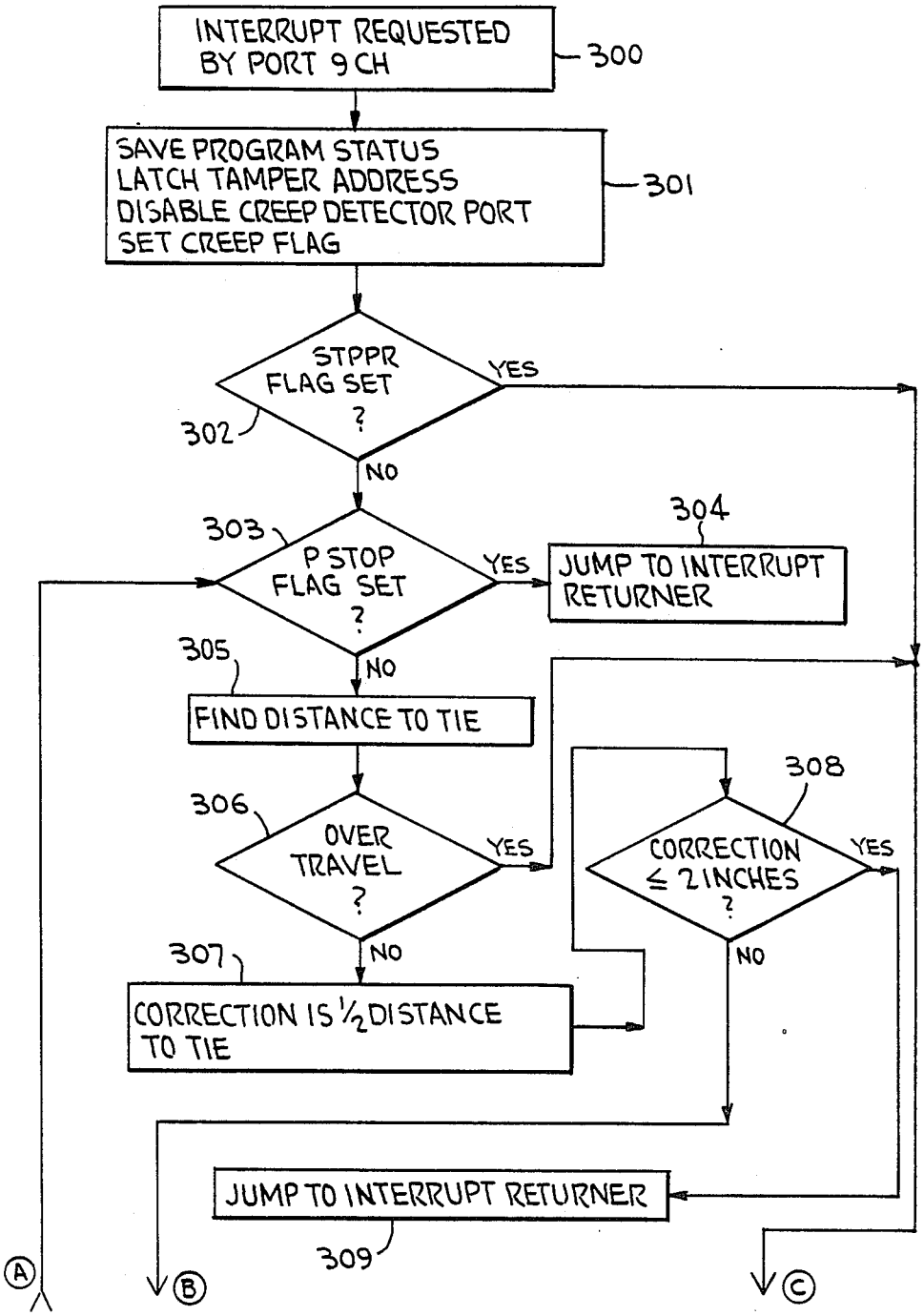

The CREEP DETECTOR program is illustrated in FIGS. 19A-19C wherein the program is entered by an INTERRUPT requested by the computer at step No. 300. The CREEP DETECTOR program then proceeds to step No. 301 where the following functions are performed:

(1) SAVE program status;

(2) LATCH TAMPER HEAD address;

(3) DISABLE CREEP DETECTOR port; and (4) SET CREEP FLAG.

The program then flows to step No. 302 to DETERMINE if the STPPR FLAG is set, with a positive response causing the program to SKIP to step NO. 312 (FIG. 19B). A negative response causes the program to advance to step No. 303 to DETERMINE if the PSTOP FLAG has been set. A positive response causes the CREEP DETECTOR program to JUMP to the INTERRUPT RETURNER program as indicated by step No. 304.

A negative determination in step No. 303 causes the program to flow to step No. 305 where "FIND distance to tie" is carried out, with the program then proceeding to DETERMINE whether the TAMPING HEADS have over-travelled a tie in step No. 306. Over-travel results in the program SKIPPING to step No. 322, and a negative result causes the program to flow to step No. 307 for the CORRECTION "½ distance to the tie" is made, whereupon the program goes to step No. 308 to DETERMINE if the correction is less than 2 inches. A positive result from that determination causes the program to JUMP to the INTERRUPT RETURNER program as indicated by step No. 309. A negative response then causes the program to proceed to step No. 310 (FIG. 19B) to DETERMINE if the detected tie is the first tie that has been detected, with a positive result causing the program to SKIP to step No. 320 (FIG. 19C). A negative response causes the program to flow to step No. 311 to ADD correction FAST TRAVEL and then proceed to the INTERRUPT RETURNER program.

The positive results from the respective determinations made in steps No. 302 and 306 ("STPPR FLAG SET?" and "OVER-TRAVEL?", respectively) cause the program to SKIP to step No. 312 where the function "FIND over-travel distance" is performed, whereupon the program proceeds to step No. 313 to DETERMINE if the TAMPING HEADS have not under-travelled. A positive response causes the program to SKIP to step No. 320 (FIG. 19C). A negative response causes the program to flow to a DETERMINATION in step No. 314 of whether it is the first tie detected. A positive response causes the program to SKIP to step No. 322 (FIG. 19C). A negative response causes the program to flow to step No. 315 where the "over-travel" is subtracted from the old "Fast Travel" value. The program then proceeds to determine if the final distance has been corrected to less than a preset value, 0 in, with a negative response causing the program to SKIP BACK to step No. 311. A positive response causes the program to flow to step No. 317 where the DETERMINATION "can two inches be subtracted" is performed with a positive response causing the program to SKIP BACK to step No. 311. A positive response causes the program to proceed to step No. 318 (FIG. 19C) where the determination "can one inch be subtracted" is determined with a positive response causing the program to SKIP BACK to step No. 311. A negative response then causes the program to flow to step No. 319 where Fast Travel is SET to the preset value, 0 in, and then the program SKIPS BACK to step No. 311.

Program step No. 320 is entered by a positive response from the DETERMINATION "FIRST TIE DETECTED?" in step No. 310. In step No. 320 a determination "is old Travel Distance greater than or equal to 40 inches?" is made. A negative response causes the program to SKIP BACK to step No. 303 (FIG. 19A) and a positive response causes the program to proceed to step No. 321 wherein the following steps are performed:

(1) OPTIMIZE entire FAST TRAVEL lookup table;

(2) RESET FIRST TIE FLAG; and (3) GO to INTERRUPT RETURNER program.

In step No. 322, which is entered by an indication that the detected tie is the first tie detected in step No. 314 (FIG. 19B), the DETERMINATION "is old FAST TRAVEL greater than or equal to 40 inches" is made. A positive response causes the program to proceed to step No. 323 wherein the steps of OPTIMIZE the entire FAST TRAVEL lookup table and RESET the FIRST TIE FLAG are performed. A negative response in step No. 322 causes the program to SKIP BACK to step No. 312 to FIND the over-travel distance.

The CREEP DETECTOR program then JUMPS to the INTERRUPT RETURNER program as indicated by step No. 324.

Figure 20:
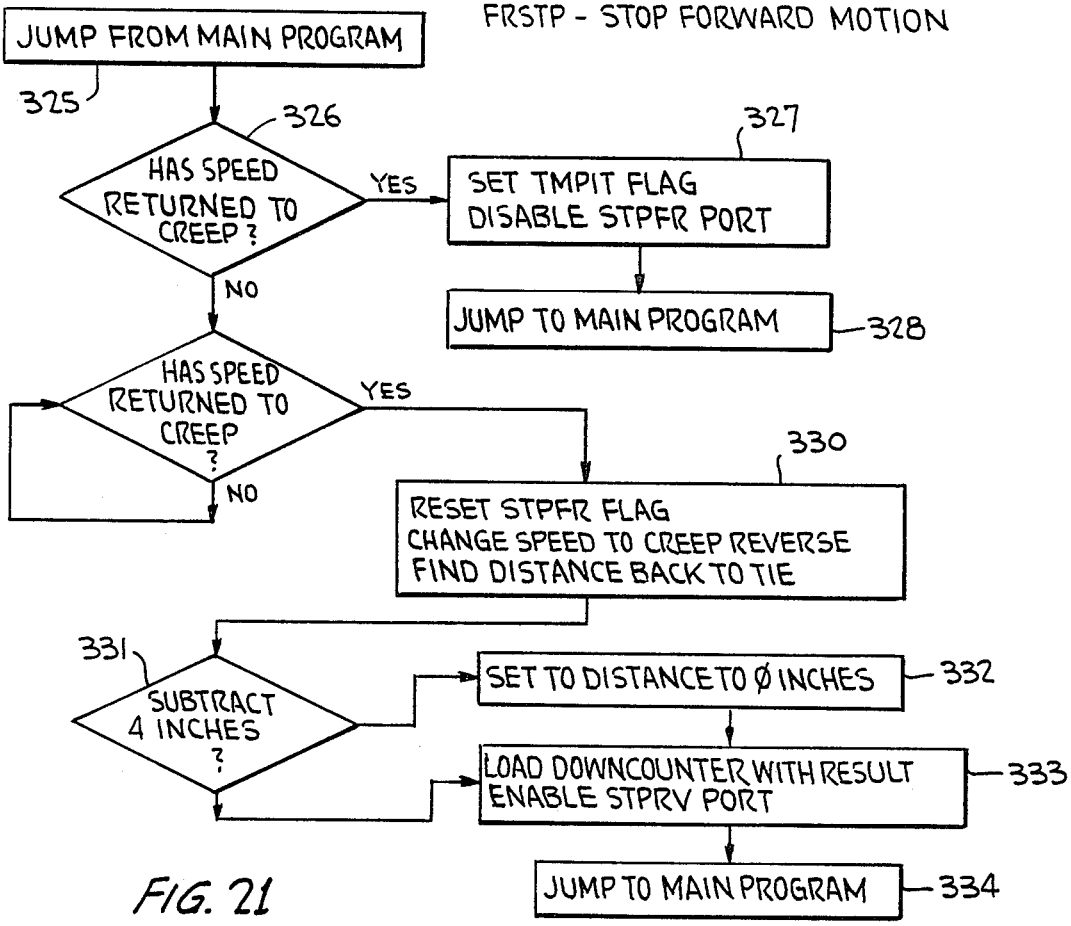

One of several exemplary ATFTA computer programs for STOP FORWARD MOTION is illustrated in FIG. 20 where the program is entered by a JUMP in step No. 325 from the MAIN program previously described with respect to FIG. 13. In step No. 326 "has speed returned to CREEP?" is DETERMINED, with a positive response causing the program to flow to step No. 327, where the functions of "SET TMPIT FLAG" and "DISABLE STPFR port" are performed. The program then continues to step No. 328 for a JUMP to the MAIN program.

With a negative response to step No. 326, the program flows to step No. 329 for a DETERMINATION of whether the speed of the motor drive tamper vehicle and the tie detector cart have returned to CREEP speed. A negative response causes the program to recycle at step No. 329. A positive response causes the program to flow to step No. 330 where the following operations are performed:

(1) RESET STPFR (STOP FORWARD) FLAG;

(2) CHANGE SPEED to CREEP REVERSE; and (3) FIND DISTANCE back to tie;

The STOP FORWARD MOTION program then continues at step No. 331 where the function "SUBTRACT 4 inches" is performed, with a negative response causing the program to flow to step No. 332 to SET the distance to zero inches. The program then flows to step No. 333.

With a positive response to the determination in step No. 331, the program flows to step No. 333 where the operations of "LOAD DOWNCOUNTER with result" and "ENABLE STPVR port" are carried out. The program then flows to step No. 334 for a JUMP to the MAIN program.

Figure 21:
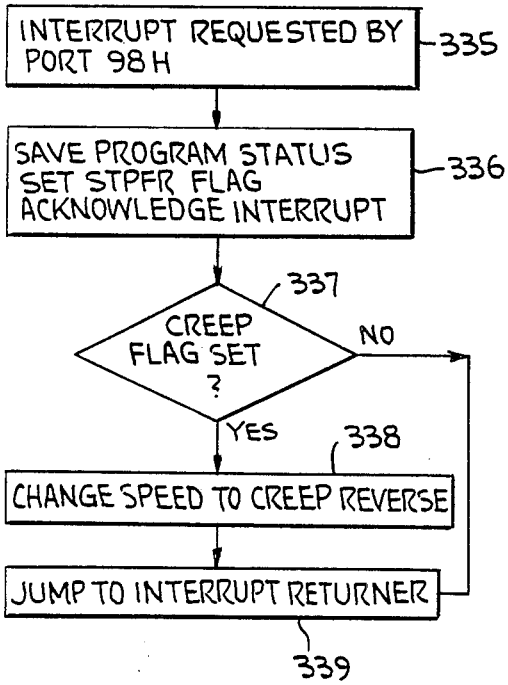

FIG. 21 illustrates an exemplary program for the STOP FORWARD MOTION mode of operation of the ATFTA, wherein the program is entered in step No. 335 from an INTERRUPT requested by the ATFTA computer. In the first program step No. 336, the following steps are carried out:

(1) SAVE program status;

(2) SET STPFR (STOP FORWARD) FLAG; and (3) ACKNOWLEDGE interrupt.

The program then proceeds to step No. 337 where "CREEP FLAG SET?" is determined, and if negative, the program SKIPS to step No. 339 and JUMPS to the INTERRUPT RETURNER mode. With the "CREEP FLAG SET" in step No. 337, the program proceeds to CHANGE speed to CREEP REVERSE in step No. 338 and then flows onto step No. 339, to enter the INTERRUPT RETURNER mode to end the STOP FORWARD MOTION program.

Figure 22:
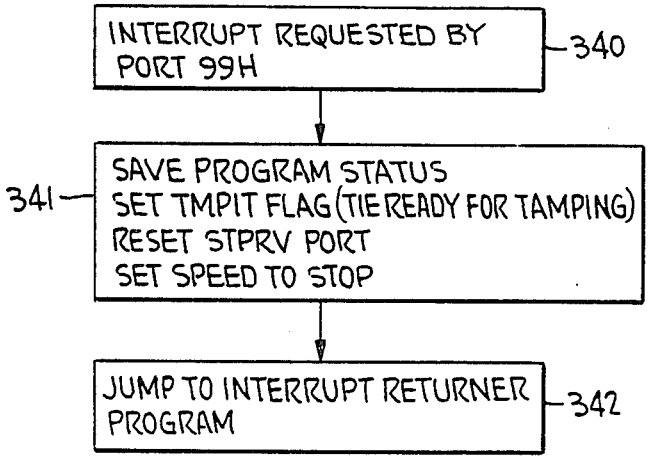

FIG. 22 illustrates an exemplary embodiment of the STOP REVERSE MOTION program for the ATFTA where the program is entered from an INTERRUPT requested by the ATFTA computer in step No. 340 and proceeds to step No. 341 where the following steps are performed:

(1) SAVE program status;

(2) SET TMPIT FLAG (tie ready for tamping);

(3) RESET STPRV (STOP REVERSE motion) Port; and (4) SET speed to STOP.

From step No. 341 the program JUMPS in step No. 342 to enter the INTERRUPT RETURNER program and end the STOP REVERSE motion program.

FIGS. 24A–24C show an exemplary TAMPING program for the ATFTA, where the program is entered through step No. 343 in a JUMP from the MAIN program. The program flows to step No. 344 where the speed is SET to STOP and the TAMPING RELAYS are RESET. The program then proceeds to step No. 345 to DETERMINE whether the number of tie insertions equals zero. With a positive determination, the program flows to step No. 346 where the steps of:

(1) CALL one second time delay;

(2) UPFEED TAMPING HEADS to the TRAVEL position; and (3) CALL up 2tp (TRAVEL program) are performed, whereupon the program proceeds to step No. 363 et. seq., and more fully described hereinafter.

In step No. 345, if the determination of the number of tie insertions is that the number was not equal to zero, then the program proceeds to step No. 347 where the following steps are performed:

(1) STORE the number of tie insertions;

(2) START PAINT POT; and (3) GEt TAMPING FLAGS.

The TAMPING program then proceeds to step No. 348 to DETERMINE whether the LEFT TAMPING FLAG is SET. With a negative determination the program flows to step No. 349 to DETERMINE if the RIGHT TAMPING FLAG is SET. The program flow for a positive determination of whether the left tamping flag was set will be described more fully hereinafter. With a negative determination that the RIGHT TAMPING FLAG has NOT BEEN SET in step No. 349, the program flows to step No. 350 (FIG. 24B), where the LEFT TAMPING FLAG is SET and the TIE INSERTIONS TOTALIZER is INCREMENTED. With the RIGHT TAMPING FLAG determined as being set in step No. 349, the program SKIPS to step No. 351, where the RIGHT TAMPING RELAY is SET to cause the program flow to SKIP to step No. 354 (more fully described below). The program flow also SKIPS to step No. 353 from step No. 350 as indicated in FIG. 24B.

Returning to step No. 349, with a positive indication that the LEFT TAMPING FLAG has been set, the program flows to step No. 354 and with a positive indication that the RIGHT FLAG has been SET, the TAMPING program SKIPS to step No. 352 where the LEFT and RIGHT TAMPING RELAYS are SET, and the TIE INSERTION TOTALIZER is INCREMENTED, whereupon the program proceeds to step No. 353 where the following steps are performed:

(1) RESET SQUEEZE PRESSURE FLAG;

(2) Delay while LEFT and RIGHT RELAY CONTACTS TRANSFER and (3) ENABLE SQUEEZE PRESSURE port and latch.

Continuing with the TAMPING program, the program then flows to step No. 353 where the following steps are performed:

(1) RESET SQUEEZE PRESSURE FLAG;

(2) DELAY while the LEFT and RIGHT TAMPING RELAY CONTACTS TRANSFER; and (3) ENABLE SQUEEZE PRESSURE PORT and LATCH.

In step No. 355 (entered after step No. 353 as illustrated in FIG. 24B), a CHECK is made as to whether the SQUEEZE FLAGS are set. With the SQUEEZE FLAGS being SET, the TAMPING program flows to step No. 356 to DETERMINE if there are any more tie insertions. With a positive indication, the program flows to step NO. 357 to JUMP to the RECYCLE program (to be described more fully hereinafter with respect to FIG. 25). If there are no more tie insertions as determined in step No. 356, the TAMPING program proceeds to step No. 357 to DETERMINE if any extra tamping pressure is required, and if the extra tamping pressure required button has been depressed by the ATFTA operator, then the program proceeds to step No. 360 (FIG. 24C). With no extra tamping pressure being required, the program flows to step No. 358 where the 2tp program is CALLED up, whereupon the program SKIPS to step NO. 363 (more fully described below with respect to FIG. 363).

Returning to step No. 355, with a negative determination that the SQUEEZE FLAGS have not been set, the program flows to step No. 359 where a CHECK is made as to whether there is a three second timeout. With no three second time-out being called for, the program returns to step No. 355. However, with a three second timeout being required, the TAMPING program SKIPS to step No. 362 (FIG. 24C).

Returning to step No. 357, with extra tamping pressure being required, the TAMPING program flows to step No. 360 (FIG. 24C) to DETERMINE whether the EXTRA TAMP FLAG has been set. With a positive determination the program SKIPS BACK to step No. 358 to CALL up the 2tp program, whereupon the TAMPING program reverts to step No. 363 FIG. 24A).

However, with the EXTRA TAMP FLAGS not set (step No. 360), the program flows to step No. 361 where the steps of (1) SET EXTRA TAMP FLAG" and (2) Set number of TIE INSERTIONS=1" are performed. The TAMPING program then reverts back to step No. 357 to JUMP into the RECYCLE program (describer hereinafter with respect to FIG. 25).

Returning to step No. 359 (FIG. 24B), where a positive indication that a three second timeout is called for, the program then JUMPS to step No. 362 where the following steps are carried out:

(1) DISABLE SQUEEZE PORT;

(2) SET DSTOP (DISTANCE STOP) FLAG;

(3) UPFEED TAMPING HEADS to TRAVEL position;

(4) SOUND alarm; and (5) "WORK SAFELY" announced by the SPEECH SYNTHESIZER.

The TAMPING program then reverts to step No. 363 (FIG. 24A), which has also been entered from previously described step Nos. 354, 358, and just described step No. 362. Returning to step No. 354 (FIG. 24A), with a DETERMINATION that no RIGHT TAMPING FLAGS have been set, the TAMPING program flows to step No. 363, where the EXTRA TAMP FLAG is RESET. The program then flows to step NO. 364 to DETERMINE if the "ADD a tie" CONTROL BUTTON has been depressed. With a negative determination, the program proceeds to step No. 365 where a check is made to DETERMINE if the "SUBTRACT a tie" CONTROL BUTTON has been depressed. If not, then the program proceeds to step No. 366 to DETERMINE if the "ADD one inch" CONTROL BUTTON was depressed. If that determination is positive, the TAMPING program flows to step 372 (described hereinbelow with respect to FIG. 24C).

Returning to step No. 365 (FIG. 24B), with an indication that the "SUBTRACT a tie" button has been depressed, the TAMPING program flows to step No. 368 to DETERMINE if the TAMP counter equals "0", and with a negative determination thereof, the program flows to step No. 369 to DECREMENT the TAMP COUNTER. With a positive determination that the TAMP COUNTER equals 0, the program flows to step No. 370 to check if the SKIP COUNTER equals 0, and with a negative determination, the TAMPING program flows to step No. 371 to DECREMENT the SKIP COUNTER. However, with a positive determination in step No. 370 that the SKIP counter equals "0", then the program SKIPS to step No. 376 (FIG. 24B).

Returning to step No. 372 (FIG. 24B), which is entered from a positive determination in step No. 366 (FIG. 24A) that the "ADD one inch" CONTROL BUTTON has been depressed, the TAMPING program ADDS one inch to the tamping offset, whereupon the program proceeds to step No. 375. From Step No. 373 (determination of whether the "SUBTRACT one inch" CONTROL BUTTON was depressed), the program flows to step No. 374 where the step of "SUBTRACT one inch from the offset" (tamping) is performed, so that the program then proceeds to step No. 375 to RESET the 0–7 INDICATOR LAMPS.

From step No. 375, the TAMPING program proceeds to step No. 376 where the following operations are performed:

(1) CLEAR TAMPED TIE from STACK;
(2) UPDATE TIE STACKPOINTER; and
(3) DISABLE SQUEEZE PORT.

The TAMPING program then enters step No. 377 where it JUMPS to the MAIN program previously described with respect to FIGS. 12A–C. Step No. 376 is also entered from step No. 370 (FIG. 23B), and in particular from a positive determination that the skip counter was equal to "0". This completes the description of the TAMPING program.

Figure 24:
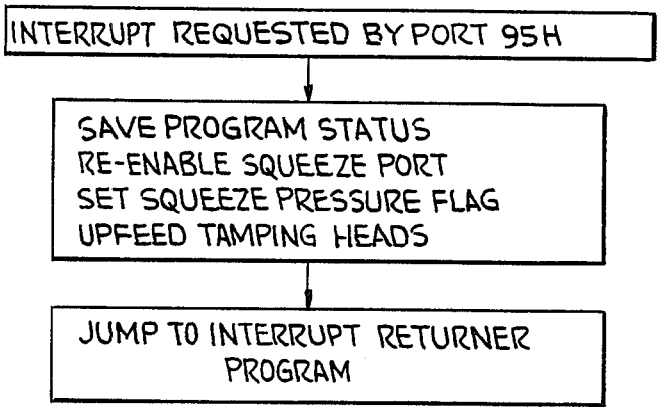

FIG. 24 illustrates the SQUEEZE PRESSURE program which is entered from a request for an interrupt from the ATFTA computer (check this) in step No. 380. The program then proceeds to step No. 381 where the following steps are carried out:

(1) SAVE program status;
(2) RE-ENABLE SQUEEZE PORT;
(3) SET SQUEEZE PRESSURE FLAG; and
(4) UPFEED TAMPING HEADS.

The program then enters step No. 382 where the SQUEEZE PRESSURE program JUMPS to the INTERRUPT RETURNER program.

Figure 23A:
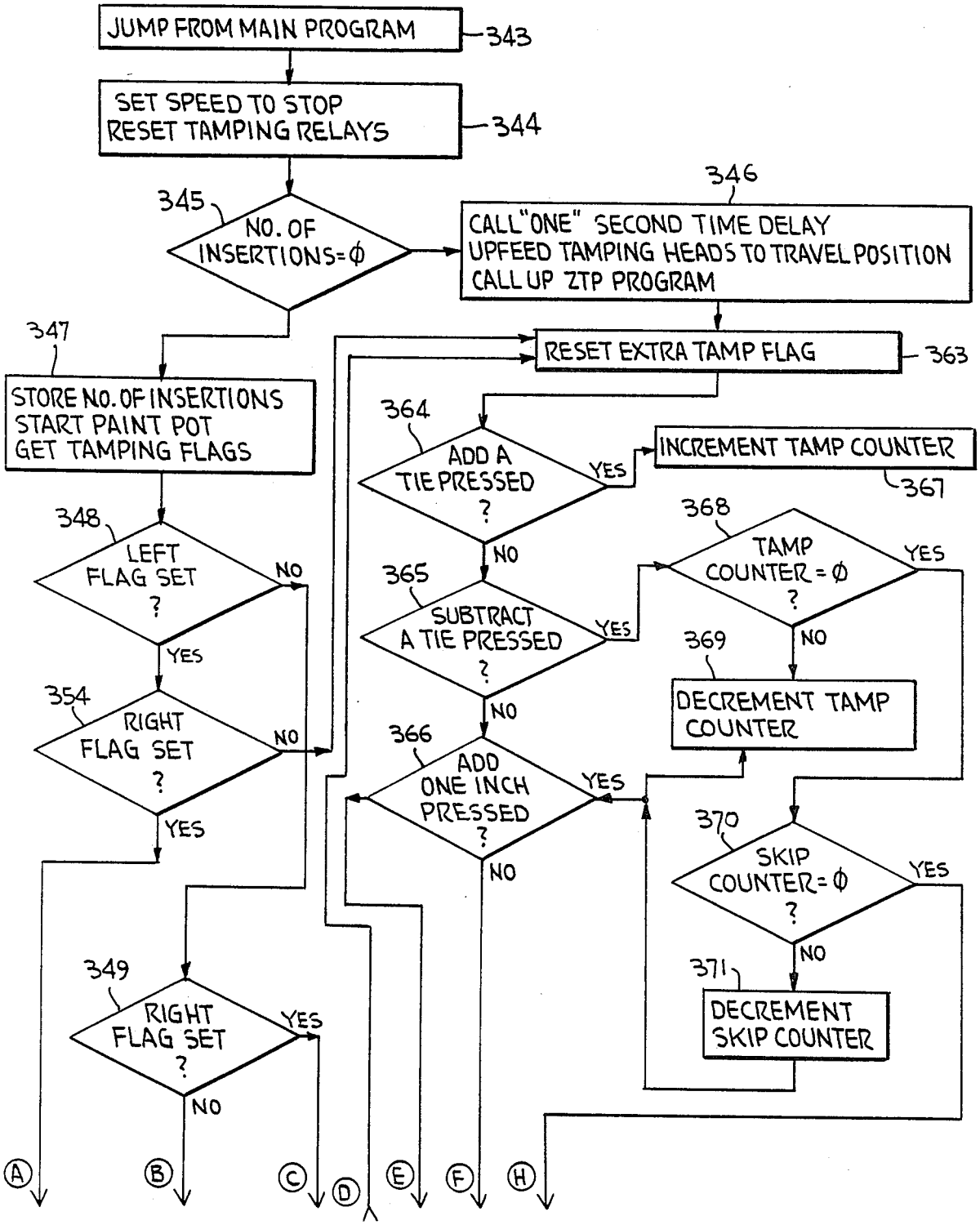
Figure 25:
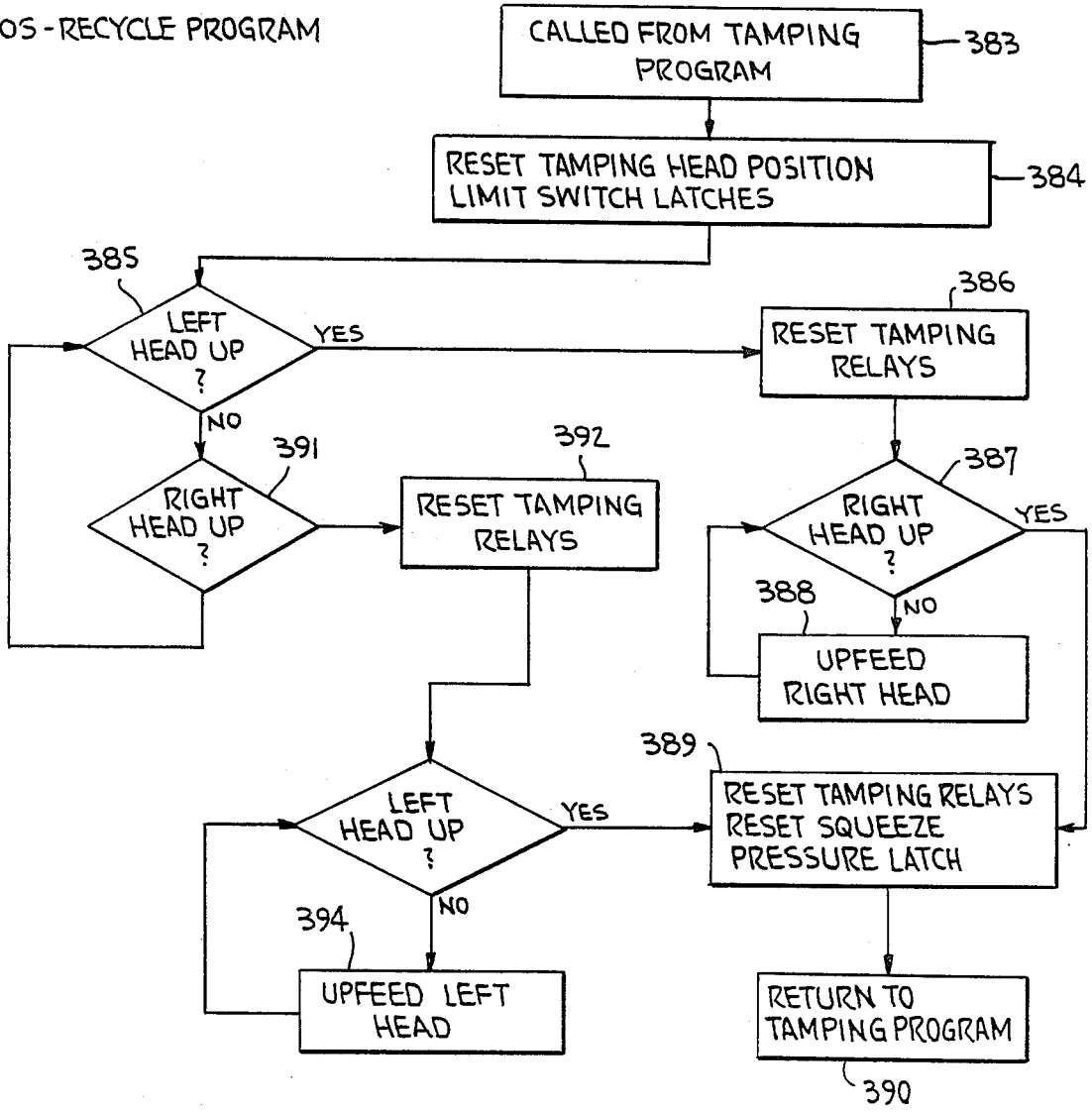

The ATFTA RECYCLE program is illustrated in FIG. 25 and is entered in step No. 383 being CALLED from the TAMPING program previously described with respect to FIGS. 23A–C. From step No. 383 the RECYCLE program proceeds to step No. 384 to RESET the TAMPING HEAD POSITION LIMIT SWITCH LATCHES, whereupon the program flows to step No. 385, where the "left head up?" DETERMINATION is made. If the left tamping head is determined to be in the "UP" position, the program flows to step No. 386 to RESET the TAMPING HEAD RELAYS. The program then proceeds to step No. 387 to determine if the "right tamping head is up?", with a negative result causing the program to flow to step No. 388 to UPFEED the RIGHT TAMPING HEAD. However, if the determination in step No. 387 is positive, the RECYCLE program proceeds to step No. 389 to (1) RESET the TAMPING RELAYS and (2) RESET the SQUEEZE PRESSURE LATCH. The RECYCLE program then enters step No. 390 where it RETURNS to the TAMPING program described above with respect to FIGS. 23A–C.

Returning to step No. 385 where the "left head up?" determination is made, and with a positive result therefrom the RECYCLE program enters step No. 391 to DETERMINE if "right tamping head is up?". With a negative determination the program returns to step No. 385. However, with a positive determination, the program flows to step No. 392 where the TAMPING RELAYS are RESET and then to step No. 393 to DETERMINE if the LEFT HEAD is "UP". With a negative determination, the program flows to step No. 394 to UPFEED the LEFT TAMPING HEAD. However, with a positive determination the RECYCLE program proceeds to step No. 389 to RESET the TAMPING RELAYS and to RESET the SQUEEZE PRESSURE LATCH, as previously described. The RECYCLE program then returns to the TAMPING program as previously described with respect to FIGS. 23A–C.

Figure 26A:
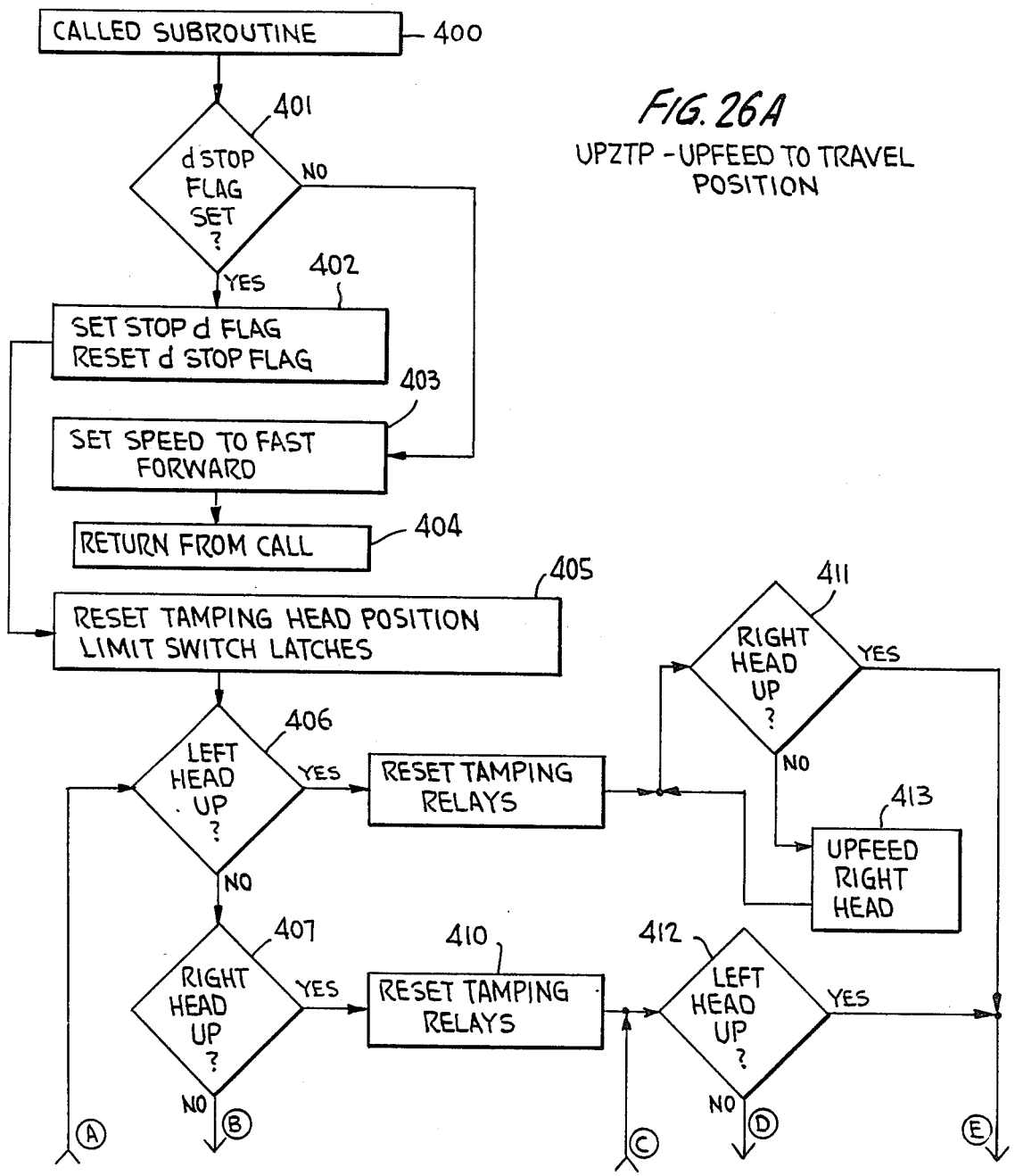
FIGS. 26A and 26B show an exemplary UPFEED-TO-TRAVEL POSITION program.
Figure 26B:
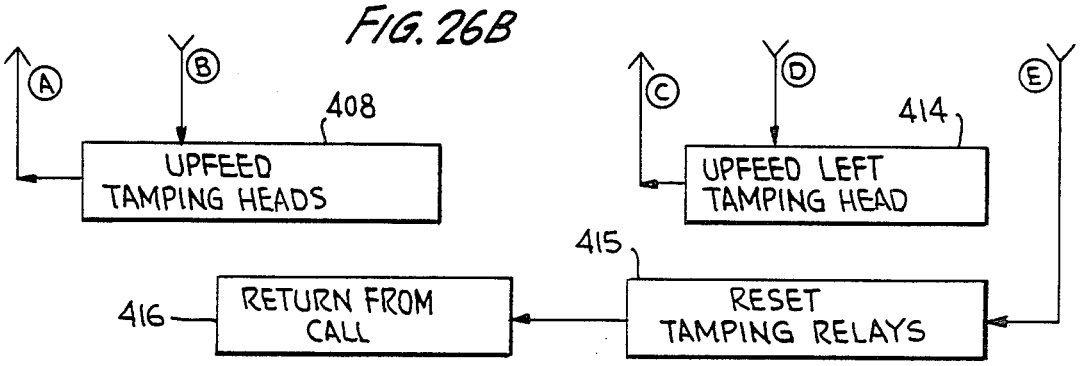

FIGS. 26A and 26B illustrates the program flow for the UPFEED-TO-TRAVEL (UP2TP) program which is entered at step No. 400 by a CALLED subroutine. The program flows to step No. 401 to determine "dstop flag set?" (DISTANCE STOP FLAG SET), and with a negative result the program SKIPS to step No. 402 to SET TRAVEL SPEED to FAST TRAVEL. With a determination that the DISTANCE FLAG is SET in step No. 401, the program proceeds to step No. 402 to (1) Set "stopd flag" (stop distance) and (2) RESET DSTOP (DISTANCE STOP) FLAG, whereupon in step No. 404 the UPFEED-TO-TRAVEL POSITION program goes to RETURN from CALL. The program flows to step No. 405 to RESET the TAMPING HEAD POSITION LIMIT SWITCH LATCHES.

With the TAMPING HEAD LIMIT SWITCHES SET, the program flows to step No. 406 and step No. 407 where the "left head up?" and "right head up?" DETERMINATIONS are respectively made, with the program preceding from step No. 406 to step No. 407 with a negative determination in step No. 406. From a negative determination in step No. 407 (RIGHT HEAD not "UP"), the program proceeds to step No. 408 to UPFEED the TAMPING HEADS, subsequent to which the program reverts to DETERMINE if the LEFT and RIGHT TAMPING HEADS are up in step Nos. 406 and 407, respectively. With a positive result from each of step Nos. 406 and 407, the program flows respectively to step Nos. 409 and 410 to RESET the TAMPING RELAYS. Subsequently the program flows to respectively DETERMINE if "right head up?" and "left head up?" in step Nos. 411 and 412. With a negative determination from each of the aforementioned determinations, the program flows respectively to step Nos. 413 and 414 to respectively UP-FEED the RIGHT and LEFT TAMPING HEADS; subsequent to which the program returns to respectively DETERMINE if the RIGHT and LEFT TAMPING HEADS are "UP" in step Nos. 411 and 412, respectively. With a positive determination from either or both of step Nos. 411 and 412, the program flows to step No. 415 to RESET the TAMPING RELAYS, and then to "RETURN from call" in step No. 416.

The delay subroutines mentioned in the above program flow description are either a first delay subroutine of approximately ½ second, or a second delay subroutine of approximately 200 milliseconds. These delays are software delays to enable the logic functions of the program flow to be accomplished.

The INTERRUPT RETURNER program RESTORES the program status and ENABLES the interrupts, and includes the function of RETURN from an interrupt.

Tie detector housings 2-46 and 2-47 containing the main and compensating loops of the tie detection mechanism are suitably mounted to the tie detector cart 2-42 to be adjustable in a vertical as well as two mutually perpendicular horizontal directions, preferably corresponding to the longitudinal and lateral axes of the tie detector cart. Before the tie detector cart is commissioned for use, the sensitivity of the tie detector is adjusted by physically displacing each of tie detector housings 2-46 and 2-47 in each of the aforementioned three directions (if necessary) to maximize the respective outputs of amplifiers 28 and 30 (FIGS. 6 and 8) with each of tie detector housings positioned over a tie plate mounted to a crosstie. In fact, several trial detections of a series of tie plates on a corresponding series of crossties are taken so that the sensitivity of the tie detector circuitry disclosed in FIGS. 6 and 8 can be optimized before the tie detector cart 2-42 is ready for actual use in the ATFTA system disclosed herein.

The mounting structure of the tie detector housings 2-46 and 2-47 should be adjustable in the three aforementioned mutually perendicular directions, to preferably 1/16" in all such directions, and of course be sufficiently rugged and durable to maintain such settings with use in the field, to reduce the necessity of constant and repetitive sensitivity adjustments. The actual structure of the mounting assembly for the tie detector housings 2-46 and 2-47 is well within the ordinary skill of one familiar with railroad components and their use.

Preferably, the relative peak detector circuitry illustrated in FIGS. 7 and 8 should be located in the respective electrical component tie detector housings 2-48 and 2-49 to be adjacent the metal tie plate detector circuitry also housed therein. This reduces or eliminates the effects of noise, stray capacitance, etc., on the output of the metal tie plate detector circuitry. The digital output signal from the relative peak detector circuitry is then transmitted via cable within coupling member 1-52 to the computer 5A-1 located within cab 1-14. Electrical component tie detector housings 2-48 and 2-49 are preferably made of a non-electrical conducting and non-magnetic material to reduce the effects of electrical and magnetic interference.

It is the intention of the inventors that the present invention not be limited to the embodiments specifically described, but that it include all such modifications and variations that would be obvious to those skilled in art to which the invention pertains. The scope of the invention should be determined by the equivalents of the various terms as recited in the following annexed claims.

What is claimed is:

1. Automated tie finder and tamping apparatus, comprising:

motor drive tamper vehicle (MDTV) means for providing motive power and including means for tamping ties;

a tie detector cart (TDC) attached to said MDTV and including means for detecting tie plates with movement of said MDTV and TDC; and means for controlling the movement of said MDTV and TDC and responsive to said tie plate detecting means for positioning said tamping means over a succession of ties to be tamper, and including means for generating a forward permissive signal for blocking detection of an already detected tie by said tie detecting means subsequent to the detection of said already detected tie in a series of ties to prevent erroneous tie detections.

2. Automated tie finder and tamping apparatus as claimed in claim 1, wherein said controlling means further includes means for initiating different travel modes of movement of said MDTV and TDC and including a fast travel mode to move said MDTV and TDC in a forward direction along the rails at an optimum speed and controlling deceleration of said MDTV and TDC for accurately positioning said tamping means over a series of ties to be tamped.

3. Automated tie finder and tamping apparatus as claimed in claim 2 further comprising distance encoder means for determining the distance travelled by said MDTV and TDC and generating a signal output representative thereof, and wherein said means for initiating travel modes is responsive to said distance signal output for entering an optimum speed mode of travel for positioning said TDC at a given tie upon determination of a minimum distance to said given tie in a series of ties to be tamped.

4. Automated tie finder and tamping apparatus as claimed in claim 3 wherein said optimum speed causes said MDTV and TDC to move in a reverse direction to the tie to be tamped upon detection of an overshoot condition.

5. Automated tie finder and tamping apparatus as claimed in claim 2 wherein said control means further includes means for generating a travel lookup table upon "power-up" or a reset condition of said controlling means.

6. Automated tie finder and tamping apparatus as claimed in claim 2 wherein said control means further includes means for uplifting said tamping means into a raised position in the fast travel mode.

7. Automated tie finder and tamping apparatus as claimed in claim 1 further comprising means for manually inserting tie detection and tamping variables into said control means and said control means further includes means for for controlling tamping of ties and responsive to said manually inserted tie detection and tamping variables.

8. Automated tie finder and tamping apparatus as claimed in claim 7, wherein said manual data insertion means includes means for inserting at least the number of ties to be tamped, the number of tamping insertions per tie, and the number of ties to be skipped, and said tamping means is responsive to said manually inserted data during a tamping operation.

9. Automated tie finder and tamping apparatus as claimed in claim 8 wherein said tamping means includes at least two pairs of oppositely disposed tamping heads each said pair of tamping heads being positioned at respective end regions of a tie to be tamped and adapted for simultaneous tamping on both sides of both tie ends.

10. Automated tie finder and tamping apparatus as claimed in claim 9 wherein said control means initiates simultaneous, repetitive tamping insertions on at least one tie in a series of ties to be tamped by both said two pairs of tamping heads.

11. Automated tie finder and tamping apparatus as claimed in claim 10 further comprising means for independently lifting each pair of said two pairs of tamping heads to each of two positions, namely a first position where each of said two pairs of tamping heads are cleared of the rails for movement of said MDTV and TDC, and a second position lower than each pair of tamping heads in said first position so that each of said pair of tamping heads is prepositioned for successive tamping insertions.

12. Automated tie finder and tamping apparatus as claimed in claim 8 wherein said control means initiates separate, sequential tamping insertions by each pair of said two pairs of tamping heads on at least one tie in a series of ties to be tamped.

13. Automated tie finder and tamping apparatus as claimed in claim 1 wherein said tie detector cart includes a pair of metal tie plate detectors mounted in spaced relationship such that each metal plate detector detects the tie plate of a respective rail.

14. Automated tie finder and tamping apparatus as claimed in claim 13, wherein said tie detector cart is made of pultruted plastic material.

15. Automated tie finder and tamping apparatus as claimed in claim 14, wherein said tie detector cart includes a pair of guide wheels mounted on respective front and rear axles for maintaining said TDC on the rails.

16. Automated tie finder and tamping apparatus as claimed in claim 1 further comprising means for detecting the presence of obstacles to at least one of said front, side and rear of said MDTV and TDC.

17. Automated tie finder apparatus as claimed in claim 1 further comprising means for annunciating commands and instructions in the immediate vicinity of said MDTV and TDC.

18. Apparatus as claimed in claim 1 wherein said means for generating said forward permissive signal includes two channel comparator means for determining the peak and valley of the signal from said means for detecting with said peak signal representing the positioning of said vehicle over one of said metallic objects and said valley signal representing the positioning of said vehicle midway between two of said metallic objects.

19. Apparatus as claimed in claim 1, wherein said means for detecting includes two channel comparator means for respectively determining the peak and valley of the signal from said means for detecting with the peak signal representing the positioning of said means for detecting over a tie plate and the valley signal representing the positioning of said means for detecting midway between two of said tie plates.

20. Apparatus as claimed in claim 19, wherein said means for detecting further includes means in each of said two channels for providing a threshold level associated respectively with said peak and valley signals such that said means for detecting only generates a detection signal when said detection signal exceeds said threshold level.

21. A method for automatically detecting and tamping crossties, comprising:

moving a motor driven tamper vehicle (MDTV) and tie detector means along railroad track having crossties to be tamped;

controlling the movement of said MDTV and tie detector means; and controlling the movement of said MDTV and tie detector means in response to the detection of said tie plates to position tamping heads mounted on said MDTV over a succession of ties to be tamped, and blocking detection of a previously detected tie subsequent to the detection of said previously detected tie in a series of ties to prevent erroneous tie detections.

22. A method of automatically detecting and tamping crossties as claimed in claim 21 further comprising initiating different travel modes of movement of said MDTV and TDC and including a fast travel mode to move said MDTV and TDC in a forward direction along the rails at an optimum speed and controlling deceleration of said MDTV and TDC to accurately position said tamping heads over a succession of ties to be tamped.

23. The method as claimed in claim 22 further comprising determining the distance travelled by said MDTV and TDC and generating a signal output representative thereof, and causing said MDTV and TDC to enter an optimum speed mode of travel for positioning said TDC at a given tie upon determination of a minimum distance to said given tie in a series of ties to be tamped.

24. The method as claimed in claim 23 wherein initiation of said optimum speed is in a reverse direction of travel of said MDTV and TDC.

25. The method as claimed in claim 22 further comprising the generation of a distance travel lookup table upon turning on of power or resetting of the MDTV and TDC control means.

26. The method as claimed in claim 22 wherein the tamping means are uplifted into a raised position in the fast travel mode.

27. The method as claimed in claim 21 further comprising the manual insertion of tie detection and tamping variables into the control means for said MDTV and TDC and subsequently tamping at least one in a series of ties with said manually inserted tie detection and tamping variables.

28. A method as claimed in claim 27 wherein said manually inserted tie detection and tamping variables includes the number of ties to be tamped, the number of tamping insertions per tie and the number of ties to be skipped and subsequently tamping at least one of a series of ties using said tie detection and tamping variables.

29. A method as claimed in claim 28 wherein the movement of said MDTV and TDC, the detection of said crossties and the tamping thereof are controlled by a programmed computer for controlling said means for detecting, said control means and said tamping means.

30. A method as claimed in claim 21 wherein both ends of at least one tie in a series of ties are simultaneously tamped on both sides thereof.

31. A method as claimed in claim 30 further comprising successively, repetitively tamping said at least one tie in a series of ties.

32. A method as claimed in claim 21 wherein each end of at least one tie in a series of ties is successively tamped on both sides thereof.

33. A method as claimed in claim 21 further comprising the lifting of said tamping heads to each of two positions, namely a first position where each of two pairs of oppositely disposed tamping heads are lifted to a first position clear of the rails during the fast travel movement of said MDTV and TDC, and a second position lower than said first position for prepositioning said tamping heads for successive tamping insertions of at least one tie in a series of ties to be tamped.

34. Apparatus for automatically detecting at least one metallic object in a series of metallic objects lying along a path in a repetitive pattern, comprising:

means for detecting the location of said at least one metallic object and being mounted on a vehicle for movement along said path;

means for controlling movement of said vehicle and including means responsive to said detecting means for positioning said vehicle over a detected metallic object, and means for generating a forward permissive signal for blocking detection of a previously detected metallic object subsequent to the detection of said previously detected metallic object to prevent erroneous metallic object detections; and means for initiating different travel modes of movement of said vehicle, said travel modes including a fast travel mode to move said vehicle in a forward direction along said path at an optimum speed and controlling deceleration of said vehicle for accurately positioning it at a detected one of said metallic objects.

35. Apparatus as claimed in claim 34 further comprising distance encoder means for determining the distance travelled by said vehicle and generating a signal output representative thereof, and wherein said means for initiating travel modes is responsive to said distance signal output for entering an optimum speed mode of travel for positioning said vehicle at a metallic object upon detection of a minimum distance to said metallic object.

36. Apparatus as claimed in claim 35 wherein said optimum speed causes said vehicle to move in a reverse direction to the metallic object upon detection of an overshoot condition.

37. Apparatus as claimed in claim 34 wherein said control means further includes means for generating a travel look-up table upon "power-up" or a reset condition of said means for controlling.

38. Apparatus as claimed in claim 34 wherein said means for generating said forward permissive signal includes two channel comparator means for respectively determining the peak and valley of the signal from said means for detecting with said peak signal representing the positioning of said vehicle over one of said metallic objects and said valley signal representing the positioning of said vehicle midway between two of said metallic objects.

39. Automated tie finder and tamping apparatus, comprising:

motor drive tamper vehicle (MDTV) means for providing motive power and including means for tamping ties;

a tie detector cart (TDC) made of pultruted plastic material and including a pair of metal tie plate detectors mounted in spaced relationship such that each metal plate detector detects tie plates of a respective rail with movement of said MDTV and TDC; and means for controlling the movement of said MDTV and TDC and responsive to said tie plate detecting means for positioning said tamping means over a succession of ties to be tamped.

40. Automated tie finder and tamping apparatus as claimed in claim 39, wherein said TDC includes a pair of guide wheels mounted on respective front and rear axles for maintaining said TDC on the rails.

41. A method for automatically detecting and tamping crossties, comprising:

moving a motor drive tamper vehicle (MDTV) and tie detector means along railroad track having crossties to be tamped;

detecting the tie plates of said crossties with movement of said MDTV;

and controLling the movement of said MDTV and the tamping of said crossties in response to the detection of said tie plates to position tamping heads mounted on said MDTV over a succession of ties to be tamped by the steps of:

manually inserting into a computer data representative of at least the number of ties to be tamped, the number of tamping insertions per tie, and the number of ties to be skipped and stored in respective tamp, skip and insertion counters;

tamping the crossties in accordance with said manually inserted data and the detected tie plates;

determining whether one or both ends of a respective crosstie has been detected; and performing successive tamping operations in accordance with a predetermined tamping program including the decrementing of said tamp and skin counters with operation of the tamping program.

42. A method as claimed in claim 41, wherein the performance of said successive tamping operations includes at least one of the simultaneous, repetitive tamping insertions on at least one crosstie in a series of crossties and separate, sequential tamping insertions on at least one crosstie in a series of crossties to be tamped.

43. A method as claimed in claim 42, wherein the performance of said successive tamping operations further includes raising said tamping heads to each of two positions, namely a first position wherein said tamping heads are cleared of the rails for rapid movement of said MDTV and a second position wherein said tamping heads are raised to a position closer to the rails than said first position so that said tamping heads are prepositioned for successive tamping operations.

44. A method as claimed in claim 41, further comprising determining the distance of said tamping heads from a detected tie plate and wherein controlling the movement of said MDTV and tie detector means includes adjusting the speed of travel in accordance with the determined distance of said tamping heads to a detected crosstie.

45. A method as claimed in claim 44, wherein controlling the movement of said MDTV and tie detector means further includes a creep speed mode of travel upon determination of a minimum distance to a given crosstie in a series of crossties to be tamped.

46. A method as claimed in claim 44, wherein the controlling of movement of said MDTV and tie detector means further includes the initiation of different travel modes of movement and at least including a fast travel mode to move said MDTV and tie detector means in a forward direction along said rails at an optimum speed and controlling deceleration of said MDTV and tie detector means to accurately position said tamping heads over a succession of crossties to be tamped.

47. A method as claimed in claim 44, further comprising the generation of a distance travel look-up table to control the movement of said MDTV and tie detector means.

48. A method as claimed in claim 41, further comprising controlling the movement of said MDTV and tie detector means from a location remote from said MDTV and tie detector means.

49. A method as climed in claim 41, further comprising the annunciation of commands to warn operating personnel of the operation of said MDTV and tie detector means.

* * * * *